US007692644B2

(12) United States Patent
Eriguchi et al.

(10) Patent No.: US 7,692,644 B2
(45) Date of Patent: Apr. 6, 2010

(54) DISPLAY APPARATUS

(75) Inventors: Takuya Eriguchi, Yokosuka (JP); Norio Mamba, Kawasaki (JP); Yoshinori Aoki, Mobara (JP)

(73) Assignee: Hitachi Displays, Ltd. (JP)

( * ) Notice: Subject to any disclaimer, the term of this patent is extended or adjusted under 35 U.S.C. 154(b) by 31 days.

(21) Appl. No.: 11/871,278

(22) Filed: Oct. 12, 2007

(65) Prior Publication Data

US 2008/0180430 A1 Jul. 31, 2008

(30) Foreign Application Priority Data

Oct. 13, 2006 (JP) ..... 2006-279898
Jan. 11, 2007 (JP) ..... 2007-003375

(51) Int. Cl.
*G09G 5/00* (2006.01)

(52) U.S. Cl. ..... 345/212; 345/89; 345/92; 345/96; 345/99; 345/100; 345/209; 345/690

(58) Field of Classification Search ..... 345/76–83, 345/87–100, 204–215, 690–699
See application file for complete search history.

(56) References Cited

U.S. PATENT DOCUMENTS 6,473,077 B1 10/2002 Takenaka et al.
6,781,605 B2 * 8/2004 Kudo et al. ..... 345/690
6,856,373 B2 * 2/2005 Sekido et al. ..... 349/181
7,006,065 B1 * 2/2006 Sugawara et al. ..... 345/89
7,023,458 B2 4/2006 Kudo et al.
7,227,560 B2 * 6/2007 Kudo et al. ..... 345/690
7,450,099 B2 * 11/2008 Kudo et al. ..... 345/89
2002/0186230 A1 * 12/2002 Kudo et al. ..... 345/690
2002/0186231 A1 * 12/2002 Kudo et al. ..... 345/690
2005/0017992 A1 * 1/2005 Kudo et al. ..... 345/690
2005/0253785 A1 11/2005 Miyasaka et al.
2007/0080905 A1 * 4/2007 Takahara ..... 345/76
2007/0188623 A1 8/2007 Yamashita et al.

FOREIGN PATENT DOCUMENTS

JP 2002-366112 12/2002
JP 2005-173387 6/2005
JP 2006-024176 1/2006

OTHER PUBLICATIONS

Japanese Office Action dated Oct. 7, 2008.

* cited by examiner

*Primary Examiner*—Vijay Shankar
(74) *Attorney, Agent, or Firm*—Antonelli, Terry, Stout & Kraus, LLP.

(57) ABSTRACT

In a display apparatus of a hold type represented by a TFT liquid crystal display, blurring of dynamic picture when the dynamic picture is displayed is improved. One frame is divided into dark fields and light fields. A dark brightness gradation voltage approaching to display of black as near as possible is generated in the dark fields and a light brightness gradation voltage for compensating the brightness reduced by the dark fields is generated in the light fields. At this time, low gradation voltages (V0P to V20P) or high gradation voltages (V43P to V63P) in the dark or light brightness gradation voltages are set to the same potential.

18 Claims, 31 Drawing Sheets

FBI ON REGISTER DATA
γ SET VALUE SWITCH SIGNAL
109
VDH
422
VRP0
V0P
SW
1R
410
400
423
PRP0
V1P
SW
1R
411
401
424
PRP1
V2P
SW
2R
412
402
425
PRP2
V4P
SW
2R
413
403
426
PRP3
V8P
SW
6R
414
404
427
PRP4
V20P
428
SRP0
8R
415
429
SRP1
V43P
430
PRP5
SW
6R
416
405
431
PRP6
V55P
SW
2R
417
406
432
PRP7
V59P
SW
2R
418
407
433
PRP8
V61P
SW
1R
419
408
434
PRP9
V62P
SW
1R
420
409
435
VRP1
V63P
4R
421
GND
POSITIVE POLARITY LADDER CIRCUIT

FBI ON REGISTER DATA
γ SET VALUE SWITCH SIGNAL
110
VDH
522
VRP0
V0N
SW
1R
510
500
523
PRP0
V1N
SW
1R
511
501
524
PRP1
V2N
SW
2R
512
502
525
PRP2
V4N
SW
2R
513
503
526
PRP3
V8N
SW
6R
514
504
527
PRP4
V20N
528
SRP0
8R
515
529
SRP1
V43N
530
PRP5
SW
6R
516
505
531
PRP6
V55N
SW
2R
517
506
532
PRP7
V59N
SW
2R
518
507
533
PRP8
V61N
SW
1R
519
508
534
PRP9
V62N
SW
1R
520
509
535
VRP1
V63N
4R
521
NEGATIVE POLARITY LADDER CIRCUIT
GND

CONTRAST EMPHASIS REGISTER DATA
CONTRAST EMPHASIS SWITCH REGISTER DATA
109
VDH
1422
VRP0
V63P
SW
1R
1410
1400
1423
PRP0
V62P
SW
1R
1411
1401
1424
PRP1
V61P
SW
2R
1412
1402
1425
PRP2
V59P
SW
2R
1413
1403
1426
PRP3
V55P
SW
6R
1414
1404
1427
PRP4
V43P
1428
SRP0
8R
1415
1429
SRP1
V20P
1430
PRP5
SW
6R
1416
1405
1431
PRP6
V8P
SW
2R
1417
1406
1432
PRP7
V4P
SW
2R
1418
1407
1433
PRP8
V2P
SW
1R
1419
1408
1434
PRP9
V1P
SW
1R
1420
1409
1435
VRP1
V0P
4R
1421
GND
POSITIVE POLARITY LADDER CIRCUIT

CONTRAST EMPHASIS REGISTER DATA
CONTRAST EMPHASIS SWITCH REGISTER DATA
110
VDH
1522
VRP0
V0N
SW
1R
1510
1500
1523
PRP0
V1N
SW
1R
1511
1501
1524
PRP1
V2N
SW
2R
1512
1502
1525
PRP2
V4N
SW
2R
1513
1503
1526
PRP3
V8N
SW
6R
1514
1504
1527
PRP4
V20N
1528
SRP0
8R
1515
1529
SRP1
V43N
1530
PRP5
SW
6R
1516
V55N
1505
1531
PRP6
SW
2R
1517
V59N
1506
1532
PRP7
SW
2R
1518
V61N
1507
1533
PRP8
SW
1R
1519
V62N
1508
1534
PRP9
SW
1R
1520
V63N
1509
1535
VRP1
4R
1521
NEGATIVE POLARITY LADDER CIRCUIT
GND

DISPLAY APPARATUS

CLAIM OF PRIORITY

The present application claims priority from Japanese applications serial no. 2006-279898 filed on Oct. 13, 2006 and no. 2007-003375 filed on Jan. 11, 2007, the contents of which are hereby incorporated by reference into this application.

BACKGROUND OF THE INVENTION

The present invention relates to a display apparatus of a hold type represented by a Thin Film Transistor (TFT) liquid crystal display and more particularly to a display apparatus which can realize improvement in the picture quality at the time that dynamic picture is displayed.

Active matrix type display apparatuses such as TFT liquid crystal displays have features of thin structure, high definition and low power consumption and accordingly are utilized widely as display apparatuses in mobile apparatuses such as mobile telephones and mobile information terminals. Particularly, the mobile telephones have increased cases in which dynamic picture is used in one-segment broadcasting, reproduction of recorded dynamic picture and applications containing games with the advance of high functions. However, the TFT liquid crystal displays are of hold-type driving in which the same image is continuously displayed during one frame period and accordingly when the dynamic picture is displayed, the picture remains in the eyes as an afterimage and there occurs the phenomenon that the outline of the displayed image is blurred (hereinafter as "blurring of dynamic picture").

As measures to prevent deterioration in the picture quality generated in such hold-type display apparatuses, U.S. Pat. No. 6,473,077 (JP-A-2000-122596) proposes a system in which the period that black is displayed is inserted during one frame period so that the afterimage in the eyes is canceled to improve the blurring of dynamic picture. However, the system of inserting black to attain the impulse type driving as represented by a cathode ray tube (CRT) spuriously reduces the maximum brightness and the contrast of displayed image.

On the other hand, U.S. Patent Application Serial No. 20050253785 (JP-A-2005-173387) proposes a system in which one frame is divided into some sub-frames to compensate the brightness reduced by insertion of black by other sub-frames as in the spurious impulse type driving but reduction in brightness and contrast is prevented when estimated during one frame period. The system requires to prepare low-brightness sub-frame data for the spurious impulse type driving and high-brightness sub-frame data for compensation of brightness on the basis of one frame data inputted to the system, although a look-up table (hereinafter referred to as "LUT") is used to perform data conversion processing at this time. This system is hereinafter referred to as "LUT system". In order to realize such LUT system, a memory having a large capacity is required as the LUT for storing converted data, although since a circuit area is increased when it is provided in the hardware such as LSI, not only the cost is increased but also it is difficult to apply it to mobile apparatuses having strict restriction on the circuit area.

Further, active matrix type display apparatuses such as liquid crystal display apparatuses have features of thin structure, high definition and low power consumption and accordingly are utilized widely as display apparatuses in mobile apparatuses such as mobile telephones and mobile information terminals. Particularly, the mobile telephones have increased cases in which dynamic picture is used in one-segment broadcasting, reproduction of recorded dynamic picture and applications containing games with the advance of high functions. When such dynamic picture is displayed, the contrast is improved to attain high-grade picture.

For such improvement of the contrast, U.S. Patent Application Serial No. 20070188623 (JP-A-2006-24176) discloses that a look-up table (LUT) is used to emphasize the contrast.

SUMMARY OF THE INVENTION

In such LUT system, when the spurious impulse type driving is made in order to improve the blurring of dynamic picture in the hold type display apparatus, the LUT corresponding to the number of gradations, for example, the LUT having the size of 256 gradations×8 bits×2 sub-frames=4096 bits for 256 gradations and gradation data of 8 bits is required when one frame is divided into a plurality of sub-frames in a time-shared manner and it is apprehended that the cost is increased.

Moreover, besides the LUT system, there is a current system in which at least two kinds of gradation voltages can be set in a gradation voltage generation circuit and one frame is divided into a plurality of fields in a time-shared manner so that the at least two kinds of gradation voltages are switched for each field to be outputted to the display apparatus. However, in the gradation voltage generation circuit of the current system, for example, a reference voltage is divided using resistors to generate gradation voltages. Accordingly, when a voltage dropped by the division using resistors is Vd, the gradation voltage of V1 has the relation of V1=V0−Vd, for example, and other gradation voltages (V2 to V63) have also the similar relation. Accordingly, gradation voltages (V1 to V63) are all different and any gradation voltages (V1 to V63) cannot be made equal.

FIGS. 11A and 11B show characteristics of the gradation voltage to the gradation number when the LUT is used and when the LUT is not used and the spurious impulse type driving is made, respectively. FIG. 11A shows the characteristics of the gradation voltage to the gradation number upon the positive polarity and FIG. 11B shows those upon the negative polarity. Further, in FIGS. 11A and 11B, when opposite polarity application voltages are set to 0V for the positive polarity and 4V for the negative polarity, the gradation voltage is made high to increase the brightness of a liquid crystal panel for the positive polarity and the gradation polarity is made high to reduce the brightness of the liquid crystal panel for the negative polarity.

In the characteristics of the gradation voltage to the gradation number in use of the LUT shown in FIG. 11A, the gradation voltage of low potential is continued for some time in the dark fields, whereas in the current system which makes the spurious impulse type driving using the gradation voltage generation circuit when the LUT is not used, the gradation voltage is increased as the gradation number is increased but the brightness of the liquid crystal panel is increased as compared with the LUT system.

Even in FIG. 11B, the brightness of the liquid crystal panel is reduced in the current system as compared with the LUT system in the same manner as in FIG. 11A. Accordingly, the current system cannot attain the improvement effect of the blurring of dynamic picture to the degree of the LUT system.

Furthermore, when the contrast is emphasized in the LUT system, the LUT corresponding to the number of gradations, for example, the LUT having the size of 256 gradations×8 bits=2048 bits for 256 gradations and gradation data of 8 bits is required and it is apprehended that the cost is increased.

Moreover, besides the LUT system, there is a current system in which positive and negative polarity gradation voltages are generated by the gradation voltage generation circuit and are switched to be outputted to the liquid crystal display apparatus. In the gradation voltage generation circuit of the current system, for example, a reference voltage is divided using resistors to generate gradation voltages. Accordingly, when a voltage dropped by the voltage division using resistors is Vd and the reference voltage is Vo, for example, the gradation voltage of V1 has the relation of V1=V0−Vd and other gradation voltages (V2 to V63) have also the similar relation. Accordingly, gradation voltages (V1 to V63) are all different and any gradation voltages (V1 to V63) cannot be made equal.

According to the present invention, at least two kinds of gradation voltages can be set in the gradation voltage generation circuit and one frame is divided into at least two fields so that at least two kinds of gradation voltages are switched for each field to be outputted to the display apparatus to thereby display the gradations required by an external system spuriously.

The two kinds of gradation voltages include a gradation voltage constituting dark brightness display fields (hereinafter referred to as dark fields) approaching to display of black as near as possible and a gradation voltage constituting light brightness display fields (hereinafter referred to as light fields) compensating the brightness reduced by the dark fields by high gradation display. These two kinds of gradation voltages are outputted to the display apparatus.

According to the present invention, when the gradation voltages are generated by the gradation voltage generation circuit in the spurious impulse type driving, resistors between gradations are passed arbitrarily without voltage division using resistors to generate the gradation voltages having the same voltage, so that the same brightness characteristics as the LUT system can be obtained. Accordingly, the LUT having the large capacity is not required except registers required to store parameters for operation.

Moreover, according to the present invention, the contrast characteristics are controlled by a resistor ladder circuit which generate the gradation voltages. That is, when the gradation voltages are generated by the resistor ladder circuit, resisters between gradations are passed arbitrarily without voltage division using resistors to generate the gradation voltages having the same voltage.

Accordingly, since the same contrast characteristics as in the LUT system can be obtained, the LUT having the large capacity is not required except resistors required to store parameters for controlling the resistor ladder circuit.

According to the present invention, the low-cost display apparatus using the driving system which does not use the LUT in the spurious impulse type driving capable of improving the dynamic picture display performance of the hold type display apparatus can be realized without reduction of brightness and contrast.

Further, the display apparatus according to the present invention can be utilized irrespective of the size of the display apparatus as compared with the hold type display apparatus and particularly it is suitable for the display apparatus for use in mobile telephones and mobile information terminals having strict restriction on the cost and the circuit area.

Moreover, according to the present invention, since the contrast characteristics can be controlled without using the LUT, the low-cost display apparatus can be realized. In addition, the present invention can be utilized irrespective to the size of the display apparatus and particularly the present invention is suitable for the display apparatus for use in mobile telephones and mobile information terminals having strict restriction on the cost and the circuit area.

Other objects, features and advantages of the invention will become apparent from the following description of the embodiments of the invention taken in conjunction with the accompanying drawings.

DESCRIPTION OF THE EMBODIMENTS

Embodiment 1

Figure 1:
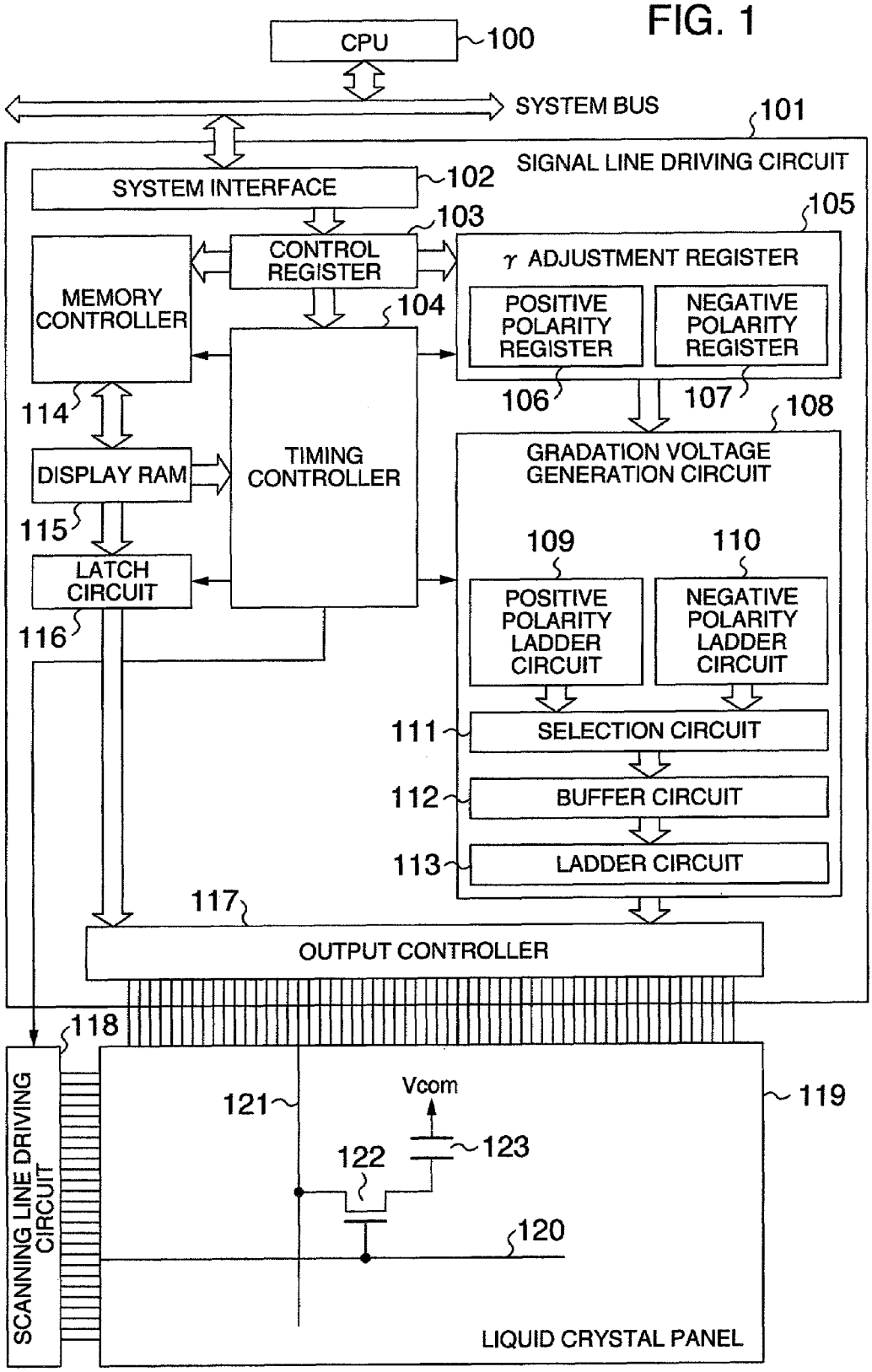
FIG. 1 is a schematic diagram illustrating a liquid crystal panel peripheral circuit according to an embodiment 1 of the present invention.

A driving system for improving blurring of dynamic picture of a hold type display apparatus according to an embodiment 1 of the present invention is now described. FIG. 1 is a schematic diagram illustrating a liquid crystal display apparatus according to the embodiment 1. The liquid crystal display apparatus is described as an example of the hold type display apparatus, although the present invention can be also applied to other display apparatuses of hold type driving. Further, in the embodiment, it is supposed that 64-gradation control is performed. Accordingly, the information content of inputted display data is 18 (6×3) bits per pixel for color.

In FIG. 1, numeral 100 denotes a central processing unit (CPU), 101 a signal line driving circuit, 102 a system interface, 103 a control register, 104 a timing controller, 105 a γ adjustment register, 108 a gradation voltage generation circuit, 114 a memory controller, 115 a display RAM, 116 a latch circuit, 117 an output controller, 118 a scanning line driving circuit and 119 a liquid crystal panel.

The signal line driving circuit 101 is a so-called display memory built-in type control driver and includes measures for realizing the present invention. The internal block configuration and operation of the signal line driving circuit 101 are now described.

The system interface 102 receives display data and instructions outputted by the CPU 100 which is an external system and supplies the received display data and instructions to the control register 103. The instructions are information for deciding internal operation of the signal line driving circuit 101 and contains parameters such as frame frequency, number of driving lines and driving voltage.

The control register 103 stores data of the instructions and supplies the data to each block. For example, the instructions concerning the frame frequency, the number of driving lines and data voltage switch timing are supplied to the timing controller 104 and the instructions concerning a potential of the gradation voltage are supplied to the γ adjustment register 105. Further, the display data is also stored in the control register 103 once and is then supplied to the memory controller 114 together with the instructions for instructing a display position.

The memory controller 114 performs writing and reading operation of the display RAM 115. The memory controller 114 outputs a signal for selecting an address of the display RAM 115 on the basis of the instructions for the display position transferred from the control register 103 in the writing operation. Concurrently with this operation, the memory controller 114 transfers the display data to the display RAM 115, so that the display data can be written in a predetermined address of the display RAM 115. On the other hand, in the reading operation, the memory controller 114 repeats the operation for successively selecting a predetermined word line group in the display RAM 115 one by one, so that display data on the selected word lines can be read out through bit lines simultaneously. It is supposed that setting of the range of word lines to be read, the selection period at a time (equivalent to one scanning period), a repetition cycle of the selection operation (equivalent to one frame period) and the like is instructed by instructions.

The display RAM 115 includes word lines and bit lines corresponding to the scanning lines and the signal lines of the liquid crystal panel 119, respectively, and performs writing operation and reading operation of the display data. The read display data is once held in the latch circuit 116 and then outputted to the output controller 117.

The timing controller 104 generates signals indicating one scanning period, one frame period and the like on the basis of reference clocks generated by an oscillator included therein.

The γ adjustment register 105 includes a positive polarity register 106 and a negative polarity register 107. The instructions inputted from the control register 103 are held in the positive polarity register 106 and the negative polarity register 107 and outputted to the gradation voltage generation circuit 108.

The gradation voltage generation circuit 108 includes a positive polarity ladder circuit 109 and a negative polarity ladder circuit 110 functioning as a reference ladder circuit, a selection circuit 111, a buffer circuit 112 and a gradation voltage ladder circuit 113. A difference voltage between a reference high voltage and a reference low voltage is divided using resistors in the positive polarity ladder circuit 109 and the negative polarity ladder circuit 110 on the basis of a γ adjustment signal inputted from the γ adjustment register 105, so that reference voltages of 12 levels are generated to be outputted to the selection circuit 111.

The selection circuit 111 selects one of the reference voltages generated by the positive polarity ladder circuit 109 and the negative polarity ladder circuit 110 on the basis of an alternating signal and supplies it to the buffer circuit 112. The buffer circuit 112 buffers the inputted reference voltage by a voltage follower circuit and supplies it to the gradation voltage ladder circuit 113.

The gradation voltage ladder circuit 113 divides the inputted reference voltage by resistors on the basis of the reference voltages of 12 levels to generate gradation voltages of 64 levels and supplies it to the output controller 117.

The output controller 117 selects one level of the gradation voltages of 64 levels inputted from the gradation voltage generation circuit 108 on the basis of the display data inputted from the latch circuit 116 and supplies it onto the signal line 121 of the liquid crystal panel 119.

The scanning line driving circuit 118 supplies a scanning voltage (high level in the embodiment) indicating the selected state to the scanning line 120 of the liquid crystal panel 119 in synchronism with one scanning period successively. The timing that the high level scanning voltage is supplied to the first scanning line is synchronized with the timing that the first word line in the display RAM 115 is read.

The liquid crystal panel 119 is a flat panel named a so-called active matrix type including a switching transistor 122 disposed at each pixel part positioned at each intersection of the signal lines 121 and the scanning lines 120. A source terminal of the transistor 122 is connected to an output of the output controller 117 through the signal line 121 and a gate terminal thereof is connected to an output of the scanning line driving circuit 118 through the scanning line 120. A drain terminal of the transistor 122 is connected to a display element 123. The opposite side of the display element 123 is connected to a common electrode to which a voltage Vcom is supplied. Accordingly, the display element 123 connected to the scanning line 120 in the selected state is supplied with a voltage difference between the gradation voltage and the voltage Vcom.

In the embodiment, since the potential Vcom for the positive polarity is 0V and the potential Vcom for the negative polarity is 4V, the gradation voltage is made high to increase the brightness (the gradation voltage is made low to reduce the brightness) for the positive polarity and the gradation voltage is made low to increase the brightness (the gradation voltage is made high to reduce the brightness) for the negative polarity. The display element 123 is made of liquid crystal, organic electro-luminescence (EL) and the like representatively, although other elements may be used as far as the display brightness can be controlled by voltage.

Figure 2A:
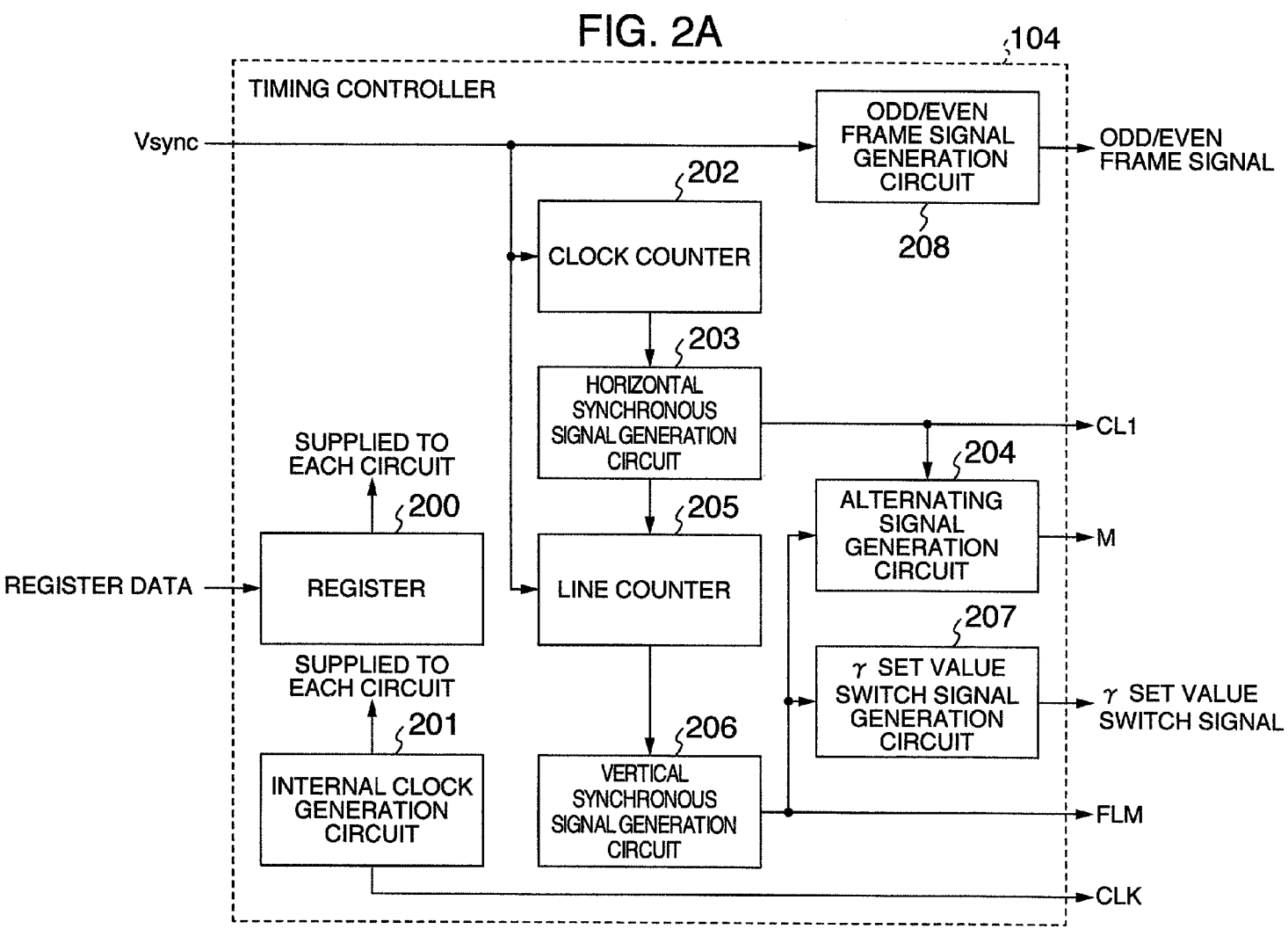
FIG. 2A is a schematic diagram illustrating a timing controller used in the liquid crystal panel peripheral circuit shown in FIG. 1.

Referring now to FIG. 2A, the internal block configuration of the timing controller 104 and operation thereof are described. In FIG. 2A, numeral 200 denotes a register, 201 an internal clock generation circuit, 202 a clock counter, 203 a horizontal synchronous signal generation circuit, 204 an alternating signal generation circuit, 205 a line counter, 206 a vertical synchronous signal generation circuit, 207 a γ set value switch signal generation circuit, and 208 an odd/even frame signal generation circuit.

Information including one scanning period, one frame period, one field period and the like inputted from the control register 103 shown in FIG. 1 is held in the register 200 and supplied to the clock counter 202 and the line counter 205.

The internal clock generation circuit 201 generates a reference operation clock CLK to be supplied to each circuit. Each circuit operates on the basis of the reference clock CLK generated by the internal clock generation circuit 201.

The clock counter 202 counts the reference clock until the count reaches the CLK value for one scanning period inputted from the register 200 and supplies the clock count to the horizontal synchronous signal generation circuit 203. The clock count of the clock counter 202 is cleared (count=0) when the CLK value for the one scanning period is exceeded or cleared by a falling edge of an inputted horizontal synchronous signal Vsync (active at low level in the embodiment).

The horizontal synchronous signal generation circuit 203 generates a horizontal synchronous signal CL1 on the basis of the clock count inputted from the clock counter 202. The horizontal synchronous signal CL1 rises (active at high level in the embodiment) when the clock count is equal to "0" and outputs the high level signal while the horizontal synchronous signal inputted from the register 200 is active.

The line counter 205 makes counting in synchronism with the rising of the horizontal synchronous signal CL1 until the number of lines for one field period inputted from the register 200 is reached and supplies the line count to the vertical synchronous signal generation circuit 206. The line count of the line counter 205 is cleared (count=0) when the number of lines for one field period is exceeded or cleared by the falling edge of the inputted horizontal synchronous signal Vsync.

The vertical synchronous signal generation circuit 206 generates a vertical synchronous signal FLM on the basis of the count inputted from the line counter 205. The vertical synchronous signal FLM rises (active at high level in the embodiment) when the line count is equal to "0" and outputs the high level signal while the vertical synchronous signal inputted from the register 200 is active.

The alternating signal generation circuit 204 generates an alternating signal M in response to the alternating signal ("0" in frame alternating driving and "1" in line alternating driving in the embodiment) inputted from the register 200.

The γ set value switch signal generation circuit 207 generates a γ set value switch signal on the basis of the vertical synchronous signal FLM. The odd/even frame signal generation circuit 208 generates an odd/even frame signal on the basis of the inputted horizontal synchronous signal Vsync.

Figure 2B:
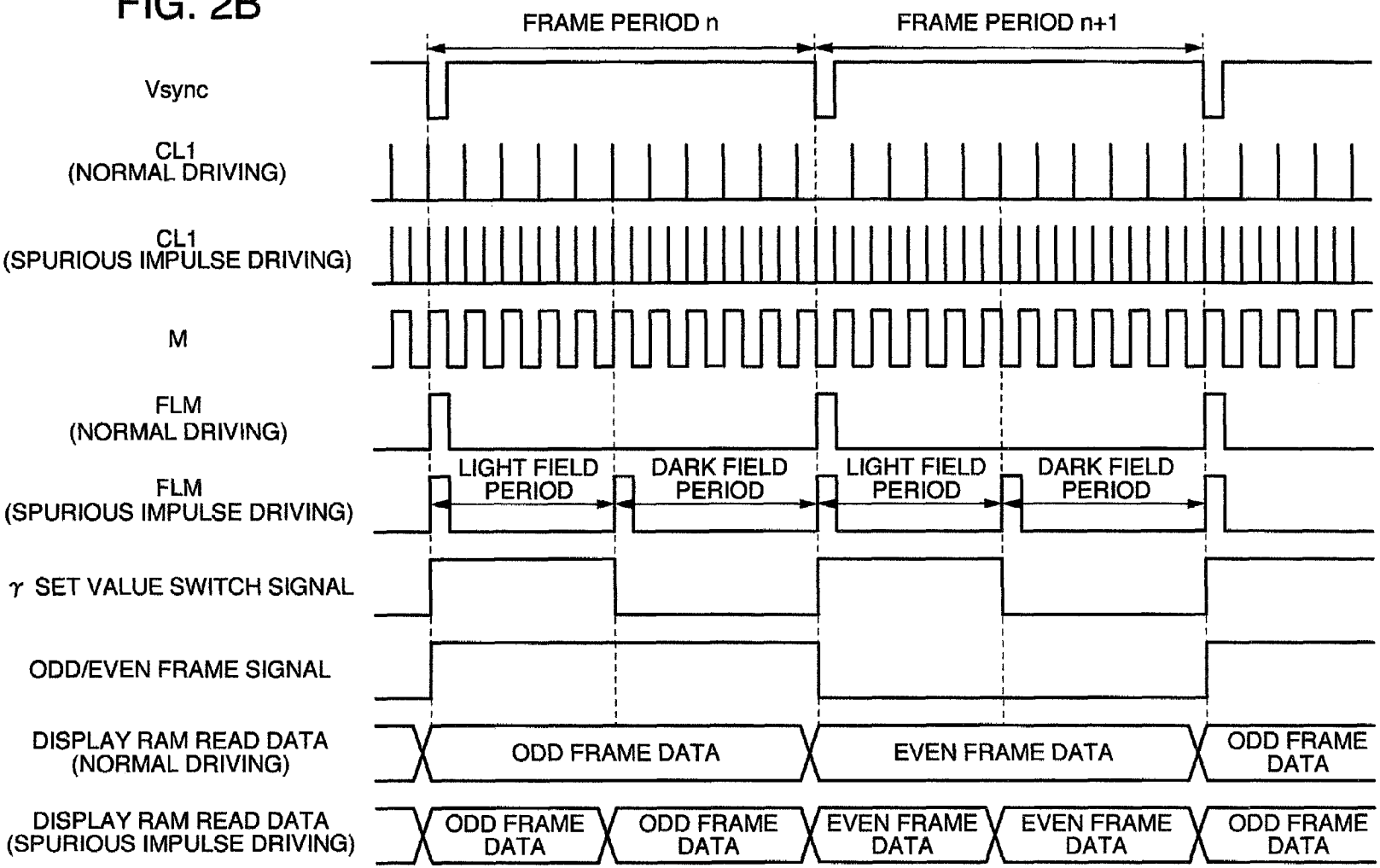
FIG. 2B is a timing chart showing operation of the timing controller shown in FIG. 2A.

Referring now to FIG. 2B, the operation timing of signals generated by the timing controller 104 is described. When the spurious impulse type driving is made, the vertical synchronous signal FLM is made active twice during one frame period of the inputted horizontal synchronous signal Vsync (one frame is divided into two sub-frames). Thus, the two field periods can be formed during one frame period. Further, when the spurious impulse type driving is not made, the vertical synchronous signal FLM has the same waveform as that of the inputted horizontal synchronous signal Vsync.

The horizontal synchronous signal CL1 is made active by the number of lines set in the register 200. In the embodiment, since one frame is divided into two fields, one scanning period at the time that the spurious impulse type driving is made is a half of one scanning period at the time that the spurious impulse type driving is not made.

The alternating signal M is made "high" and "low" repeatedly in accordance with the alternating method set in the register 200. In the embodiment, since the line alternating driving is set, the alternating signal is made "high" or "low" during one scanning period.

The γ set value switch signal is repeatedly made "high" and "low" during one field period in response to the vertical synchronous signal FLM.

The odd/even frame signal is repeatedly made "high" and "low during one frame period in response to the inputted horizontal synchronous signal Vsync.

The display data held in the display RAM 115 is read out for one frame during one field period when the spurious impulse type driving is made. Further, when the odd/even frame signal is "high", the display data of the odd frame is outputted and when the odd/even frame signal is "low", the display data of the even frame is outputted. In the embodiment, when the odd/even frame signal is "high", the odd frame display data is outputted and when the odd/even frame signal is "low", the even frame display data is outputted. When the spurious impulse type driving is not made, the display data for one frame is read out during one frame period to be outputted.

Figure 3A:
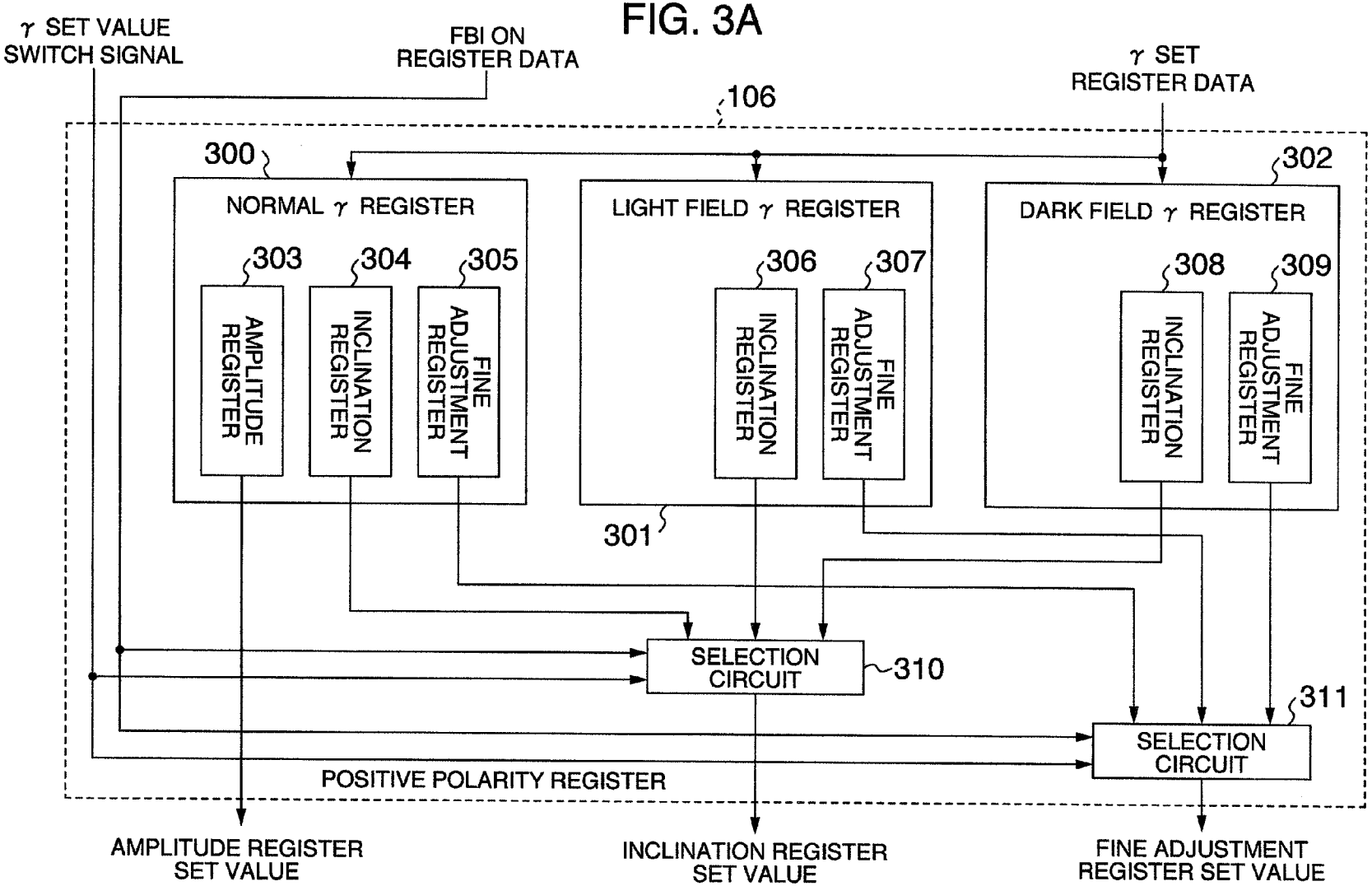
FIG. 3A is a schematic diagram illustrating a positive polarity register in a γ adjustment register used in the liquid crystal panel peripheral circuit shown in FIG. 1.

Referring now to FIG. 3A, the internal block configuration of the positive polarity register 106 shown in FIG. 1 is described. The circuit configuration and operation of the negative polarity register 107 are the same as those of the positive polarity register 106.

In FIG. 3A, numeral 300 denotes a normal γ register, 301 a light field register, 302 a dark field register, 303 an amplitude register, 304, 306 and 308 inclination registers, 305, 307 and 309 fine adjustment registers, and 310 and 311 selection circuits.

The normal γ register 300 holds a γ register value when the spurious impulse type driving is not used and the light field γ register 301 holds a γ register value for the light field when the spurious impulse type driving is made. The dark field γ register 302 holds a γ register value for the dark field when the spurious impulse type driving is made.

The γ register value inputted from the control register 103 shown in FIG. 1 is classified into an amplitude register value, an inclination register value or a fine adjustment register value, which is supplied to the gradation voltage generation circuit 108, so that variable registers in the positive polarity ladder circuit 109 and the negative polarity ladder circuit 110 of the gradation voltage generation circuit 108 can be adjusted to thereby set a potential of the gradation voltage.

The amplitude register value is a set value for adjusting an amplitude of the gradation voltage and the inclination adjustment register value is a set value for adjusting an inclination near the middle of the characteristics of the gradation voltage to the gradation number without changing the dynamic range largely. The fine adjustment register value is a set value for finely adjusting the gradation voltage level.

The amplitude adjustment register value, the inclination register value and the fine adjustment value are held in the amplitude register 303, the inclination registers 304, 306 and 308 and the fine adjustment registers 305, 307 and 309 of the normal γ register 300, the light field γ register 301 and the dark field γ register 302, respectively.

Since the amplitude register value has the same value (the amplitude of the gradation voltage is fixed) whether the spurious impulse type driving is used or not, the amplitude register value is held in only the amplitude register 303 of the normal γ register 300 and even when the spurious impulse type driving is used, the amplitude register held in the amplitude register 303 is supplied to the gradation voltage generation circuit 108 to thereby suppress increase of the circuit scale.

When the FBI on register data inputted from the control register 103 (when it is "high" the spurious impulse type driving is used and when it is "low" the spurious impulse type driving is not used in the embodiment) is "low", the inclination register value held in the inclination register 304 of the normal γ register 300 is selected to be supplied to the gradation voltage generation circuit 108. Further, when the FBI on register data is "high" and the γ set value switch signal (the signal being "high" indicates the light field and the signal being "low" indicates the dark field in the embodiment) is "high", the inclination register value held in the inclination register 306 of the light field γ register 301 is selected and when the FBI on register data is "high" and the γ set value switch signal is "low", the inclination register value held in the inclination register 308 of the dark field γ register 302 is selected to be outputted to the gradation voltage generation circuit 108.

When the FBI on register data inputted from the control register 103 is "low", the selection circuit 11 selects the fine adjustment register value held in the fine adjustment register 305 of the normal γ register 300 to be outputted to the gradation voltage generation circuit 108. Moreover, when the FBI on register data is "high" and the γ set value switch signal is "high", the fine adjustment register value held in the fine adjustment register 307 of the light field γ register 301 is selected and when the FBI on register data is "high" and the γ set value switch signal is "low", the fine adjustment register value held in the fine adjustment register 309 of the dark field γ register 302 is selected to be outputted to the gradation voltage generation circuit 108.

Figure 3B:
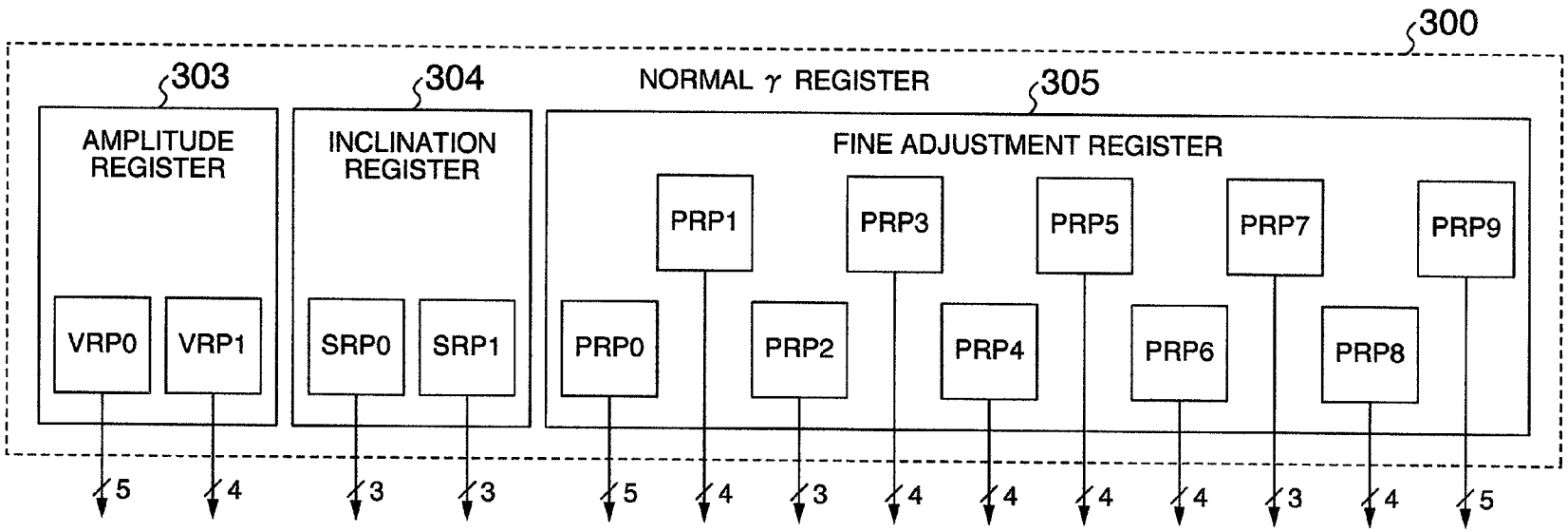
FIG. 3B is a schematic diagram illustrating a normalγ register used in the positive polarity register shown in FIG. 3A.

Referring now to FIG. 3B, the internal configuration of each register in the normal γ register 300 is described. The amplitude register 303 includes two registers VRP0 and VRP1 and the amplitude value of the gradation voltage is adjusted by the register values held in the two registers VRP0 and VRP1. The inclination register 304 includes two registers SRP0 and SRP1 and the inclination near the middle of the characteristics of the gradation voltage to the gradation number is adjusted by the register values held in the two registers SRP0 and SRP1. The fine adjustment register 305 includes ten registers PRP0 to PRP9 and the gradation voltage level is finely adjusted by the register values held in the ten registers PRP0 to PRP9. The light field γ register 301 and the dark field γ register 302 have the same internal configuration as that of the inclination register 304 and the fine adjustment register 305.

Figure 4:
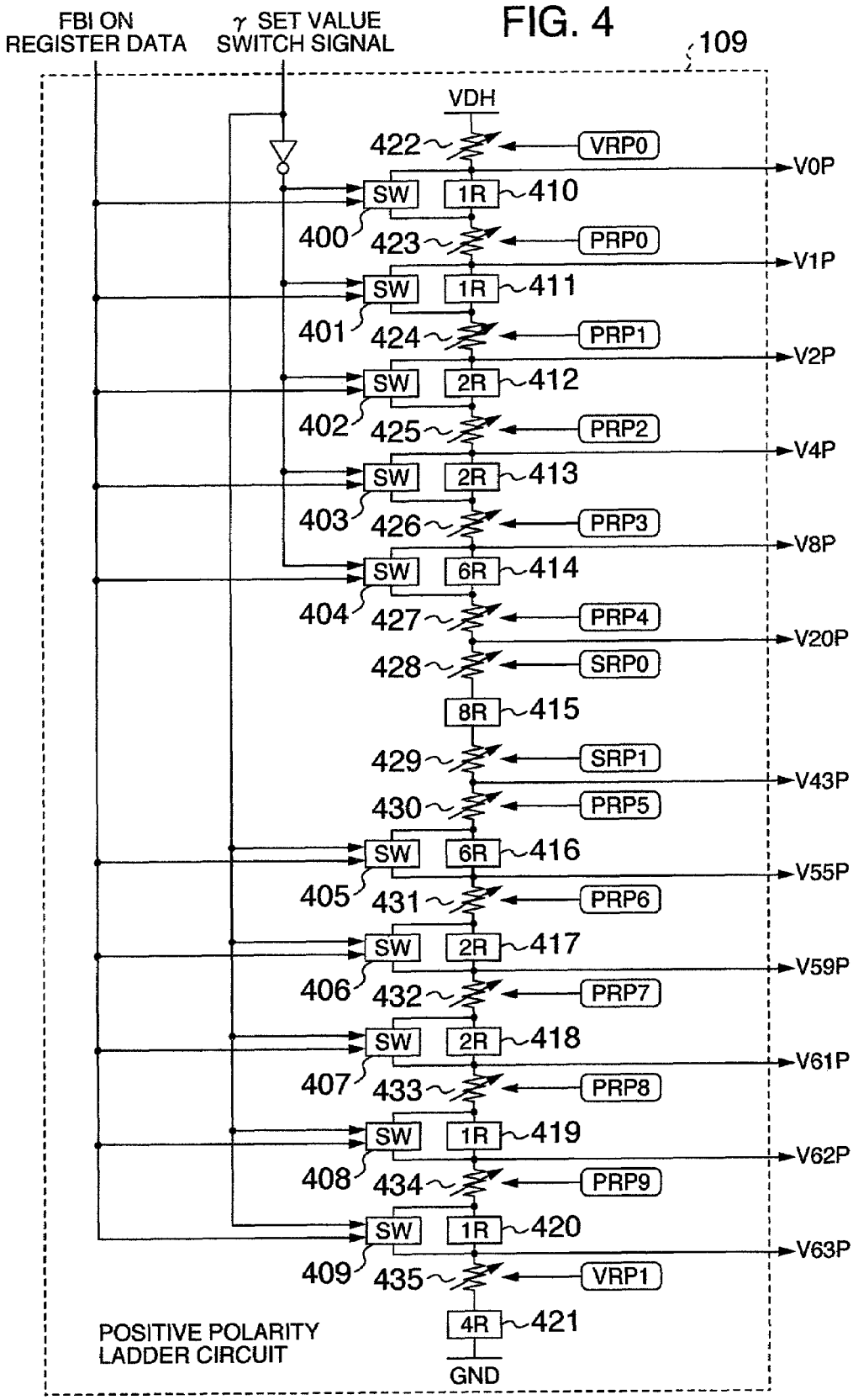
FIG. 4 is a schematic diagram illustrating a positive polarity ladder circuit used in the liquid crystal panel peripheral circuit shown in FIG. 1.

Referring now to FIG. 4, the internal block configuration of the positive polarity ladder circuit 109 is described. In FIG. 4, numerals 400 to 409 denote switches (hereinafter abbreviated to "SW"), 410 to 421 fixed resistors and 422 to 435 variable resistors. The variable resistors 422 and 435 have resistance values set in accordance with the amplitude register value inputted from the γ adjustment register 105. The variable resistors 428 and 429 have resistance values set in accordance with the inclination register value inputted from the γ adjustment register 105. The variable resistors 423 to 427 and 430 to 434 have resistance values set in accordance with the fine adjustment register value inputted from the γ adjustment register 105.

The minimum resistance values of the variable resistors 422 to 435 are set to resistance value (ideally 0Ω) to the degree that a potential difference between the gradations is not produced by the voltage division using resistors. When the SWs 400 to 409 are on, the on-resistance of the SWs 400 to 409 is sufficiently small as compared with the fixed resistors 410 to 420 and when the SWs 400 to 409 are off, the off-resistance of the SWs 400 to 409 is sufficiently large as compared with the fixed resistors 410 to 420.

When the FBI on register data is "low" (when the spurious impulse type driving is not used), the SWs 400 to 409 are turned off and a current flows through the fixed resistors 410 to 414 and 416 to 420, so that the voltage is divided by the resistance values of the fixed resistors and the variable resistors to generate reference voltages V0P, V1P, V2P, V4P, V8P, V20P, V43P, V55P, V59P, V61P, V62P and V63P of 12 levels.

V0P is a potential for positive polarity of gradation number 0, V1P a potential for positive polarity of gradation number 1, V2P a potential for positive polarity of gradation number 2, V4P a potential for positive polarity of gradation number 4, V8P a potential for positive polarity of gradation number 8, V20P a potential for positive polarity of gradation number 20, V43P a potential for positive polarity of gradation number 43, V55P a potential for positive polarity of gradation number 55, V59P a potential for positive polarity of gradation number 59, V61P a potential for positive polarity of gradation number 61, V62P a potential for positive polarity of gradation number 62 and V63P a potential for positive polarity of gradation number 63.

Figure 6A:
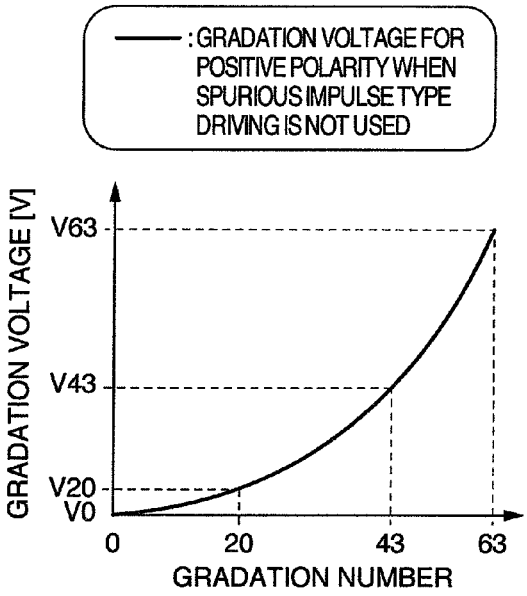
FIGS. 6A to 6D are graphs showing characteristics of gradation voltage to gradation number in the embodiment 1 of the present invention.

The reference voltages of 12 levels are buffered by the buffer circuit 112 and then supplied to the gradation voltage ladder circuit 113. The gradation voltage ladder circuit 113 makes the voltage division using resistors on the basis of the reference voltages of 12 levels and generates the gradation voltages for the remaining gradation numbers 3, 5-7, 9-19, 21-42, 44-54, 56-58 and 60 in case of 64-gradation display. The characteristics of the gradation voltage to the gradation number at this time are as shown in FIG. 6A.

When the FBI on register data is "high" (when the spurious impulse type driving is used) and the γ set value switch signal is "low" (in dark fields), the SWs 400 to 404 are turned on. Accordingly, a current does not flow through the fixed resistors 410 to 414 and a current flows through the SWs 400 to 404. Since the SWs 405 to 409 are turned off, a current flows through the fixed resistors 416 to 420. At this time, when the resistance values of the variable resistors 423 to 427 are set to the minimum value by the register values of the fine adjustment registers PRP0 to PRP4 of the dark field γ register 302, the voltage division using resistors is not made, so that a high voltage VDH from a reference high voltage source (not shown) is outputted and the potentials of the reference voltages V0P to V20P are identical. Since a current flows through the fixed resistors 416 to 420, the reference voltages V43P to V63P are divided by resistors and do not have the same potential.

When the FBI on register data is "high" (when the spurious impulse type driving is used) and the γ set value switch signal is "high" (in light fields), the SWs 400 to 404 are turned off. Accordingly, a current flows through the fixed resistors 410 to 414 and since the SWs 405 to 409 are turned on, a current flows through the SWs 405 to 409 and a current does not flow through the fixed resistors 416 to 420. At this time, when the resistance values of the variable resistors 430 to 434 are set to the minimum value by the register values of the fine adjustment registers PRP5 to PRP9 of the light field γ register 301, the voltage division using resistors is not made, so that a low voltage GND from a reference low voltage source (not shown) is outputted and the potentials of the reference voltages V43P to V63P are identical. Since a current flows through the fixed resistors 410 to 414, the reference voltages V0P to V20P are subjected to the voltage division using resistors and do not have the same potential.

Figure 6B:
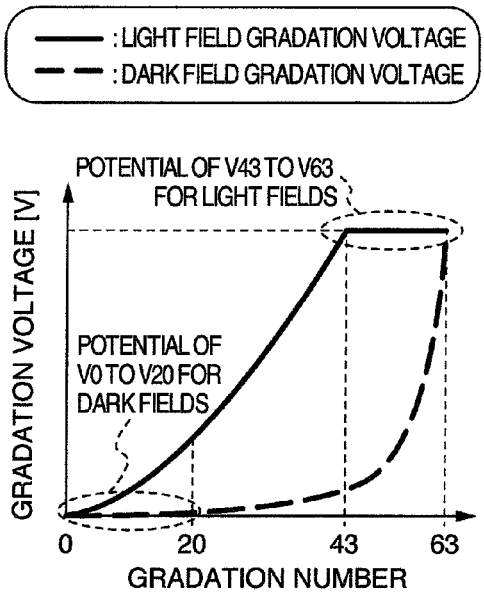

From the foregoing operation, the same voltage can be produced in the gradations of V43 to V63 in the light fields and the gradations of V0 to V20 in the dark fields as shown by the characteristics of the gradation voltage to the gradation number in FIG. 6B.

Figure 5:
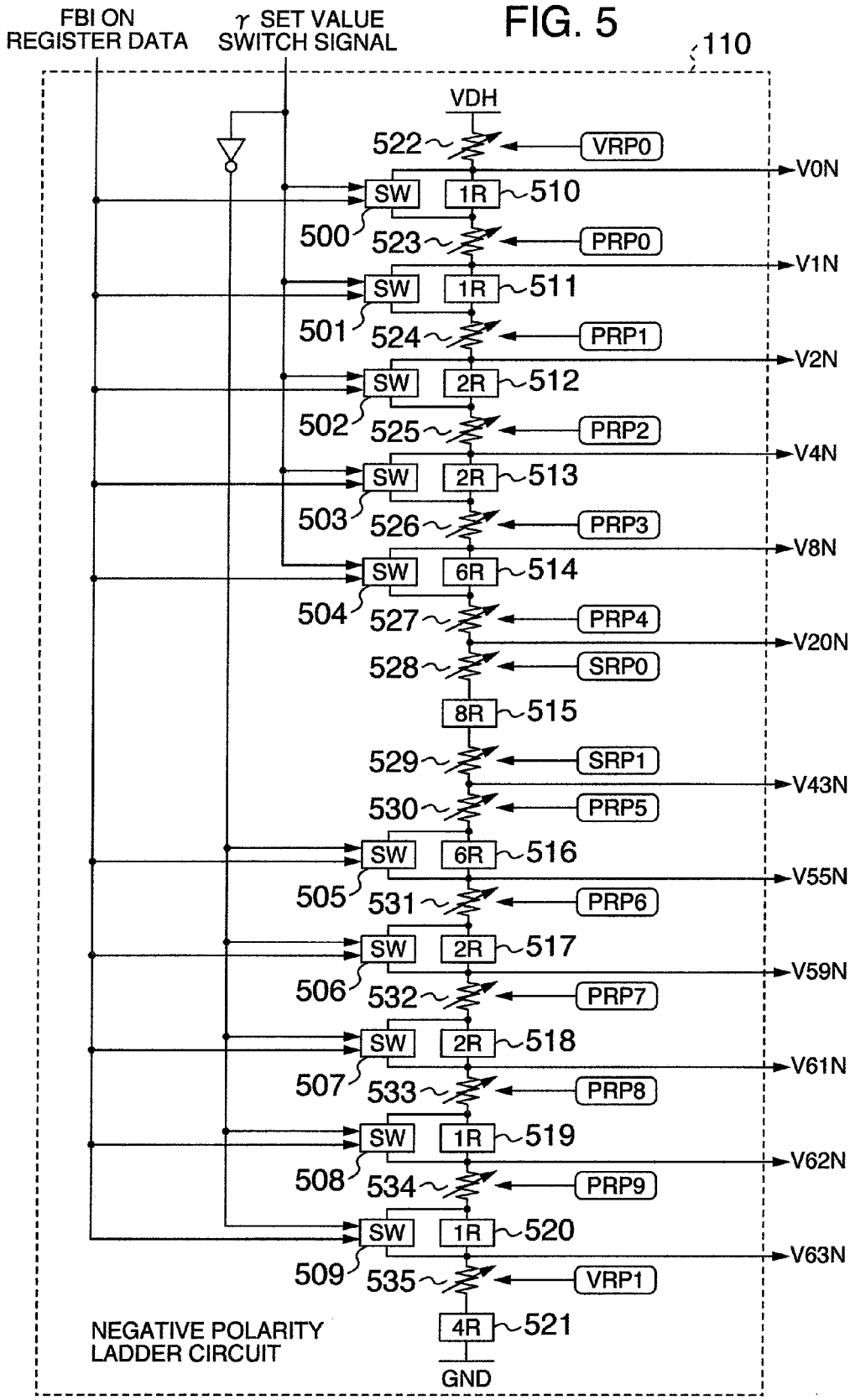
FIG. 5 is a schematic diagram illustrating a negative polarity ladder circuit used in the liquid crystal panel peripheral circuit shown in FIG. 1.

Referring now to FIG. 5, the internal block configuration of the negative polarity ladder circuit 110 is described. In FIG. 5, numeral 500 to 509 denote SWs, 510 to 521 fixed resistors and 522 to 535 variable resistors. The resistance values of the fixed resistors 510 to 521 and the variable resistors 522 to 535 are the same as those of the fixed resistors 410 to 421 and the variable resistors 422 to 435 of the positive polarity ladder circuit 109.

The variable resistors 522 and 535 have the resistance values set in accordance with the amplitude register values inputted from the γ adjustment register 105. The variable resistors 528 and 529 have the resistance values set in accordance with the inclination register values inputted from the γ adjustment register 105. The variable resistors 523 to 527 and 530 to 534 have the resistance values set in accordance with the fine adjustment register values inputted from the γ adjustment register 105.

The minimum resistance values of the variable resistors 522 to 535 are set to a resistance value (ideally 0Ω) to the degree that a potential difference between the gradations is not produced by the voltage division using resistors. When the SWs 500 to 509 are on, the on-resistance of the SWs 500 to 509 is sufficiently small as compared with the fixed resistors 510 to 520 and when the SWs 500 to 509 are off, the off-resistance of the SWs 500 to 509 is sufficiently large as compared with the fixed resistors 510 to 520.

When the FBI on register data is "low" (when the spurious impulse type driving is not used), the SWs 500 to 509 are turned off and a current flows through the fixed resistors 510 to 514 and 516 to 520, so that the voltage is divided by the resistance values of the fixed resistors and the variable resistors to generate reference voltages V0N, V1N, V2N, V4N, V8N, V20N, V43N, V55N, V59N, V61N, V62N and V63N of 12 levels.

V0N is a potential for negative polarity of gradation number 0, V1N a potential for negative polarity of gradation number 1, V2N a potential for negative polarity of gradation number 2, V4N a potential for negative polarity of gradation number 4, V8N a potential for negative polarity of gradation number 8, V20N a potential for negative polarity of gradation number 20, V43N a potential for negative polarity of gradation number 43, V55N a potential for negative polarity of gradation number 55, V59N a potential for negative polarity of gradation number 59, V61N a potential for negative polarity of gradation number 61, V62N a potential for negative polarity of gradation number 62 and V63N a potential for negative polarity of gradation number 63.

Figure 6C:
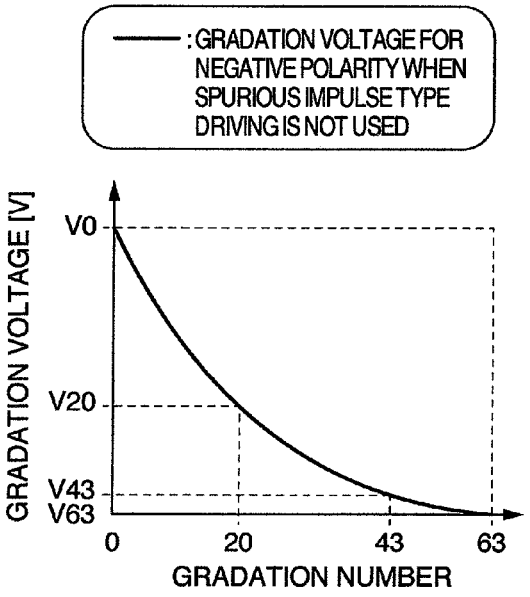

The reference voltages of 12 levels are buffered by the buffer circuit 112 and then supplied to the gradation voltage ladder circuit 113. The gradation voltage ladder circuit 113 makes the voltage division using resistors on the basis of the reference voltages of 12 levels and generates the gradation voltages for the remaining gradation numbers 3, 5-7, 9-19, 21-42, 44-54, 56-58 and 60 in case of 64-gradation display. The characteristics of the gradation voltage to the gradation number at this time are as shown in FIG. 6C.

When the FBI on register data is "high" (when the spurious impulse type driving is used) and the γ set value switch signal is "high" (in light fields), the SWs 500 to 504 are turned on. Accordingly, a current does not flow through the fixed resistors 510 to 514 and a current flows through the SWs 500 to 504. Since the SWs 505 to 509 are turned off, a current flows through the fixed resistors 516 to 520. At this time, when the resistance values of the fixed resistors 523 to 527 are set to the minimum value by the register values of the fine adjustment registers PRP0 to PRP4 of the light field γ register in the negative polarity register 107, the voltage division using resistors is not made, so that a high voltage VDH from a reference high voltage source (not shown) is outputted and the potentials of the reference voltages V0N to V20N of 6 levels are identical. Since a current flows through the fixed resistors 516 to 520, the reference voltages V43N to V63N of other 6 levels are subjected to the voltage division using resistors and do not have the same potential.

When the FBI on register data is "high" (when the spurious impulse type driving is used) and the γ set value switch signal is "low" (in dark fields), the SWs 500 to 504 are turned off. Accordingly, a current flows through the fixed resistors 510 to 514 and since the SWs 505 to 509 are turned on, a current flows through the SWs 505 to 509 and a current does not flow through the fixed resistors 516 to 520. At this time, when the resistance values of the variable resistors 530 to 534 are set to the minimum value by the register values of the fine adjustment registers PRP5 to PRP9 of the dark field γ register in the negative polarity register 107, the voltage division using resistors is not made, so that a low voltage GND from a reference low voltage source (not shown) is outputted and the potentials of the reference voltages V43N to V63N of 6 levels are identical. Since a current flows through the fixed resistors 510 to 514, the reference voltages V0N to V20N of other 6 levels are subjected to the voltage division using resistors and do not have the same potential.

Figure 6D:
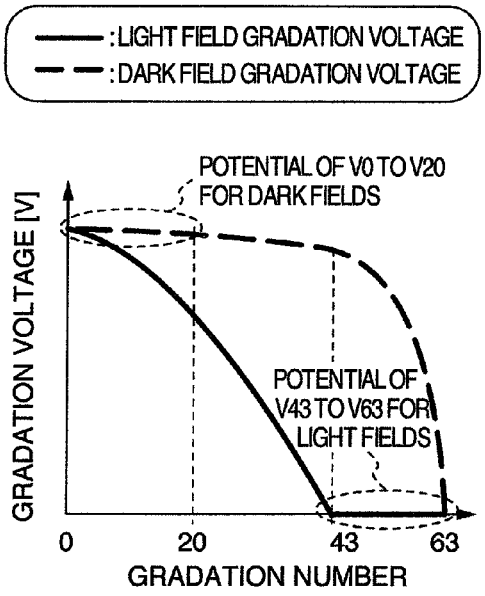

From the foregoing operation, the same voltage can be produced in the gradations of V43 to V63 in the light fields and the gradations of V0 to V20 in the dark fields as shown by the characteristics of the gradation voltage to the gradation number in FIG. 6D.

Figure 7:
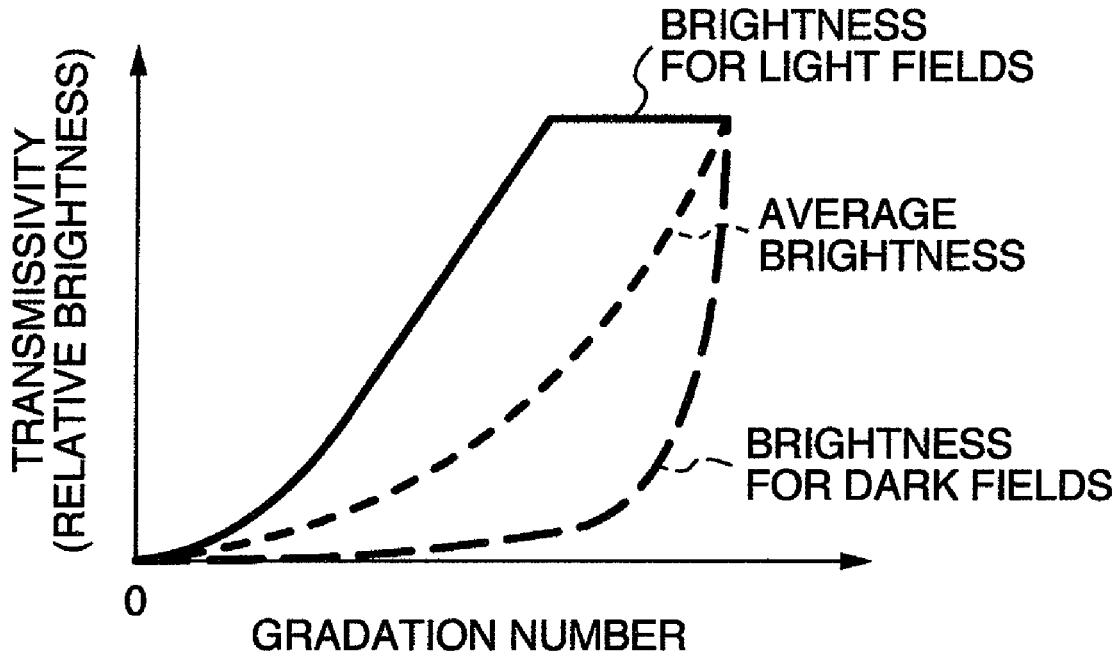
FIG. 7 is a graph showing γ characteristics in the embodiment 1 of the present invention.

As described above, the gradation voltages shown in FIGS. 6B and 6D are supplied to the liquid crystal panel 119 shown in FIG. 1, so that the liquid crystal panel 119 exhibits low brightness approaching to display of black as near as possible during the dark field period and exhibits high brightness during the light field period as shown in FIG. 7.

If the average of the display brightness of the liquid crystal panel 119 in the dark and light fields shown in FIG. 7 is set to $\gamma=2.2$ when the display brightness of the liquid crystal panel 119 in case where the spurious impulse type driving is not used is $\gamma=2.2$, brightness and coloring of the displayed image on the liquid crystal panel 119 are not changed.

As described above, according to the embodiment, the driving system which can improve blurring of dynamic picture without reduction in the brightness and the contrast can be realized with low-cost structure in which the LUT is not used.

In the embodiment, the information content of display data is 18 bits per pixel, although the present invention is not limited thereto. Moreover, in the embodiment, the potentials of the voltage Vcom applied to the opposite electrode is 0V for positive polarity and 4V for negative polarity, although the present invention is not limited thereto.

Embodiment 2

A driving system for improving blurring of dynamic picture of a hold type display apparatus according to an embodiment 2 of the present invention is now described. The signal line driving circuit 101 of the embodiment 2 has the configuration shown in FIG. 1 similarly to the embodiment 1. The signal line driving circuit 101 of the embodiment 2 includes the gradation voltage generation circuit 108 having the configuration shown in FIG. 1 similarly to the embodiment 1, although the circuit configuration of the positive polarity ladder circuit 109 and the negative polarity ladder circuit 110 of the embodiment 2 is different from that of the embodiment 1. The negative polarity ladder circuit 110 has the same circuit configuration and operation as the positive polarity ladder circuit 109.

Figure 8:
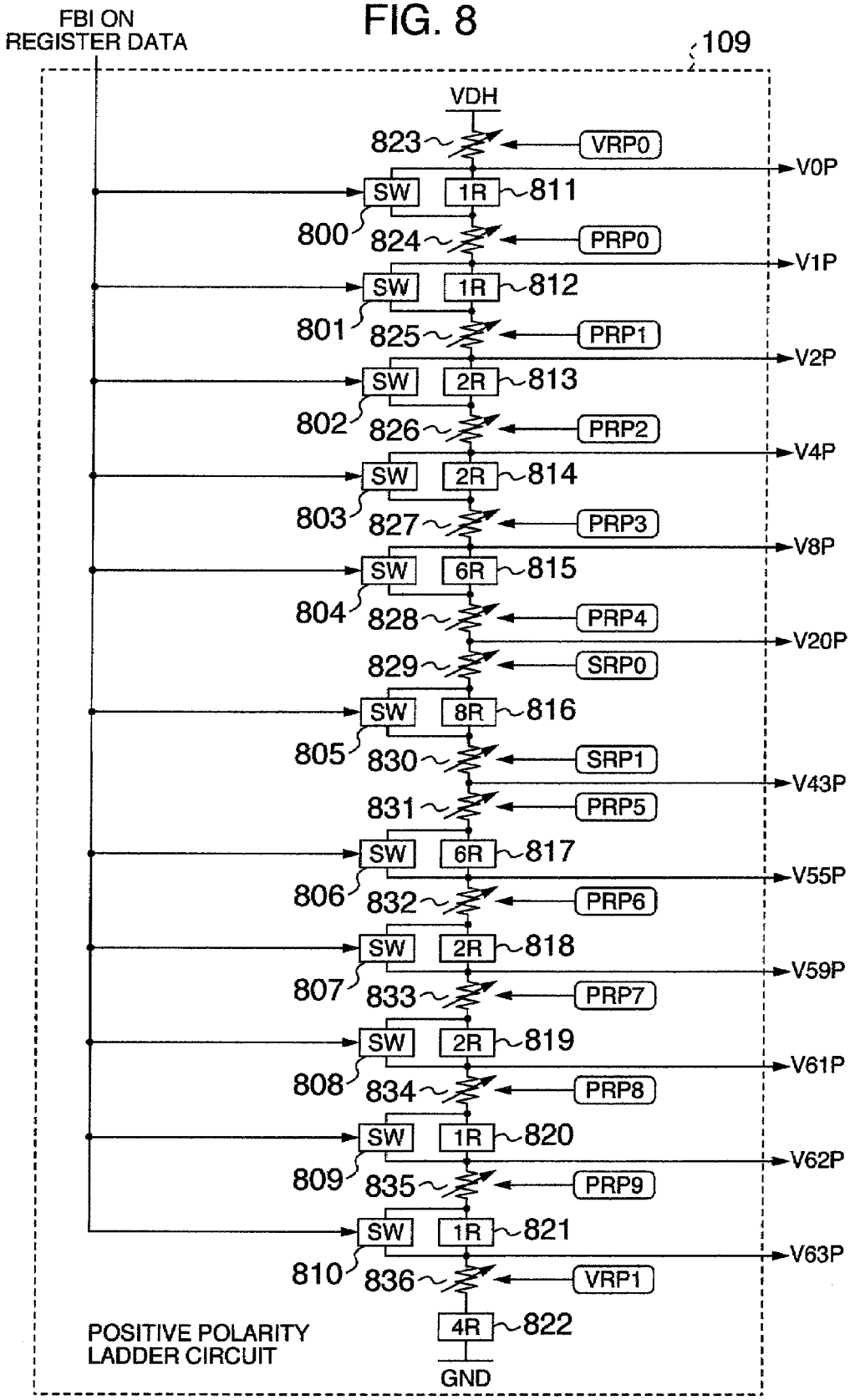
FIG. 8 is a schematic diagram illustrating a positive polarity ladder circuit used in an embodiment 2 of the present invention.

The positive polarity ladder circuit 109 of the embodiment is now described with reference to FIG. 8. In FIG. 8, numerals 800 to 810 denote SWs, 811 to 822 fixed resistors and 823 to 836 variable resistors. The variable resistors 823 and 836 have resistance values set in accordance with the amplitude register value inputted from the γ adjustment register 105. The variable resistors 829 and 930 have resistance values set in accordance with the inclination register value inputted from the γ adjustment register 105. The variable resistors 824 to 828 and 831 to 835 have resistance values set in accordance with the fine adjustment register value inputted from the γ adjustment register 105.

The minimum resistance values of the variable resistors 823 to 836 are set to a resistance value (ideally 0Ω) to the degree that a potential difference between the gradations is not produced by the voltage division using resistors. When the SWs 800 to 810 are on, the on-resistance of the SWs 800 to 810 is sufficiently small as compared with the fixed resistors 811 to 821 and when the SWs 800 to 810 are off, the off-resistance of the SWs 800 to 810 is sufficiently large as compared with the fixed resistors 811 to 821.

When the FBI on register data is "low" (when the spurious impulse type driving is not used), the SWs 800 to 810 are turned off and a current flows through the fixed resistors 811 to 821, so that the voltage is divided by the resistance values of the fixed resistors and the variable resistors to generate reference voltages V0P, V1P, V2P, V4P, V8P, V20P, V43P, V55P, V59P, V61P, V62P and V63P of 12 levels.

V0P is a potential for positive polarity of gradation number 0, V1P a potential for positive polarity of gradation number 1, V2P a potential for positive polarity of gradation number 2, V4P a potential for positive polarity of gradation number 4, V8P a potential for positive polarity of gradation number 8, V20P a potential for positive polarity of gradation number 20, V43P a potential for positive polarity of gradation number 43, V55P a potential for positive polarity of gradation number 55, V59P a potential for positive polarity of gradation number 59, V61P a potential for positive polarity of gradation number 61, V62P a potential for positive polarity of gradation number 62 and V63P a potential for positive polarity of gradation number 63.

The reference voltages of 12 levels are buffered by the buffer circuit 112 and then supplied to the gradation voltage ladder circuit 113. The gradation voltage ladder circuit 113 makes the voltage division using resistors on the basis of the reference voltages of 12 levels and generates the gradation voltages for the remaining gradation numbers 3, 5-7, 9-19, 21-42, 44-54, 56-58 and 60 in case of 64-gradation display. At this time, the potentials of the reference voltages V0P to V63P are not identical.

When the FBI on register data is "high" (when the spurious impulse type driving is used), the SWs 800 to 810 are turned on. Accordingly, a current does not flow through the fixed resistors 811 to 821 and a current flows through the SWs 800 to 810. At this time, when the resistance values of the variable resistors 823 to 830 are set to the minimum value by the register values of the fine adjustment registers PRP0 to PRP4 and the inclination registers SRP0 and SRP1 of the dark field γ register 302, the voltage division using resistors is not made, so that the potentials of the reference voltages V0P to V43P of 7 levels become the same potential VDH. Further, since a current does not flow through the fixed resistors 817 to 821 but the voltage division using resistors is made by adjusting the variable resistors 832 to 835 by setting of the fine adjustment registers PRP6 to PRP9, the reference voltages V55P to V63P of other 5 levels are not the same potential.

Figure 9A:
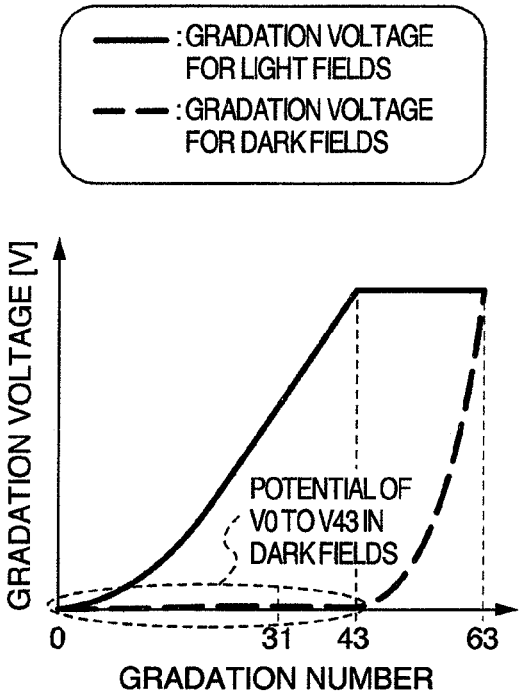
FIGS. 9A and 9B are graphs showing characteristics of gradation voltage to gradation number in the embodiment 2 of the present invention.
Figure 9B:
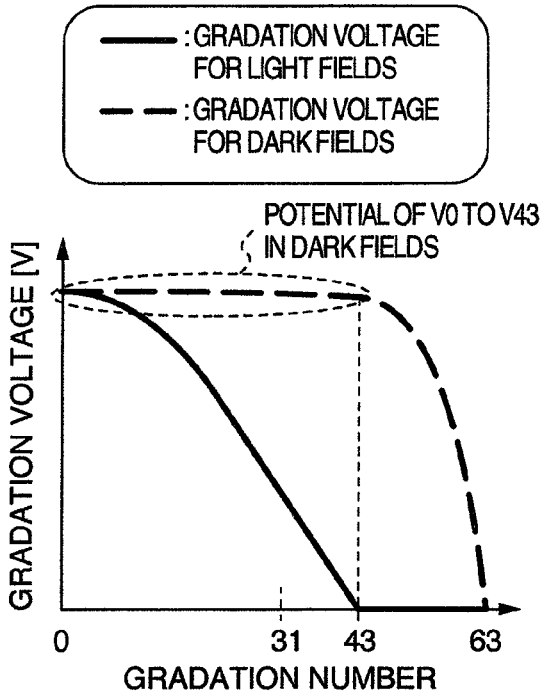

From the foregoing operation, the same low gradation voltages can be produced in the wide range of gradation numbers as shown in FIG. 9A. Further, even the negative polarity ladder circuit 110 can produce the same high gradation voltages in the wide range of gradation numbers similarly to the positive polarity ladder circuit 109 of the embodiment as shown in FIG. 9B.

As described above, since the brightness of the liquid crystal panel during the dark field period can approach to display of black as near as possible as compared with the embodiment 1, the driving system which can improve blurring of dynamic picture without reduction in the brightness and the contrast can be realized.

In the embodiment, the potentials of the voltages V0 to V43 are the same, although the present invention is not limited thereto and the range of gradation numbers in which the same potentials are produced can be set arbitrarily by set values of the amplitude registers VRP0 and VRP1, the inclination registers SRP0 and SRP1 and the fine adjustment registers PRP0 to PRP9.

Embodiment 3

A driving system for improving blurring of dynamic picture of a hold type display apparatus according to an embodiment 3 of the present invention is now described. The signal line driving circuit 101 of the embodiment 3 has the configuration shown in FIG. 1 similarly to the embodiment 1. In addition, the driving system of the embodiment includes the gradation voltage generation circuit having the configuration shown in FIG. 1 similarly to the embodiment 1, although the internal block configuration thereof is different from that of the embodiment 1.

Figure 10:
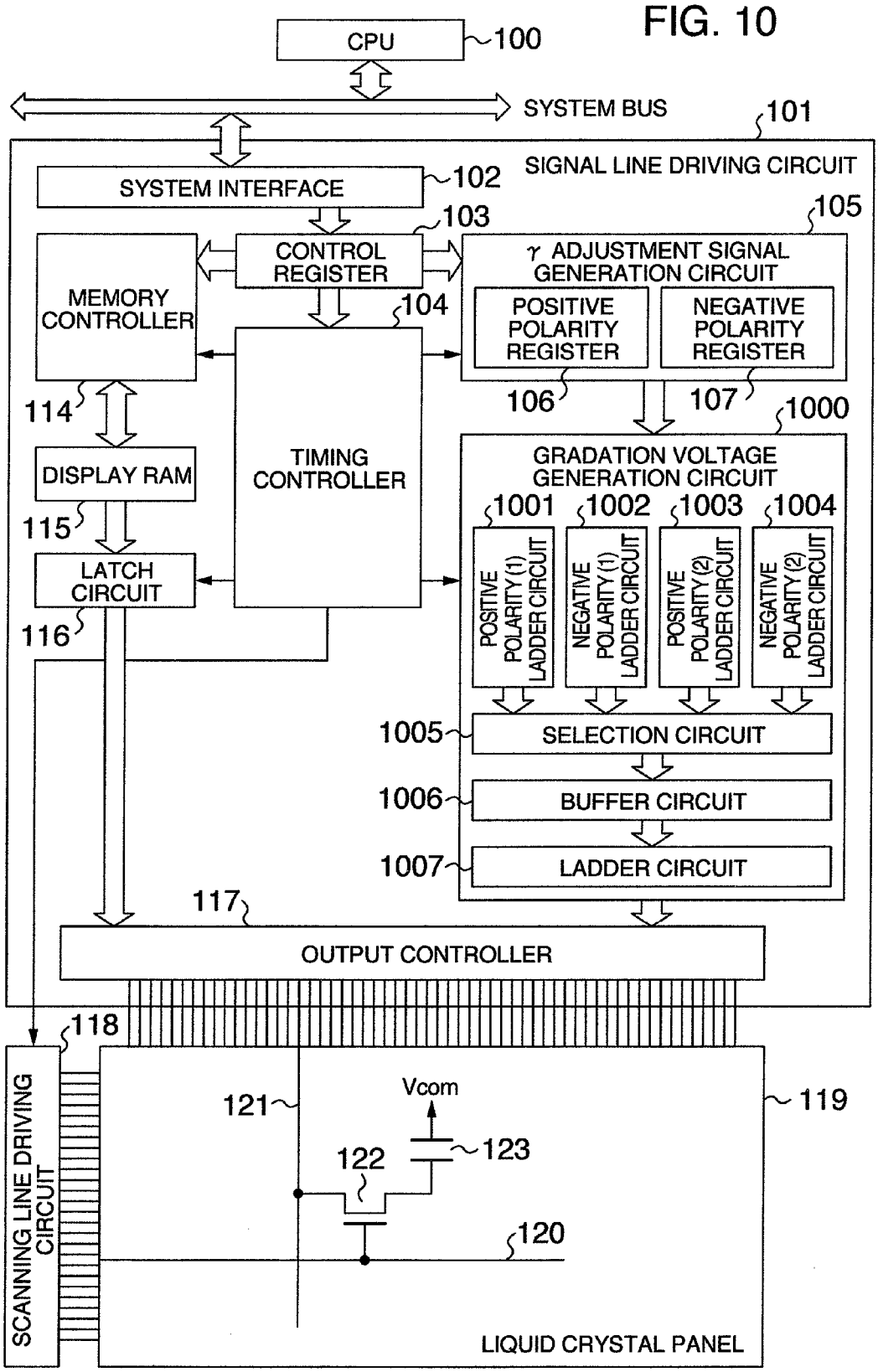
FIG. 10 is a schematic diagram illustrating a display apparatus including a gradation voltage generation circuit used in an embodiment 3 of the present invention.
Figure 11A:
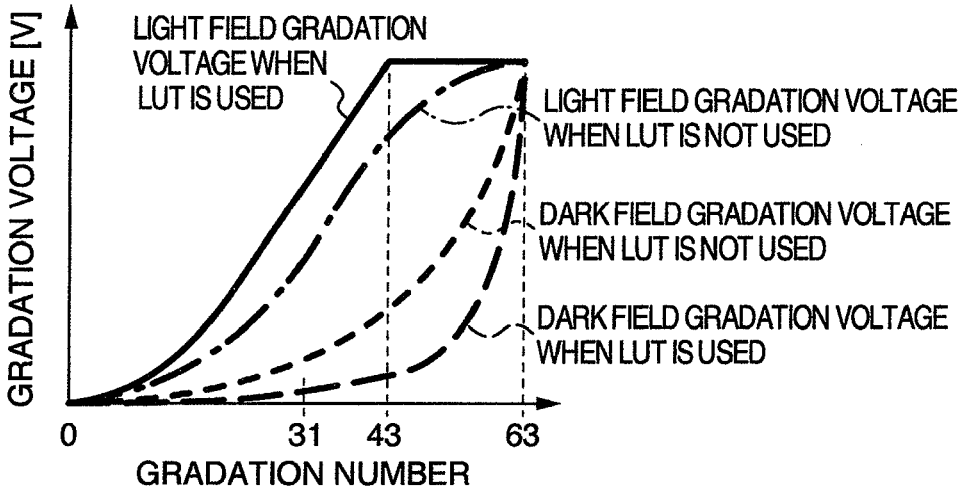
FIGS. 11A and 11B are graphs showing characteristics of gradation voltage to gradation number when spurious impulse type driving is made in the LUT system and the current system, respectively.
Figure 11B:
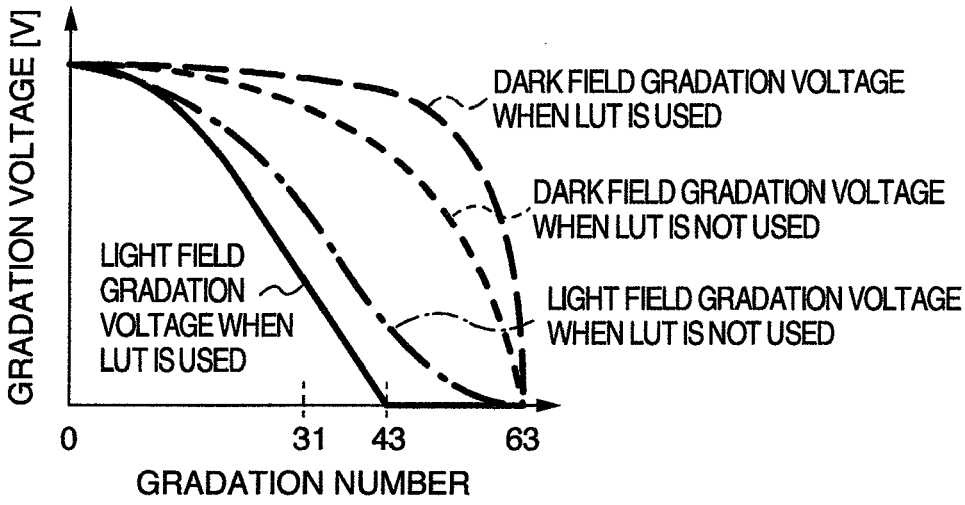

Referring now to FIG. 10, the gradation voltage generation circuit 1000 of the embodiment is described. In FIG. 10, numeral 1000 denotes a gradation voltage generation circuit, 1001 a positive polarity (1) ladder circuit, 1002 a negative polarity (1) ladder circuit, 1003 a positive polarity (2) ladder circuit, 1004 a negative polarity (2) ladder circuit, 1005 a selection circuit, 1006 a buffer circuit and 1007 a gradation voltage ladder circuit. The positive polarity (1) ladder circuit 1001, the negative polarity (2) ladder circuit 1002, the positive polarity (2) ladder circuit 1003 and the negative polarity (2) ladder circuit 1004 constitute the reference ladder circuit.

When the spurious impulse type driving is made, the γ adjustment register 105 supplies the register value held in the light field γ register of the positive polarity register 106 to the positive polarity (1) ladder circuit 1001, the register value held in the light field γ register of the negative polarity register 107 to the negative polarity (1) ladder circuit 1002, the register value held in the dark field γ register of the positive polarity register 106 to the positive polarity (2) ladder circuit 1003 and the register value held in the dark field γ register of the negative polarity register 107 to the negative polarity (2) ladder circuit 1004.

When the spurious impulse type driving is not made, the γ adjustment register 105 supplies the register value held in the normal field γ register of the positive polarity register 106 to the positive polarity (1) ladder circuit 1001 and the register value held in the normal field γ register of the negative polarity register 107 to the negative polarity (1) ladder circuit 1002.

These ladder circuits generate the reference voltage corresponding to the inputted register value to be supplied to the selection circuit 1005. The selection circuit 1005 selects one of the four kinds of reference voltages inputted from the ladder circuits in accordance with the γ set value switch signal and the alternating signal M inputted from the timing controller and supplies it to the buffer circuit 1006. The buffer circuit 1006 buffers the inputted reference voltage by the voltage follower circuit and supplies it to the gradation voltage ladder circuit 1007. The gradation voltage ladder circuit 1007 divides the inputted reference voltage using resistors to generate gradation voltages of 64 levels and supplies them to the output control circuit 117.

As described above, by providing the four positive and negative ladder circuits in accordance with the light and dark fields when the spurious impulse type driving is made, it is not necessary to generate the reference voltages in accordance with the light and dark field periods and accordingly the driving ability of the gradation voltages (reduction in variation time of the gradation voltage) can be improved as compared with the embodiments 1 and 2.

The circuit configuration of the positive polarity (1) ladder circuit 1001, the negative polarity (1) ladder circuit 1002, the positive polarity (2) ladder circuit 1003 and the negative polarity (2) ladder circuit 1004 of the embodiment may be the circuit configuration of the positive polarity ladder circuit 109 and the negative polarity ladder circuit 110 of the embodiment 1 or the embodiment 2.

Embodiment 4

Figure 12A:
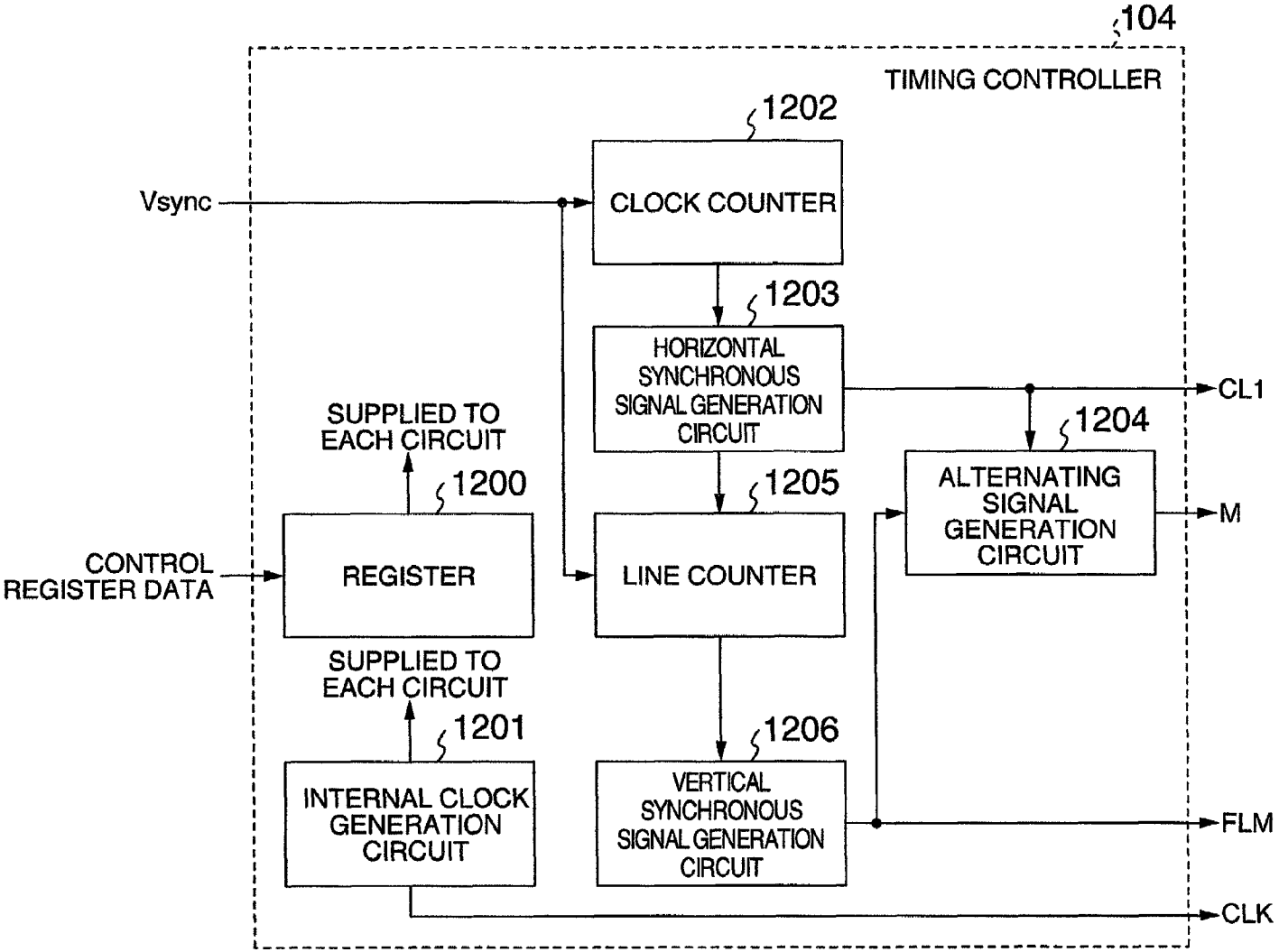
FIG. 12A is a schematic diagram illustrating the timing controller used in the liquid crystal panel peripheral circuit shown in FIG. 1.

Referring now to FIG. 12A, the internal block configuration and the timing of the timing controller 104 are described. In FIG. 12A, numeral 1200 denotes a register, 1201 an internal clock generation circuit, 1202 a clock counter, 1203 a horizontal synchronous signal generation circuit, 1204 an alternating signal generation circuit, 1205 a line counter and 1206 a vertical synchronous signal generation circuit.

Information such as one scanning period and one frame period inputted from the control circuit 103 shown in FIG. 1 is held in the register 1200 and is supplied to the clock counter 1202 and the line counter 1205.

The internal clock generation circuit 1201 generates the reference operation clock CLK and supplies it to each circuit. Each circuit operates on the basis of the reference clock CLK generated by the internal clock generation circuit 1201.

The clock counter 1202 counts the reference clock until the CLK value for one scanning period inputted from the register 1200 is reached and supplies the clock count to the horizontal synchronous signal generation circuit 1203. The clock count of clock counter 1202 is cleared (count=0) when the CLK value for one scanning period is exceeded or cleared by a falling edge of the inputted horizontal synchronous signal Vsync (active at low level in the embodiment).

The horizontal synchronous signal generation circuit 1203 generates the horizontal synchronous signal CL1 on the basis of the clock counter inputted from the clock counter 202. The horizontal synchronous signal CL1 rises (active at high level in the embodiment) when the clock count is equal to "0" and is the high level while the horizontal synchronous signal inputted from the register 1200 is active.

The line counter 1205 makes counting in synchronism with the rising of the horizontal synchronous signal CL1 until the number of lines for one frame period inputted from the register 1200 is reached and supplies the line count to the vertical synchronous signal generation circuit 1206. The line count of the line counter 1205 is cleared (count=0) when the number of lines for one frame period is exceeded or cleared by the falling edge of the inputted horizontal synchronous signal Vsync.

The vertical synchronous signal generation circuit 1206 generates a vertical synchronous signal FLM on the basis of the count inputted from the line counter 205. The vertical synchronous signal FLM rises (active at high level in the embodiment) when the line count is equal to "0" and is the high level while the vertical synchronous signal inputted from the register 1200 is active.

The alternating signal generation circuit 1204 generates an alternating signal M in response to the alternating signal ("0" in frame alternating driving and "1" in line alternating driving in the embodiment) inputted from the register 1200.

Figure 12B:
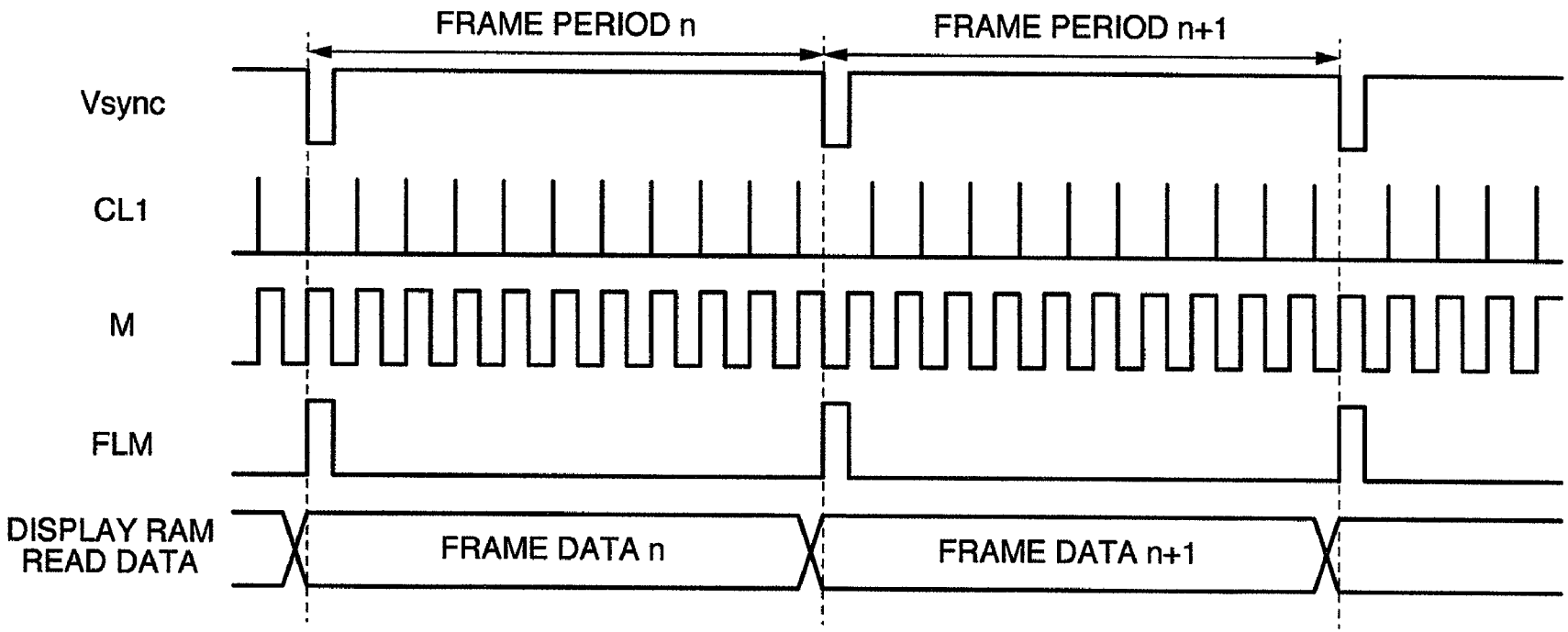
FIG. 12B is a timing chart showing operation of the timing controller shown in FIG. 12A.

Referring now to FIG. 12B, the operation timing of the signals generated by the timing controller 104 is described. The horizontal synchronous signal CL1 is generated on the basis of the inputted vertical synchronous signal Vsync. The horizontal synchronous signal CL1 is made active by the number of lines set in the register 1200.

The alternating signal M is made "high" and "low" repeatedly in accordance with the alternating method set in the register 1200. In the embodiment, since the line alternating driving is set, the alternating signal is made "high" or "low" during one scanning period.

The display data held in the display RAM is read out for one frame during one frame period.

Figure 13A:
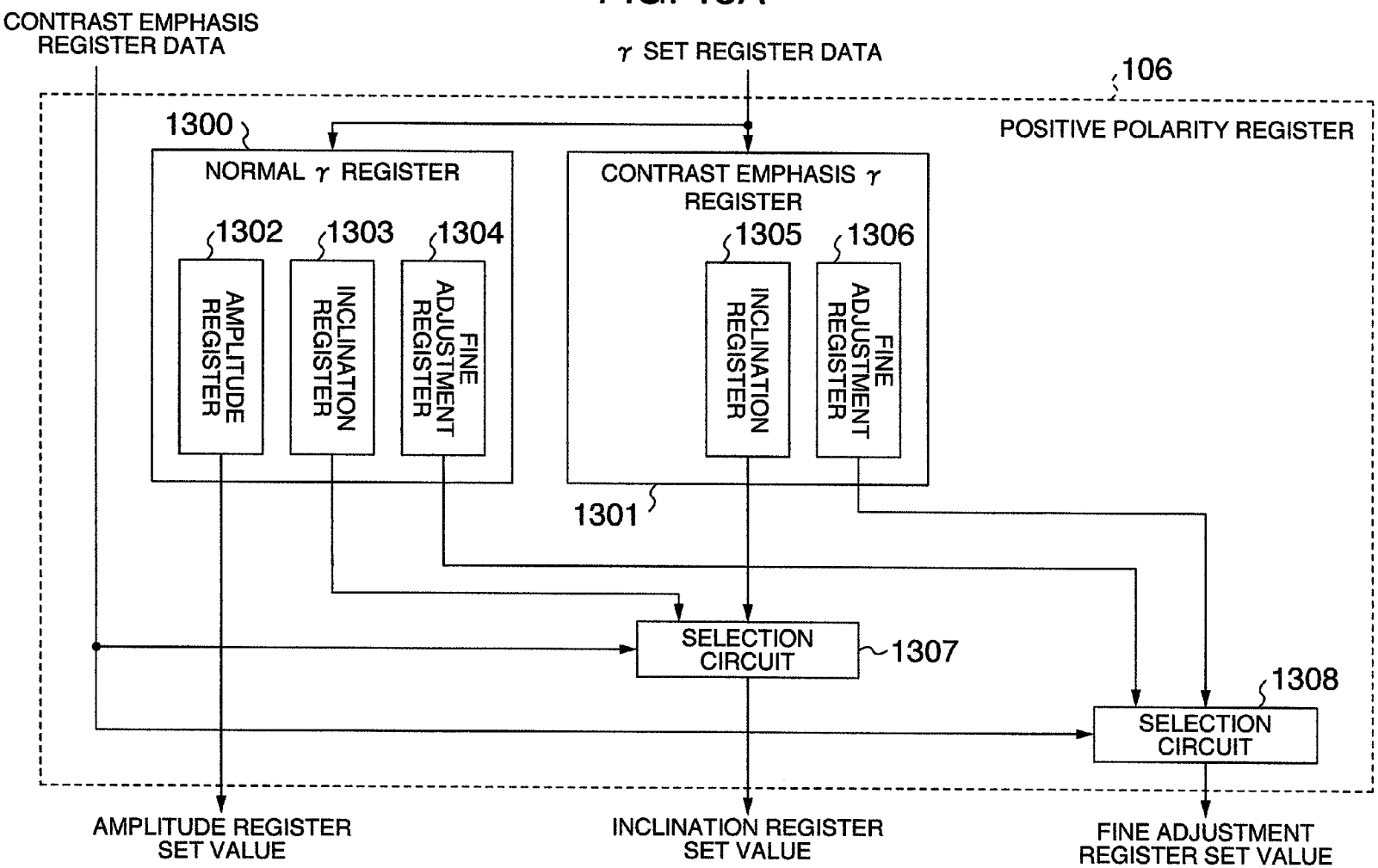
FIGS. 13A and 13B are schematic diagrams illustrating a positive polarity register used in the liquid crystal panel peripheral circuit shown in FIG. 1 and a normal γ register used in the positive polarity register shown in FIG. 13A, respectively.

Referring now to FIG. 13A, the internal block configuration of the positive polarity register 106 shown in FIG. 1 is described. The circuit configuration and operation of the negative polarity register 107 are the same as the positive polarity register 106.

In FIG. 13A, numeral 1300 denotes a normal γ register, 1301 a contrast emphasis γ register, 1302 an amplitude register, 1303 and 1305 inclination registers, 1304 and 1306 fine adjustment registers and 1307 and 1308 selection circuits.

The γ register value inputted from the control register 103 shown in FIG. 1 is classified into an amplitude register value, an inclination register value or a fine adjustment register value, which is supplied to the gradation voltage generation circuit 108, so that variable registers in the positive polarity ladder circuit 109 and the negative polarity ladder circuit 110 of the gradation voltage generation circuit 108 can be adjusted to thereby set a potential of the gradation voltage.

The amplitude register value is a set value for adjusting an amplitude of the gradation voltage and the inclination adjustment register value is a set value for adjusting an inclination near the middle of the characteristics of the gradation voltage to the gradation number without changing the dynamic range largely. The fine adjustment register value is a set value for finely adjusting the gradation voltage level.

The amplitude adjustment register value, the inclination register value and the fine adjustment register value are held in the amplitude register 1302, the inclination registers 1303 and 1305 and the fine adjustment registers 1304 and 1306 of the normal γ register 1300 and the contrast emphasis γ register 1301, respectively.

Since the amplitude register value has the same value (the amplitude of the gradation voltage is fixed) even in all cases irrespective of emphasis of the contrast, the amplitude register value is held in only the amplitude register 1302 of the normal γ register 1300 and even in the emphasis of the contrast the amplitude register value held in the amplitude register 1302 is supplied to the gradation voltage generation circuit 108 to thereby suppress increase of the circuit scale.

When the contrast emphasis register data (when it is "high" the contrast emphasis is used and when it is "low" the contrast emphasis is not used in the embodiment) inputted from the control register 103 is "low", the selection circuit 1307 selects the inclination register value held in the inclination register 1303 of the normal γ register 1300 to be supplied to the gradation voltage generation circuit 108. Moreover, when the contrast emphasis register data is "high", the selection circuit 1307 selects the inclination register value held in the inclination register 1305 of the contrast emphasis γ register 1301 to be supplied to the gradation voltage generation circuit 108.

When the contrast register data inputted from the control register 103 is "low", the selection circuit 1308 selects the fine adjustment register value held in the fine adjustment register 1304 of the normal γ register 1300 to be supplied to the gradation voltage generation circuit 108. Moreover, when the contrast emphasis register data is "high", the selection circuit 1308 selects the fine adjustment register value held in the fine adjustment register 1306 of the contrast emphasis γ register 1301 to be supplied to the gradation voltage generation circuit 108.

Figure 13B:
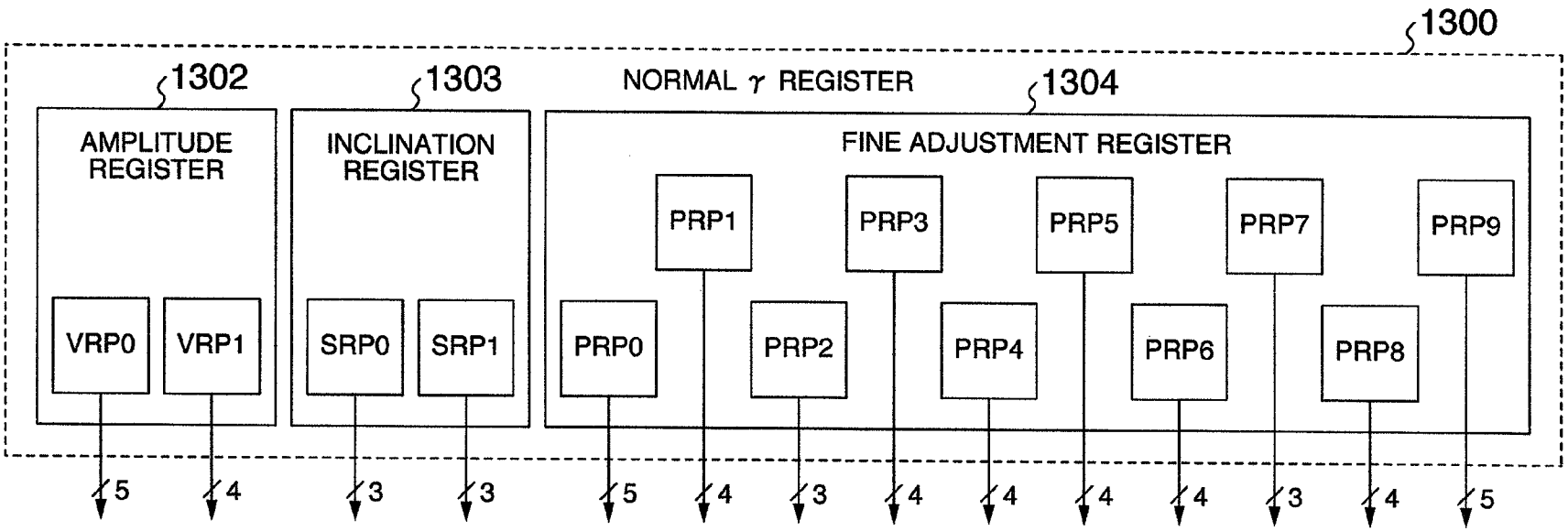

Referring now to FIG. 13B, the internal configuration of each register in the normal γ register 1300 is described. The amplitude register 1302 includes two registers VRP0 and VRP1 and the amplitude value of the gradation voltage is adjusted by the register values held in the two registers VRP0 and VRP1. The inclination register 1303 includes two registers SRP0 and SRP1 and the inclination near the middle of the characteristics of the gradation voltage to the gradation number is adjusted by the register values held in the two registers SRP0 and SRP1. The fine adjustment register 1304 includes ten registers PRP0 to PRP9 and the gradation voltage level is finely adjusted by the register values held in the ten registers PRP0 to PRP9. The internal configuration of the contrast emphasis γ register 1301 has the same internal configuration as that of the inclination register 1303 and the fine adjustment register 1304.

Figure 14:
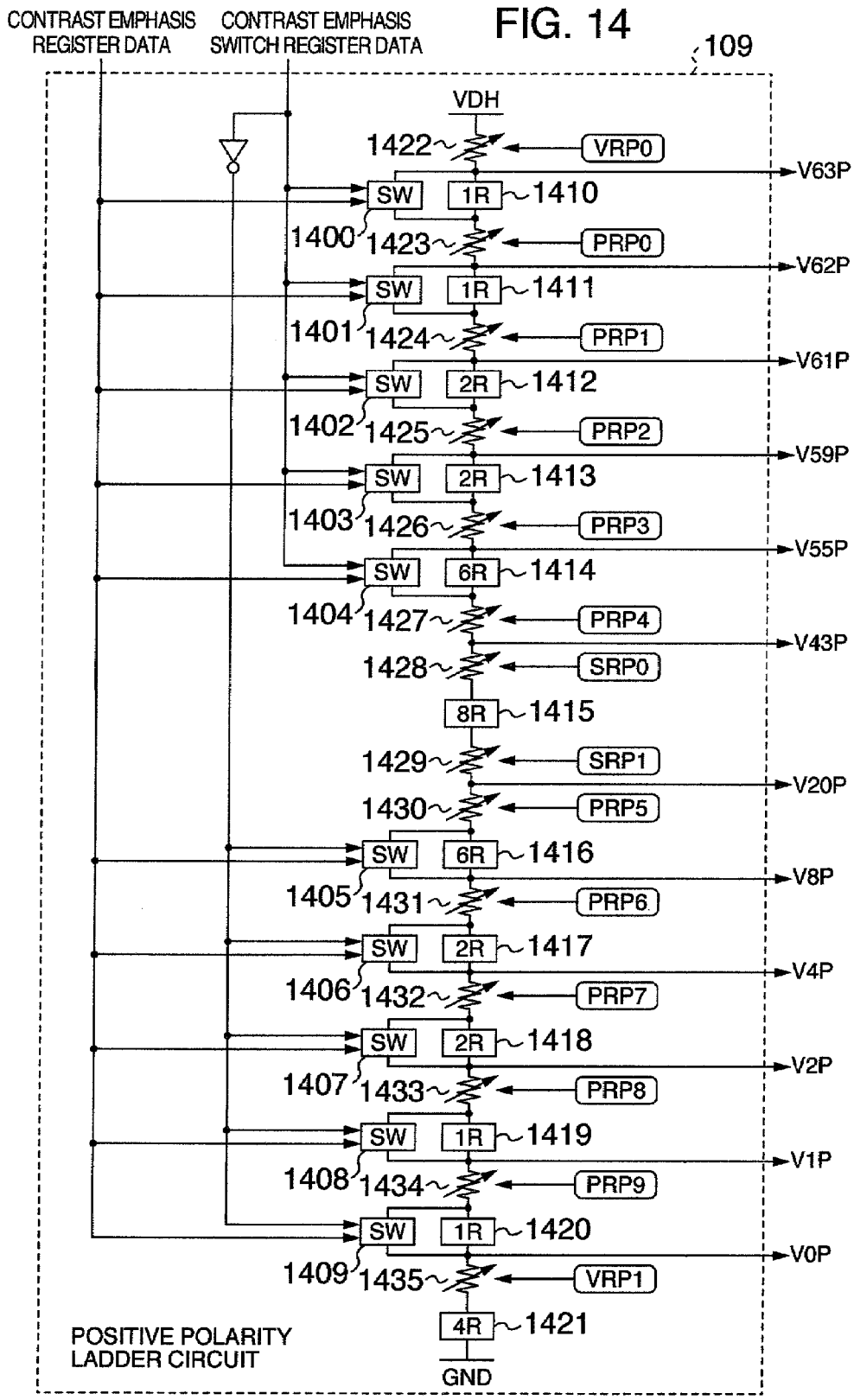
FIG. 14 is a schematic diagram illustrating the positive polarity ladder circuit used in the liquid crystal panel peripheral circuit shown in FIG. 1.

Referring now to FIG. 14, the internal block configuration of the positive polarity ladder circuit 109 shown in FIG. 1 is described. In FIG. 14, numerals 1400 to 1409 denote SWs, 1410 to 1421 fixed resistors and 1422 to 1435 variable resistors.

The variable resistors 1422 and 1435 have resistance values set in accordance with the amplitude register values VRP0 and VRP1 inputted from the amplitude register 1302. The variable resistors 1428 and 1429 have resistance values set in accordance with the inclination register values SRP0 and SRP1 inputted from the inclination register 1303. The variable resistors 1423 to 1427 and 1430 to 1434 have resistance values set in accordance with the fine adjustment register values PRP0 to PRP4 and PRP5 to PRP9 inputted from the fine adjustment register 1304.

The minimum resistance values of the variable resistors 1422 to 1435 are set to resistance value (ideally 0Ω) to the degree that a potential difference between the gradations is not produced by the voltage division using resistors. When the SWs 1400 to 1409 are on, the on-resistance thereof is sufficiently small as compared with the fixed resistors 1410 to 1420 and when the SWs 1400 to 1409 are off, the off-resistance thereof is sufficiently large as compared with the fixed resistors 1410 to 1420.

When the contrast emphasis register data is "low" (when the contrast emphasis is not used), all of the SWs 1400 to 1409 are turned off, so that a current flows through the fixed resistors 1410 to 1414 and 1416 to 1420 and the reference high voltage VDH is divided by the resistance values of the fixed resistors and the variable resistors to generate reference voltages V0P, V1P, V2P, V4P, V8P, V20P, V43P, V55P, V59P, V61P, V62P and V63P of 12 levels. The potentials of the reference voltages are all different and not identical.

V0P is a potential for positive polarity of gradation number 0, V1P a potential for positive polarity of gradation number 1, V2P a potential for positive polarity of gradation number 2, V4P a potential for positive polarity of gradation number 4, V8P a potential for positive polarity of gradation number 8, V20P a potential for positive polarity of gradation number 20, V43P a potential for positive polarity of gradation number 43, V55P a potential for positive polarity of gradation number 55, V59P a potential for positive polarity of gradation number 59, V61P a potential for positive polarity of gradation number 61, V62P a potential for positive polarity of gradation number 62 and V63P a potential for positive polarity of gradation number 63.

Figure 16A:
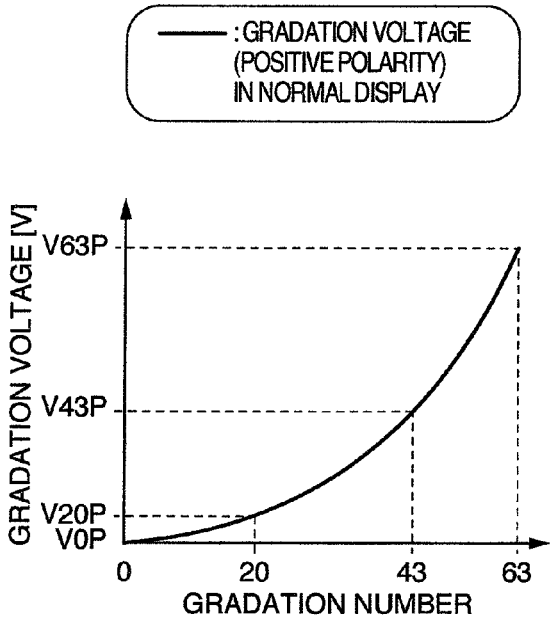
FIGS. 16A to 16D are graphs showing characteristics of gradation voltage to gradation number in an embodiment 4 of the present invention.
Figure 16B:
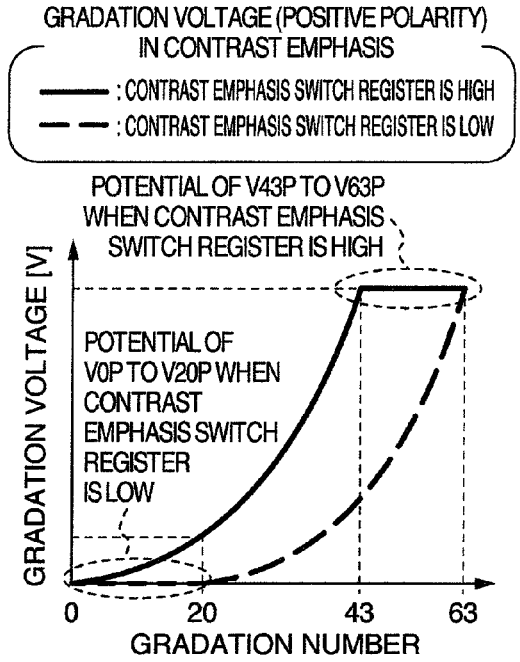

The reference voltages of 12 levels are buffered by the buffer circuit 112 shown in FIG. 1 and then supplied to the gradation voltage ladder circuit 113. The gradation voltage ladder circuit 113 makes the voltage division using resistors on the basis of the reference voltages of 12 levels and generates the gradation voltages for the remaining gradation numbers 3, 5-7, 9-19, 21-42, 44-54, 56-58 and 60 in case of 64-gradation display. The characteristics of the gradation voltage to the gradation number at this time are as shown in FIG. 16A.

When the contrast emphasis register data is "high" (when contrast emphasis is used) and the contrast emphasis switch register data is "high", the SWs 1400 to 1404 are turned on, so that a current flows through the SWs 1400 to 1404 and a current does not flow through the fixed resistors 1410 to 1414. Further, since the SWs 1405 to 1409 are turned off, a current flows through the fixed resistors 1416 to 1420.

At this time, when the resistance values of the variable resistors 1422 to 1427 are set to a minimum value by the fine adjustment register values PRP0 to PRP4 and the amplitude register value VRP0, the reference high voltage VDH is not divided by resistors and accordingly the potentials of the reference voltages V43P to V63P of 6 levels are identical since the reference high voltage VDH is outputted. The reference voltages V0P to V20P of other 6 levels are divided by resistors since a current flows through the fixed resistors 1416 to 1420 and accordingly the reference voltages V0P to V20P are not the same potential.

Next, when the contrast emphasis register data is "high" (when contrast emphasis is used) and the contrast emphasis switch register data is "low", the SWs 1400 to 1404 are turned off and accordingly a current flows through the fixed resistors 1410 to 1414. Moreover, since the SWs 1405 to 1409 are turned on, a current flows through the SWs 1405 to 1409 and a current does not flow through the fixed resistors 1416 to 1420.

At this time, when the resistance values of the variable resistors 1430 to 1435 are set to a minimum value by the fine adjustment register values PRP5 to PRP9 and the amplitude register value VRP1, the reference high voltage VDH is not divided by resistors and accordingly the potentials of the reference voltages V0P to V20P of 6 levels are identical since the reference low voltage GND is outputted. The reference voltages V63P to V43P of other 6 levels are divided by resistors since a current flows through the fixed resistors 1410 to 1414 and accordingly the reference voltages V63P to V43P are not the same potential.

From the foregoing operation, when the contrast emphasis switch register data is "high", the same voltage can be outputted in the gradations of V43 to V63 and when the contrast emphasis switch register data is "low", the same voltage can be outputted in the gradations of V0 to V20 as shown in the characteristics of the gradation voltage to the gradation number in FIG. 16.

Figure 15:
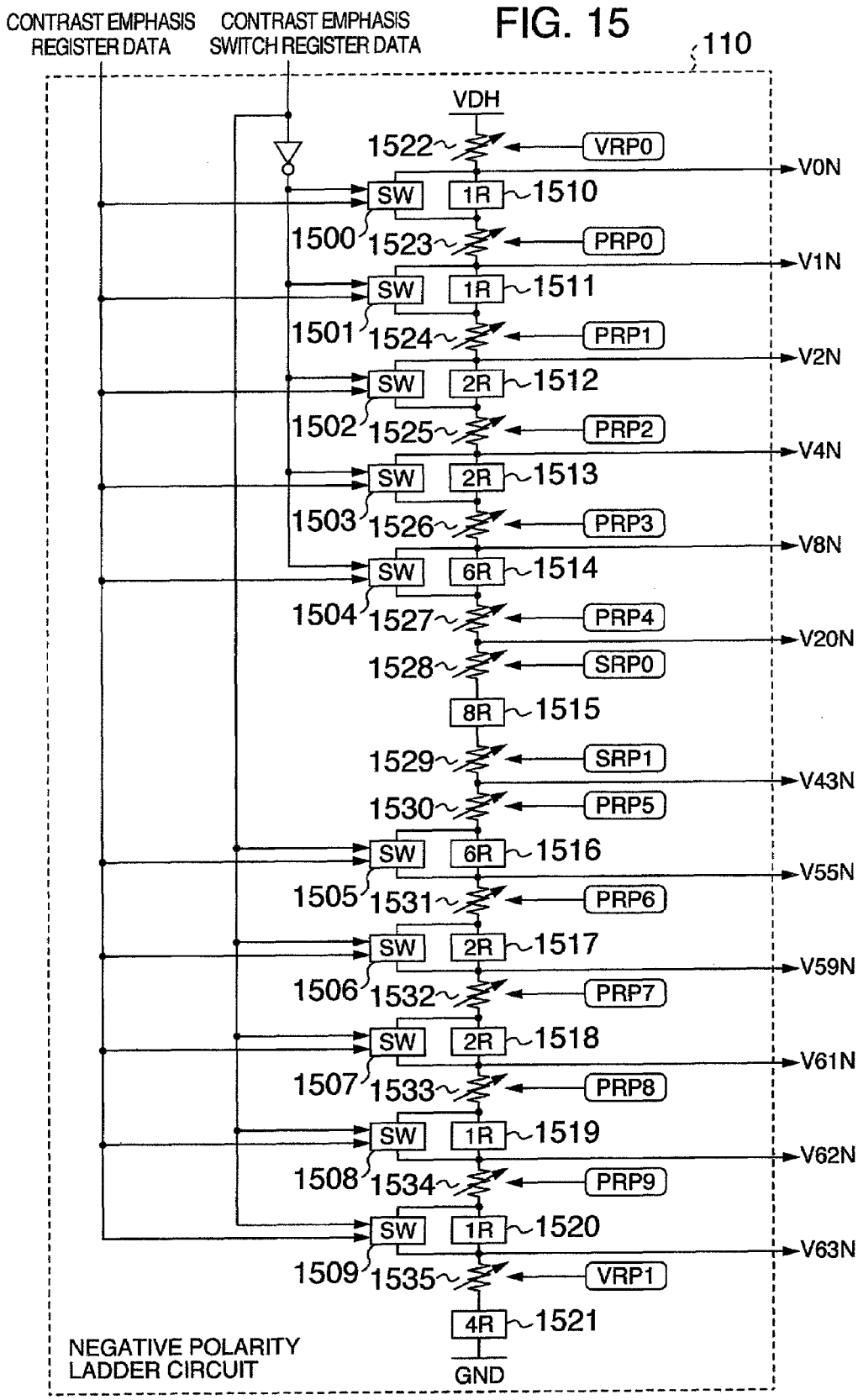
FIG. 15 is a schematic diagram illustrating the negative polarity ladder circuit used in the liquid crystal panel peripheral circuit shown in FIG. 1.

Referring now to FIG. 15, the internal block configuration of the negative polarity ladder circuit 110 is described. In FIG. 15, numerals 1500 to 1509 denote SWs, 1510 to 1521 fixed resistors and 1522 to 1535 variable resistors. The resistance values of the fixed resistors 1510 to 1521 and the variable resistors 1522 to 1535 have the same values as those of the fixed resistors 1410 to 1421 and the variable resistors 1422 to 1435 of the positive polarity ladder circuit 109 shown in FIG. 14.

The variable resistors 1522 and 1535 have resistance values set in accordance with the amplitude register value inputted from the γ adjustment register 105. The variable resistors 1528 and 1529 have resistance values set in accordance with the inclination register value inputted from the γ adjustment register 105. The variable resistors 1523 to 1527 and 1530 to 1534 have resistance values set in accordance with the fine adjustment register value inputted from the γ adjustment register 105.

The minimum resistance values of the variable resistors 1522 to 1535 are set to resistance value (ideally 0Ω) to the degree that a potential difference between the gradations is not produced by the voltage division using resistors. When the SWs 1500 to 1509 are on, the on-resistance thereof is sufficiently small as compared with the fixed resistors 1510 to 1520 and when the SWs 1500 to 1509 are off, the off-resistance thereof is sufficiently large as compared with the fixed resistors 1510 to 1520.

When the contrast emphasis register data is "low" (when the contrast emphasis is not used), all of the SWs 1500 to 1509 are turned off, so that a current flows through the fixed resistors 1510 to 1514 and 1516 to 1520 and the reference high voltage VDH is divided by the resistance values of the fixed resistors and the variable resistors to generate reference voltages V0N, V1N, V2N, V4N, V8N, V20N, V43N, V55N, V59N, V61N, V62N and V63N of 12 levels. The potentials of the reference voltages V0N to V63N are all different and not identical.

V0N is a potential for negative polarity of gradation number 0, V1N a potential for negative polarity of gradation number 1, V2N a potential for negative polarity of gradation number 2, V4N a potential for negative polarity of gradation number 4, V8N a potential for negative polarity of gradation number 8, V20N a potential for negative polarity of gradation number 20, V43N a potential for negative polarity of gradation number 43, V55N a potential for negative polarity of gradation number 55, V59N a potential for negative polarity of gradation number 59, V61N a potential for negative polarity of gradation number 61, V62N a potential for negative polarity of gradation number 62 and V63N a potential for negative polarity of gradation number 63.

Figure 16C:
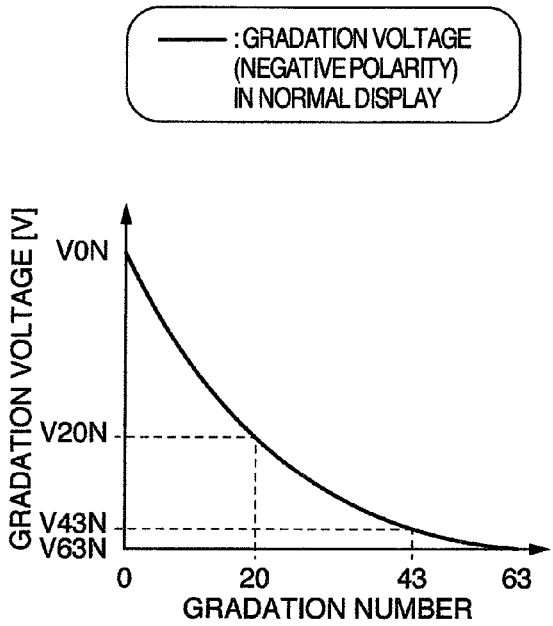

The reference voltages of 12 levels are buffered by the buffer circuit 112 shown in FIG. 1 and then supplied to the gradation voltage ladder circuit 113. The gradation voltage ladder circuit 113 makes the voltage division using resistors on the basis of the reference voltages of 12 levels and generates the gradation voltages for the remaining gradation numbers 3, 5-7, 9-19, 21-42, 44-54, 56-58 and 60 in case of 64-gradation display. The characteristics of the gradation voltage to the gradation number at this time are as shown in FIG. 16C.

When the contrast emphasis register data is "high" (when the contrast emphasis is used) and the contrast emphasis switch register data is "high", the SWs 1505 to 1509 are turned on, so that a current flows through the SWs 1505 to 1509 and a current does not flow through the fixed resistors 1516 to 1520. Further, since the SWs 1500 to 1504 are turned off, a current flows through the fixed resistors 1510 to 1514.

At this time, when the resistance values of the variable resistors 1530 to 1535 are set to a minimum value by the fine adjustment register values PRN5 to PRN9 and the amplitude register value VRN1, the reference high voltage VDH is not divided by resistors and accordingly the potentials of the reference voltages V43N and V63N of 6 levels are identical since the reference low voltage GND is outputted. Other reference voltages V0N to V20N of 6 levels are divided by resistors since a current flows through the fixed resistors 1510 to 1514 and the reference voltages V0N to V20N are not the same potential.

Next, when the contrast emphasis register data is "high" (when the contrast emphasis is used) and when the contrast emphasis switch register data is "low", the SWs 1505 to 1509 are turned off and accordingly a current flows through the fixed resistors 1516 to 1520. Moreover, since the SWs 1500 to 1504 are turned on, a current flows through the SWs 1500 to 1504 and a current does not flow through the fixed resistors 1510 to 1514.

At this time, when the resistance values of the variable resistors 1522 to 1527 are set to a minimum value by the fine adjustment register value PRN0 to PRN4 and the amplitude register value VRN0, the reference high voltage VDH is not divided by resistors and accordingly the potentials of the reference voltages V0N to V20N of 6 levels are identical since the reference high voltage VDH is outputted. The reference voltages V43N to V63N of other 6 levels are divided by resistors since a current flows through the fixed resistors 1516 to 1520 and the reference voltages V43N to V63N are not the same potential.

Figure 16D:
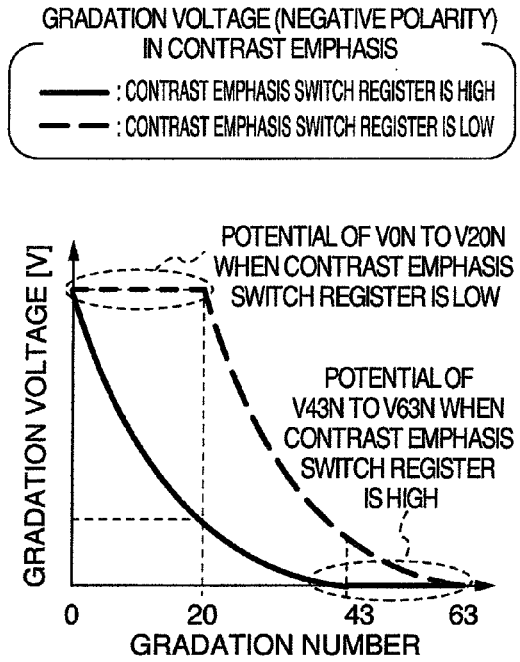

From the foregoing operation, when the contrast emphasis switch register data is "high", the same voltage can be outputted in the gradations of V43 to V63 and when the contrast emphasis switch register data is "low", the same voltage can be outputted in the gradations of V0 to V20 as shown in the characteristics of the gradation voltage to the gradation number in FIG. 16D.

As described above, according to the embodiment, control of the contrast characteristics on the low and high gradation sides can be realized by the low-cost ladder circuit without using the LUT.

Embodiment 5

Figure 17:
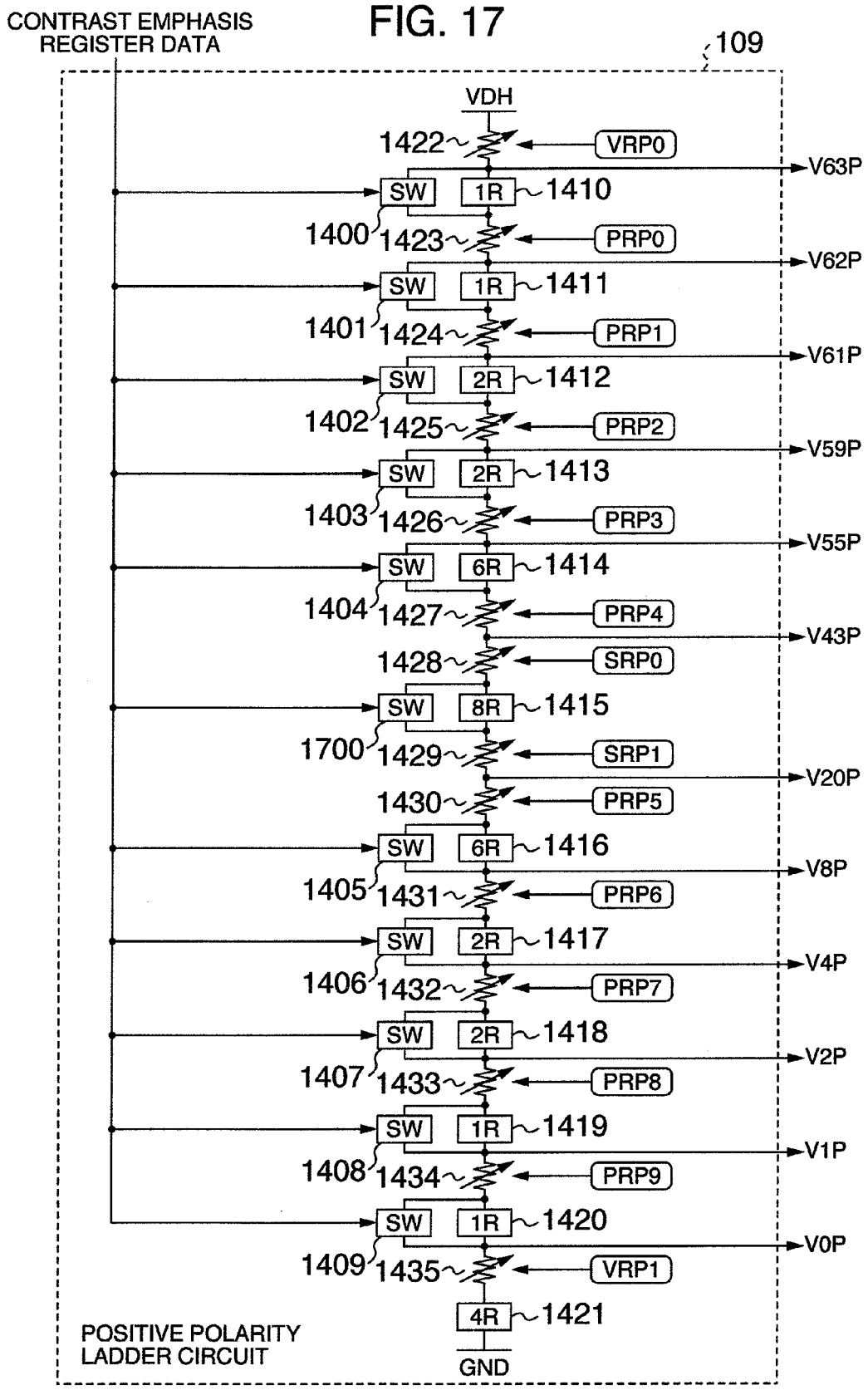
FIG. 17 is a schematic diagram illustrating a positive polarity ladder circuit used in an embodiment 5 of the present invention.
Figure 18:
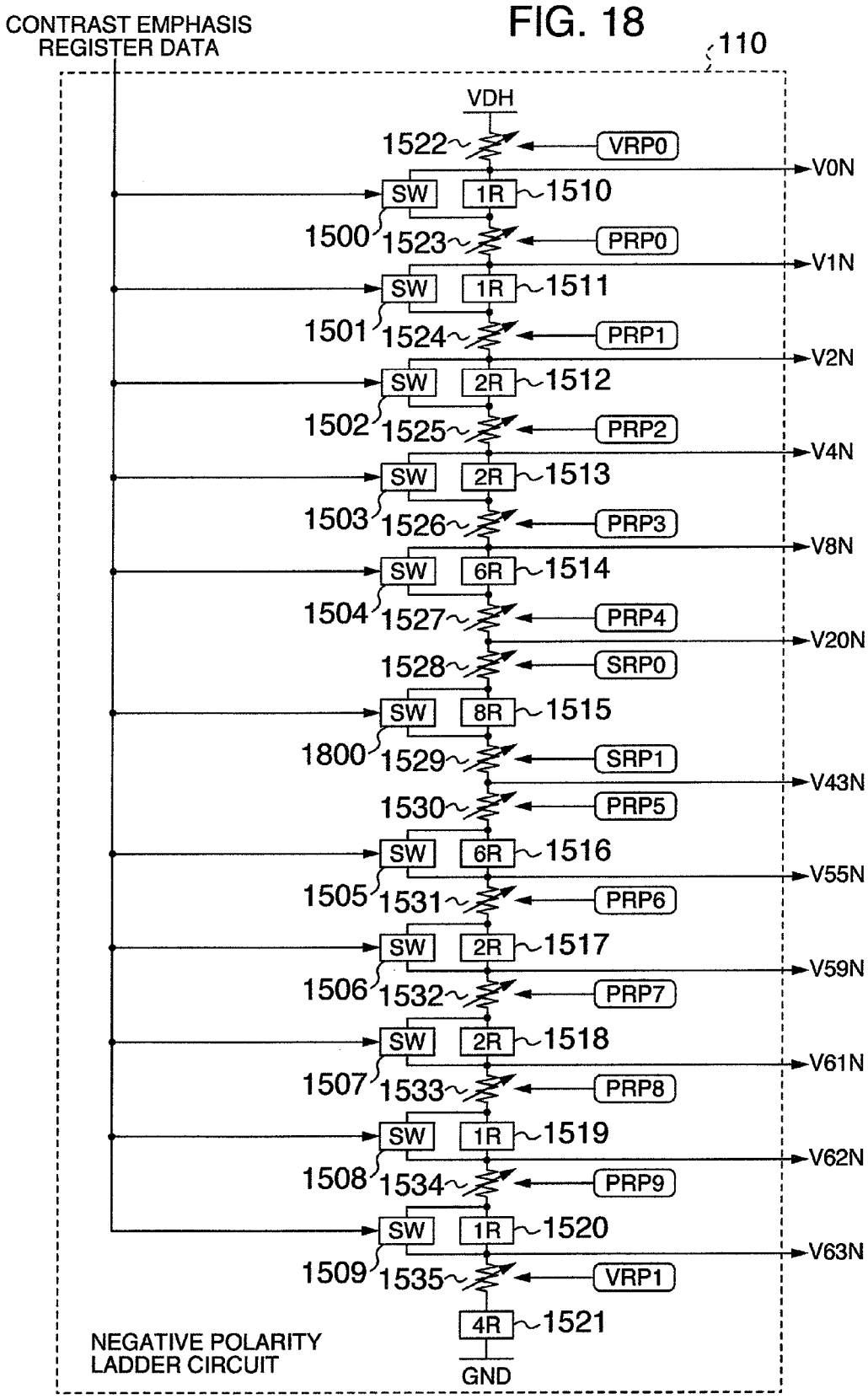
FIG. 18 is a schematic diagram illustrating a negative polarity ladder circuit used in the embodiment 5 of the present invention.
Figure 19A:
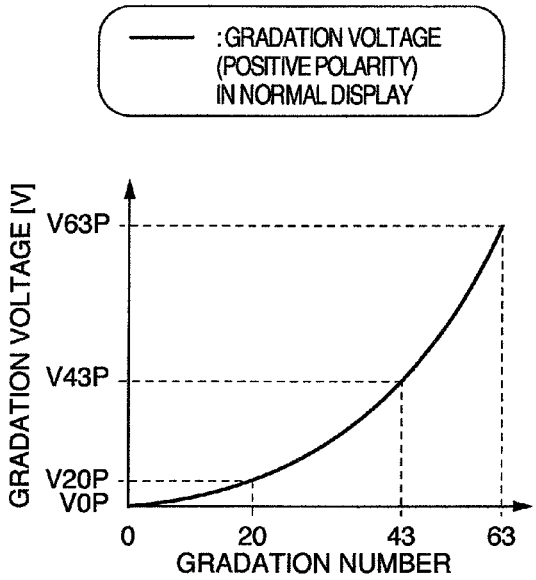
FIGS. 19A to 19D are graphs showing characteristics of gradation voltage to gradation number in the embodiment 5 of the present invention.

In the embodiment, the circuit configuration of the positive polarity ladder circuit 109 and the negative polarity ladder circuit 110 is different from that of the embodiment 4. That is, in the embodiment, FIGS. 17 to 19 are used instead of FIGS. 14 to 16 of the embodiment 4 and the contrast emphasis switch register data is omitted. Instead, a SW 1700 is connected in parallel to the fixed resistor 1415 in FIG. 17 and a SW 1800 is connected in parallel to the fixed resistor 1515 in FIG. 18. Consequently, the contrast characteristics on the high and low gradation sides can be emphasized widely as shown in FIG. 19D. Other configuration is the same as that of the embodiment 4.

Referring now to FIG. 17, the positive polarity ladder circuit 109 is described. In FIG. 17, when the contrast emphasis register data is "low" (when the contrast emphasis is not used), the SWs 1400 to 1409 and 1700 are turned off, so that a current flows through the fixed resistors 1410 to 1420 and the reference high voltage VDH is divided by the resistance values of the fixed resistors and the variable resistors to generate reference voltages V0P, V1P, V2P, V4P, V8P, V20P, V43P, V55P, V59P, V61P, V62P and V63P of 12 levels. The potentials of the reference voltages are all different and are not identical.

The gradation voltage ladder circuit 113 shown in FIG. 1 divides the reference voltages of 12 levels by resistors on the basis of the reference voltages of 12 levels and generates the gradation voltages for the remaining gradation numbers 3, 5-7, 9-19, 21-42, 44-54, 56-58 and 60 in case of 64-gradation display. The characteristics of the gradation voltage to the gradation number at this time are as shown in FIG. 19A.

Next, when the contrast emphasis register data is "high" (when the contrast emphasis is used), the SWs 1400 to 1409 and 1700 are turned on, so that a current flows through the SWs 1400 to 1409 and 1700 and a current does not flow through the fixed resistors 1410 to 1420.

At this time, when the resistance values of the variable resistors 1422 to 1429 are set to a minimum value by the fine adjustment register values PRP0 to PRP4, the inclination register values SPR0 and SPR1 and the amplitude register value VPR0 in order to emphasize the contrast on the low gradation side (in order to make the potential on the high gradation side identical), the reference high voltage VDH is not divided by resistors and accordingly the potentials of the reference voltages V20P to V63P of 7 levels are identical since the reference high voltage VDH is outputted. Since a current does not flow through the fixed resistors 1416 to 1420 but the reference high voltage VDH is divided by resistors by adjusting the variable resistors 1430 to 1435 by setting of the fine adjustment register values PRP5 to PRP9 and the amplitude register value VRP1, the reference voltages V0P to V8P of other 5 levels are not the same potential.

Furthermore, when the resistance values of the variable resistors 1428 to 1435 are set to a minimum value by the fine adjustment register values PRP5 to PRP9, the inclination register values SRP0 and SRP1 and the amplitude register value VRP1 in order to emphasize the contrast on the high gradation side (in order to make the potential on the low gradation side identical) when the contrast emphasis register data is "high" (when the contrast emphasis is used), the reference high voltage VDH is not divided by resistors and accordingly the potentials of the reference voltages V0P to V43P of 7 levels are identical since the reference low voltage GDN is outputted. Since a current does not flow through the fixed resistors 1410 to 1414 but the reference high voltage VDH is not divided by resistors by adjusting the variable resistors 1422 to 1426 by setting of the fine adjustment register values PRP0 to PRP3 and the amplitude register value VRP0, the reference voltages V55P to V63P of other 5 levels are not the same potential.

Figure 19B:
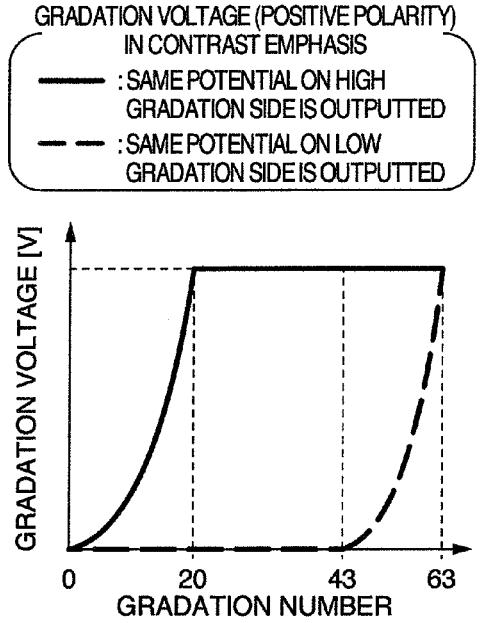

From the above operation, the potentials on the high gradation side can be made identical to emphasize the contrast on the low gradation side and the potentials on the low gradation side can be made identical to emphasize the contrast on the high gradation side as shown in FIG. 19B.

Referring now to FIG. 18, the negative polarity ladder circuit is described. In FIG. 18, when the contrast emphasis register data is "low" (when the contrast emphasis is not used, the SWs 1500 to 1509 and 1800 are turned off and a current flows through the fixed resistors 1510 to 1520, so that the reference high voltage VDH is divided by the resistance values of the fixed resistors and the variable resistors to generate reference voltages V0N, V1N, V2N, V4N, V8N, V20N, V43N, V55N, V59N, V61N, V62N and V63N of 12 levels. The potential of the reference voltages V0N to V63N are all different and not identical.

Figure 19C:
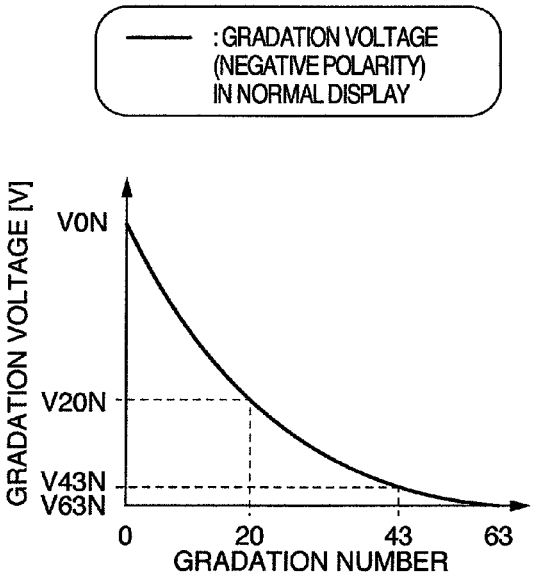
Figure 19D:
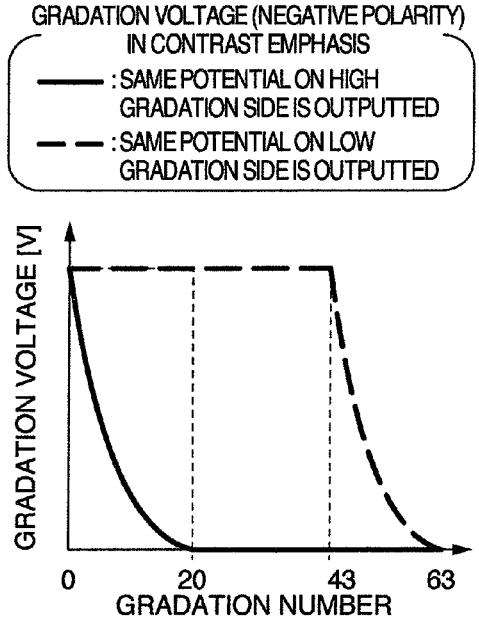

The gradation voltage ladder circuit 113 shown in FIG. 1 divides the reference voltages of 12 levels by resistors on the basis of the reference voltages of 12 levels and generates the gradation voltages for the remaining gradation numbers 3, 5-7, 9-19, 21-42, 44-54, 56-58 and 60 in case of 64-gradation display. The characteristics of the gradation voltage to the gradation number at this time are as shown in FIG. 19C.

When the contrast emphasis register data is "high" (when the contrast emphasis is used), the SWs 1500 to 1509 and 1800 are turned on, so that a current flows through the SWs 1500 to 1509 and 1800 and a current does not flow through the fixed resistors 1510 and 1520.

At this time, when the resistance values of the variable resistors 1528 to 1535 are set to a minimum value by the fine adjustment register values PRN5 to PRN9, the inclination register values SRN0 and SRN1 and the amplitude register value VRN1 in order to emphasize the contrast on the low gradation side (in order to make the potentials on the high gradation side identical), the reference high voltage VDH is not divided by resistors and accordingly the potentials of the reference voltages V20N to V63N of 7 levels are identical since the reference low voltage GND is outputted. Since a current does not flow through the fixed resistors 1510 to 1514 but the reference high voltage VDH is divided by resistors by adjusting the variable resistors 1422 to 1527 by setting of the fine adjustment register values PRP0 to PRP4 and the amplitude register value VRP0, the reference voltages V0N to V8N of other 5 levels are not the same potential.

Further, when the resistance values of the variable resistors 1522 to 1527 are set to a minimum value by the fine adjustment register values PRP0 to PRP4, the inclination register values SRP0 and SRP1 and the amplitude register value VRP0 in order to emphasize the contrast on the high gradation side (in order to make the potentials on the low gradation side identical) when the contrast emphasis register data is "high" (when the contrast emphasis is used), the reference high voltage VDH is not divided by resistors and accordingly the potentials of the reference voltages V0N to V43N of 7 levels are identical since the reference high voltage GDN is outputted. Since a current does not flow through the fixed resistors 1516 to 1520 but the reference high voltage VDH is not divided by resistors by adjusting the variable resistors 1513 to 1535 by setting of the fine adjustment register values PRP6 to PRP9 and the amplitude register value VRN1, the reference voltages V55N to V63N of other 5 levels are not the same potential.

From the above operation, the potentials on the high gradation side can be made identical to emphasize the contrast on the low gradation side and the potentials on the low gradation side can be made identical to emphasize the contrast on the high gradation side as shown in FIG. 19D.

Embodiment 6

Figure 20:
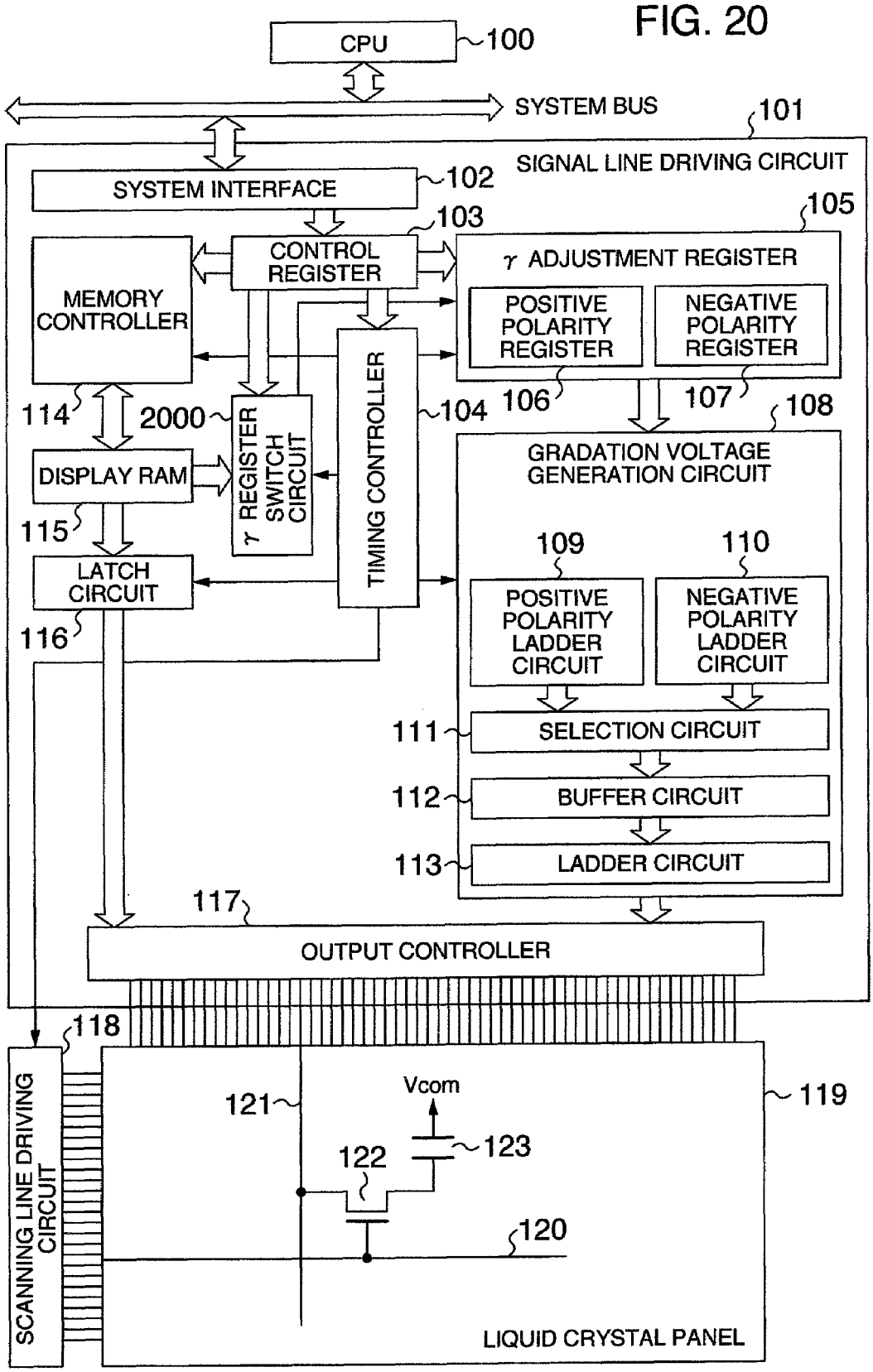
FIG. 20 is a schematic diagram illustrating a liquid crystal display apparatus according to an embodiment 6 of the present invention.
Figure 21A:
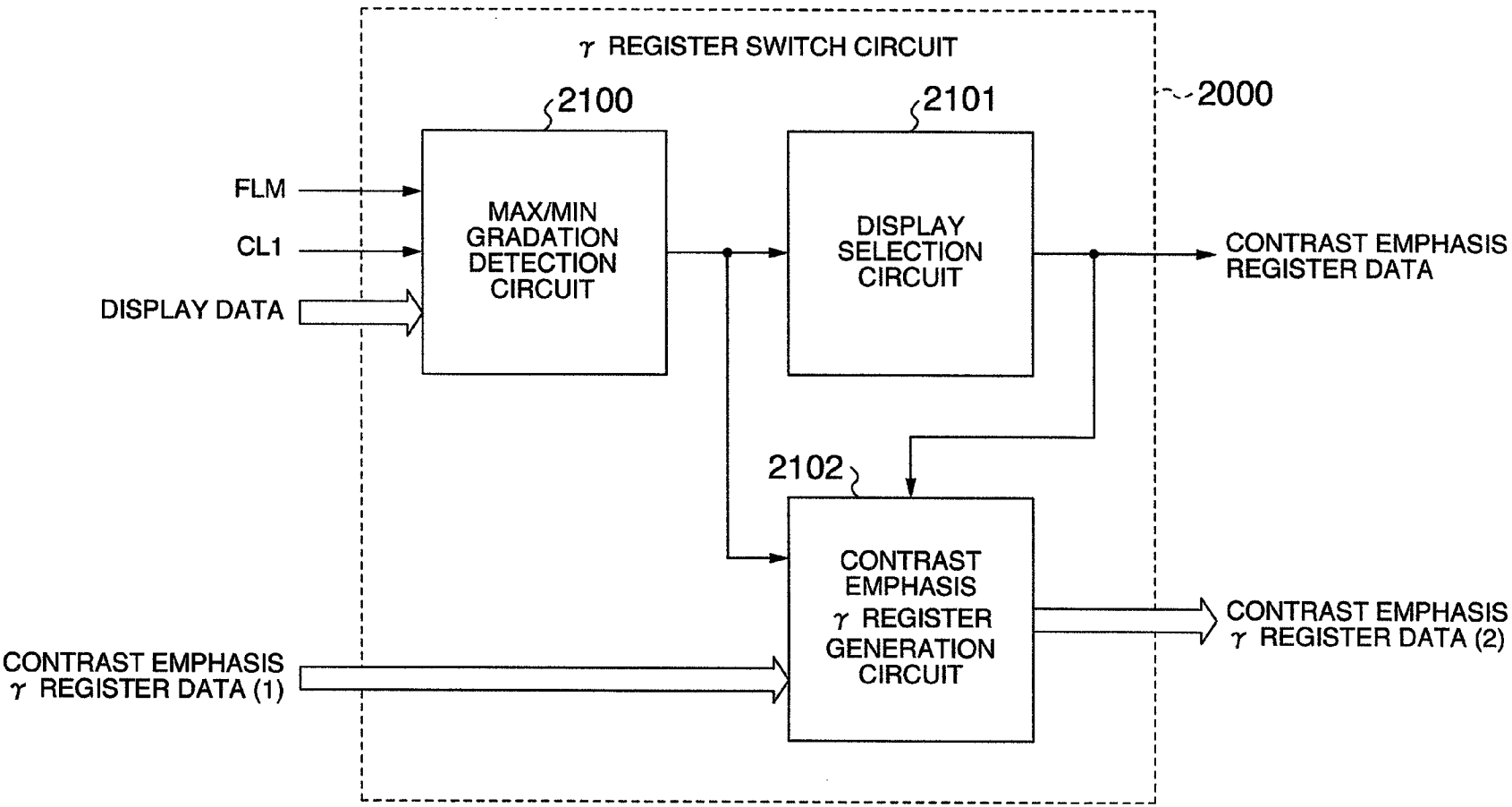
FIG. 21A is a schematic diagram illustrating a γ0 register switch circuit used in the liquid crystal display apparatus shown in FIG. 20.

FIG. 20 is a schematic diagram illustrating a liquid crystal display apparatus of the embodiment in which a γ register switch circuit 2000 is provided in the signal line driving circuit 101 shown in FIG. 1. The γ register switch circuit 2000 includes, as shown in FIG. 21A, a maximum/minimum gradation detection circuit 2100, a display selection circuit 2101 and a contrast emphasis γ register generation circuit 2102. Moreover, one frame period may be divided into n field periods (n is an integer equal to or larger than 2) so that the potential on the high gradation side may be made identical during at least one field period of the n fields and the potential on the low gradation side may be made identical during at least another field period of the n fields. Consequently, the blurring of dynamic picture can be reduced while suppressing reduction in the brightness.

Figure 21B:
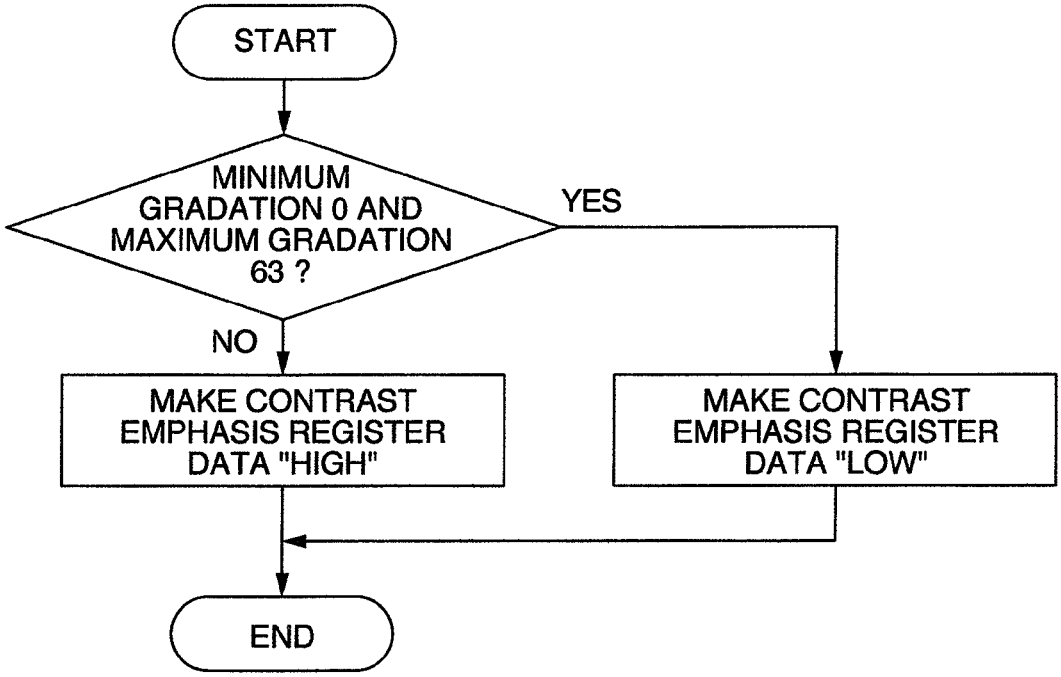
FIG. 21B is a flow chart showing operation of a display selection circuit used in the γ register switch circuit shown in FIG. 21A.

In FIG. 21A, the maximum/minimum gradation detection circuit 2100 detects the maximum and minimum gradations within one frame period and the display selection circuit 2101 generates contrast emphasis register data in accordance with the flow shown in FIG. 21B. The contrast emphasis γ register generation circuit 2102 generates contrast emphasis γ register data (2) in accordance with the flow shown in FIGS. 22 and 23 and supplies it to the positive polarity register 106 and the negative polarity register 107, so that the contrast control can be controlled in accordance with the display data for each frame. Further, the contrast emphasis γ register data (2) is generated in the maximum and minimum gradations within one frame period, although it may be generated in histogram data within one frame period.

Referring now to FIGS. 20 to 23, operation of the γ register switch circuit 2000 is described. Operation of other configuration is the same as in FIG. 1.

The maximum/minimum gradation detection circuit 2100 of the γ register switch circuit 2000 detects maximum and minimum gradations within one frame period of the display data from the display RAM 115 on the basis of the vertical synchronous signal FLM and the horizontal synchronous signal CL1 from the timing controller 104 and supplies the maximum and minimum gradations to the display selection circuit 2101 and the contrast emphasis γ register generation circuit 2102.

The display selection circuit 2101 is supplied with the detected maximum and minimum gradations, so that the display selection circuit 2102 makes the contrast emphasis register data "low" in case where the minimum gradation is 0 and the maximum gradation is 63 and makes it "high" in other cases to be outputted as shown in FIG. 21B. That is, when the minimum and minimum gradations 0 and 63 are contained in the display data, the contrast emphasis is not made in order to reproduce the display data faithfully from the minimum gradation 0 to the maximum gradation 63. In other cases, the contrast emphasis is made in accordance with the minimum and maximum gradations in the display data.

The contrast emphasis γ register generation circuit 2102 outputs the contrast emphasis γ register data (1) from the control register 103 as the contrast emphasis γ register data (2) as it is when the contrast emphasis register data inputted from the display selection circuit 2101 is "low". When the contrast emphasis register data is "high", the contrast emphasis γ register generation circuit 2102 corrects the contrast emphasis γ register data (1) on the basis of the minimum and maximum gradations inputted from the maximum/minimum gradation detection circuit 2100 and outputs it as the contrast emphasis γ register data (2).

Figure 22:
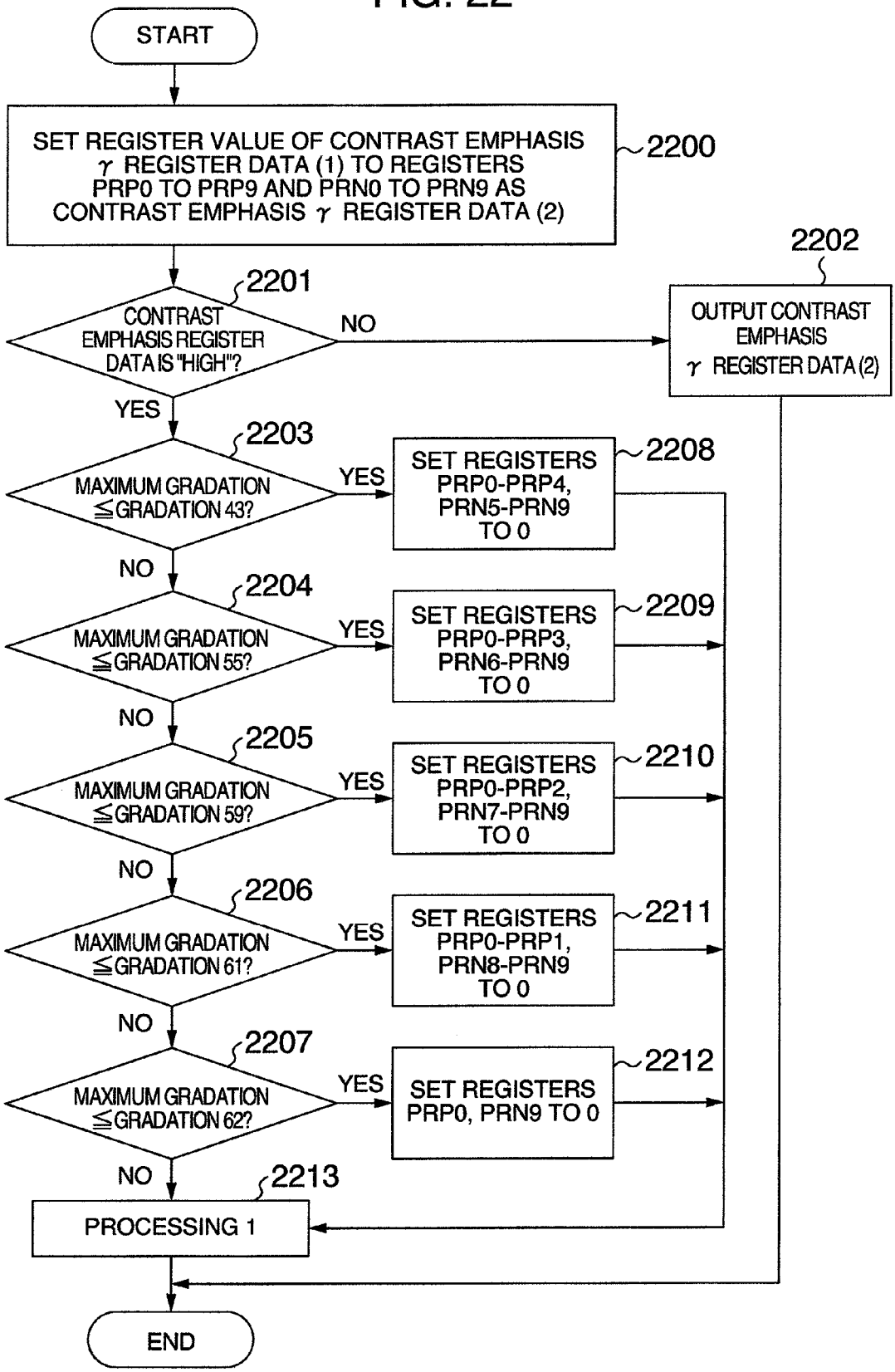
FIG. 22 is a flow chart showing operation of a contrast emphasis γ register generation circuit used in the γ register switch circuit shown in FIG. 21A.
Figure 23:
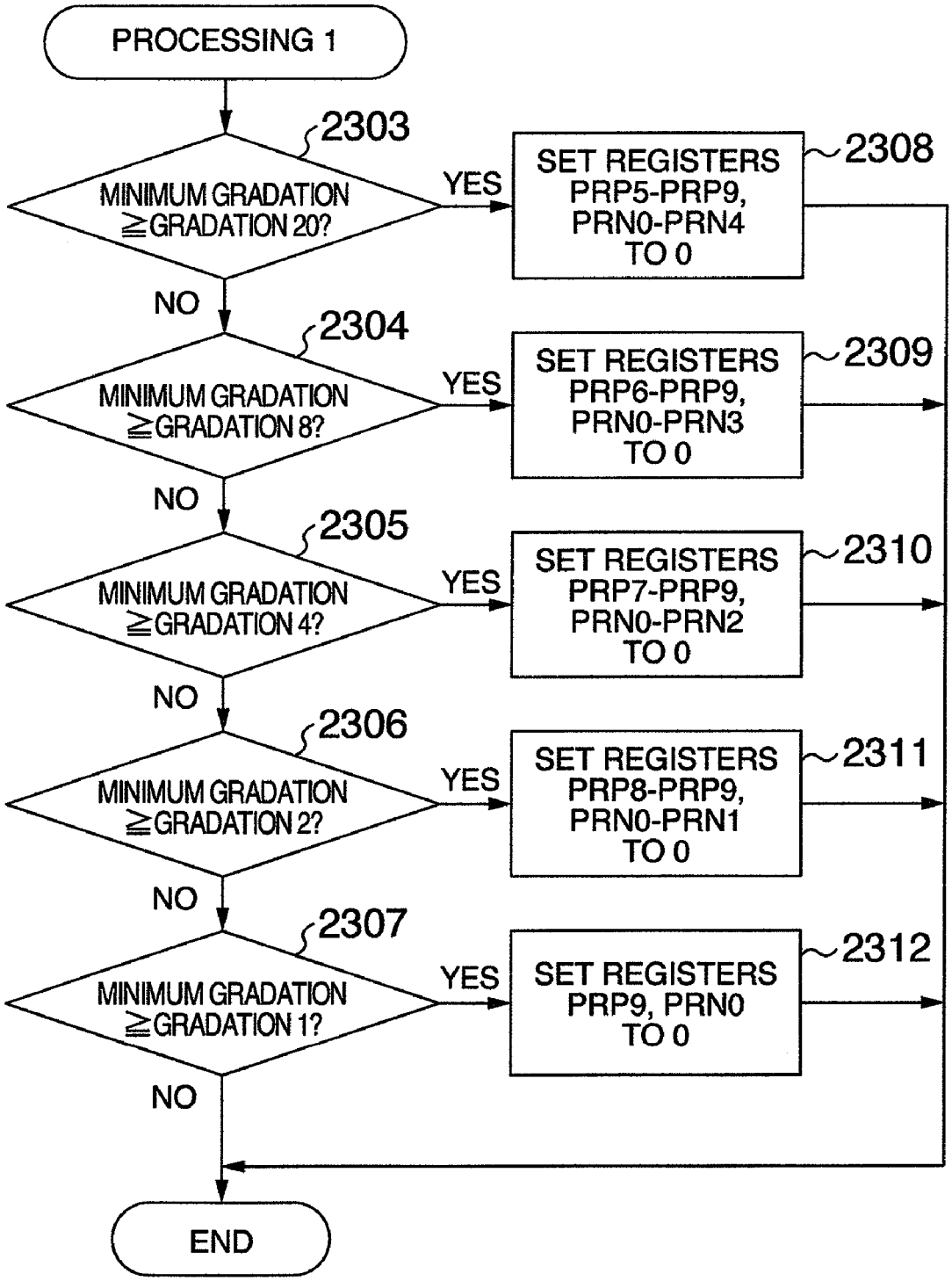
FIG. 23 is a flow chart showing operation of a contrast emphasis γ register generation circuit used in the γ register switch circuit shown in FIG. 21A.

Referring now to FIGS. 22 and 23, operation of generating the contrast emphasis γ register data (2) by the contrast emphasis γ register generation circuit 2102 is described.

First, in step 2200 of FIG. 22, the register value of the contrast emphasis γ register data (1) inputted to the contrast emphasis γ register generation circuit 2102 is set to the positive polarity fine adjustment registers PRP0 to PRP9 and the negative polarity fine adjustment registers PRN0 to PRN9 and is outputted as the contrast emphasis γ register data (2) from the contrast emphasis γ register generation circuit 2102. Next, in step 2201, it is judged whether the contrast emphasis register data inputted from the display selection circuit 2101 to the contrast emphasis γ register generation circuit 2102 is "high" or not. When it is "low", the contrast emphasis γ register data (1) is not corrected and is outputted as the correction emphasis γ register data (2) from the contrast emphasis γ register generation circuit 2102 as it is and the processing is ended without emphasizing the contrast.

In step 2201, when the contrast emphasis register data is "high", it is successively judged whether the maximum gradation in the display data is smaller than or equal to 43, 55, 59, 61 and 62 in steps 2203 to 2207, respectively, in order to emphasize the contrast.

In other words, in step 2203, when the maximum gradation is smaller than or equal to 43, the values of registers PRP0 to PRP4 and PRN5 to PRN9 are set to 0 in step 2208 and the processing 1 for the minimum gradation shown in FIG. 23 is performed in step 2213.

In step 2204, when the maximum gradation is smaller than or equal to 55, that is, when the maximum gradation in the display data is larger than 43 and smaller than or equal to 55, the values of registers PRP0 to PRP3 and PRN6 to PRN9 are set to 0 in step 2209 and the processing 1 for the minimum gradation shown in FIG. 23 is performed in step 2213.

In step 2205, when the maximum gradation is smaller than or equal to 59, that is, when the maximum gradation in the display data is larger than 55 and smaller than or equal to 59, the values of registers PRP0 to PRP2 and PRN7 to PRN9 are set to 0 in step 2210 and the processing 1 for the minimum gradation shown in FIG. 23 is performed in step 2213.

In step 2206, when the maximum gradation is smaller than or equal to 61, that is, when the maximum gradation in the display data is larger than 59 and smaller than or equal to 61, the values of registers PRP0 to PRP1 and PRN8 to PRN9 are set to 0 in step 2211 and the processing 1 for the minimum gradation shown in FIG. 23 is performed in step 2213.

In step 2207, when the maximum gradation is smaller than or equal to 62, that is, when the maximum gradation in the display data is equal to 62, the values of registers PRP0 and PRN9 are set to 0 in step 2212 and the processing 1 for the minimum gradation shown in FIG. 23 is performed in step 2213. Further, in step 2207, when the maximum gradation is 63, the values of registers PRP0 to PRP4 and PRN5 to PRN9 are not corrected and the processing 1 for the minimum gradation shown in FIG. 23 is performed in step 2213.

Referring now to FIG. 23, the processing 1 for the minimum gradation of step 2213 is described. It is successively judged whether the minimum gradation in the display data is larger than or equal to 20, 8, 4, 2 and 1 in steps 2303 to 2307, respectively.

That is, in step 2303, when the minimum gradation is larger than or equal to 20, the values of the registers PRP5 to PRP9 and PRN0 to PRN4 are set to 0 in step 2308 and the processing is ended.

In step 2304, when the minimum gradation is larger than or equal to 8, that is, when the minimum gradation in the display data is larger than or equal to 8 or smaller than 20, the values of the registers PRP6 to PRP9 and PRN0 to PRN3 are set to 0 in step 2309 and the processing is ended.

In step 2305, when the minimum gradation is larger than or equal to 4, that is, when the minimum gradation in the display data is larger than or equal to 4 or smaller than 8, the values of the registers PRP7 to PRP9 and PRN0 to PRN2 are set to 0 in step 2310 and the processing is ended.

In step 2306, when the minimum gradation is larger than or equal to 2, that is, when the minimum gradation in the display data is larger than or equal to 2 or smaller than 4, the values of the registers PRP8 to PRP9 and PRN0 to PRN1 are set to 0 in step 2311 and the processing is ended.

In step 2307, when the minimum gradation is equal to 1, the values of the registers PRP9 and PRN0 are set to 0 in step 2312 and the processing is ended. Further, in step 2307, when the minimum gradation is equal to 0, the values of the registers PRP5 to PRP9 and PRN0 to PRN4 are not corrected and the processing is ended.

Figure 24:
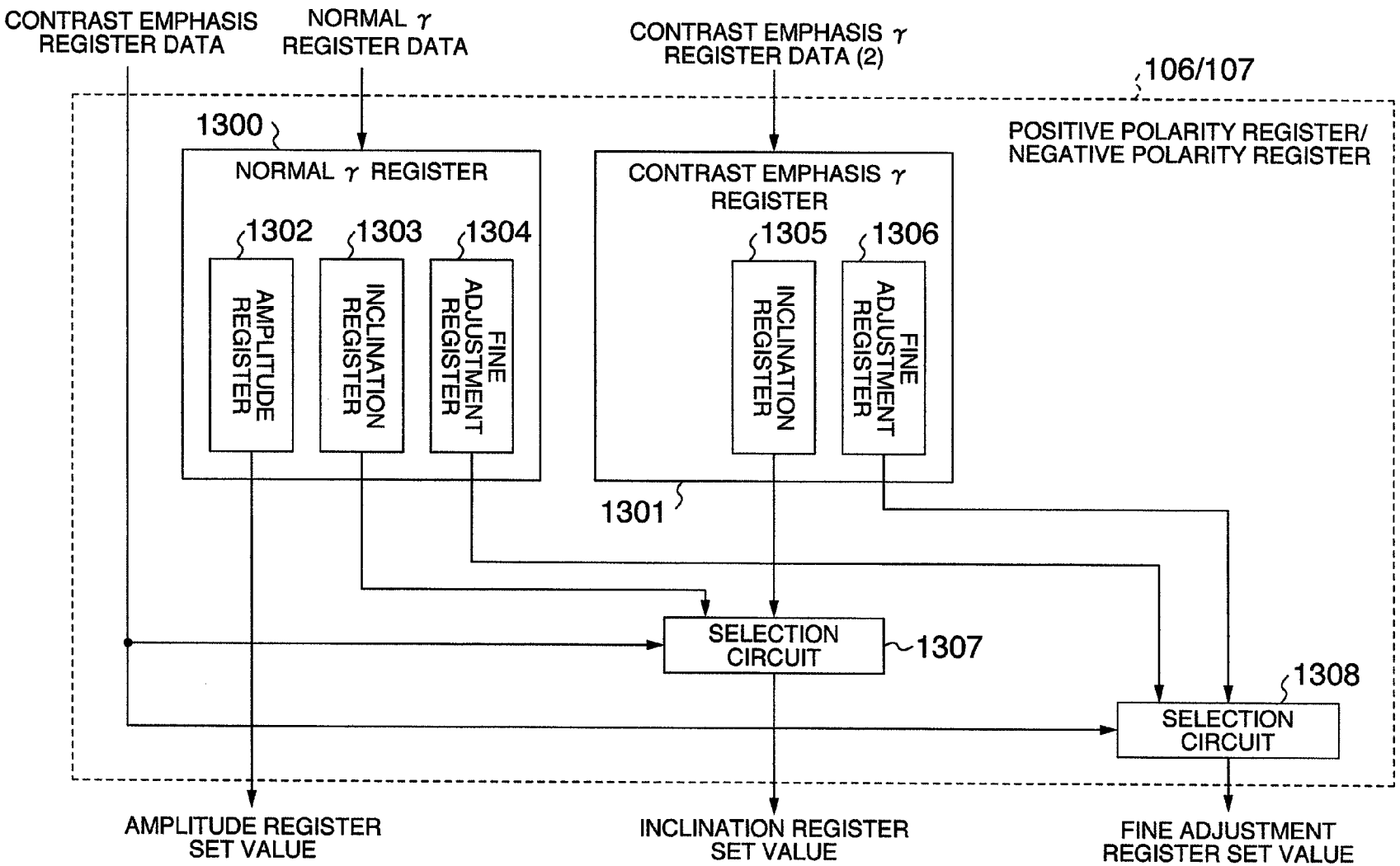
FIG. 24 is a schematic diagram illustrating positive and negative polarity registers used in the liquid crystal display apparatus shown in FIG. 20.

In this manner, the contrast emphasis register data and the contrast emphasis γ register data (2) generated by the γ register switch circuit 2000 shown in FIGS. 20 and 21A are supplied to the positive polarity register 106 and the negative polarity register 107 shown in FIG. 24. The configuration of FIG. 24 is different from that of FIG. 13A in that the normal γ register data and the contrast emphasis γ register data (2) are used in FIG. 24 instead of the γ set register data used in FIG. 13A and other configuration of FIG. 24 is the same as that of FIG. 13A.

Figure 25A:
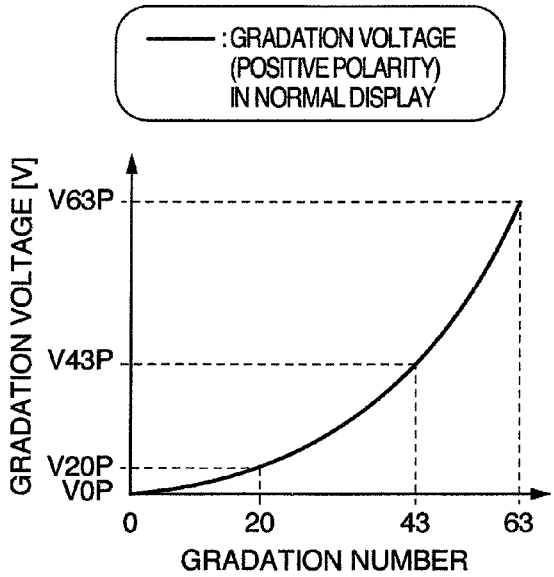
FIGS. 25A to 25D are graphs showing characteristics of gradation voltage to gradation number in an embodiment 6 of the present invention.
Figure 25B:
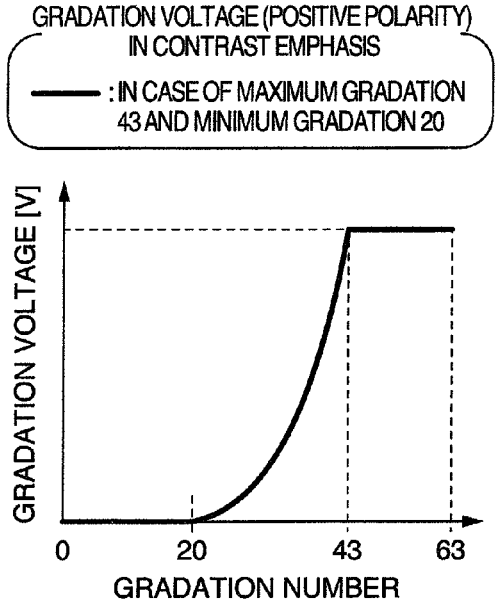
Figure 25C:
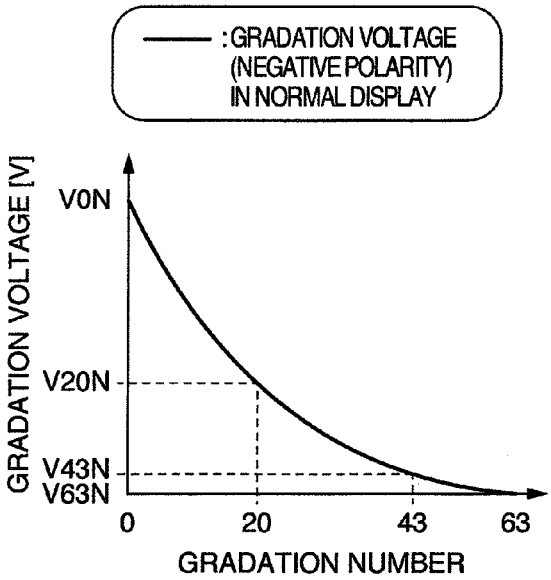
Figure 25D:
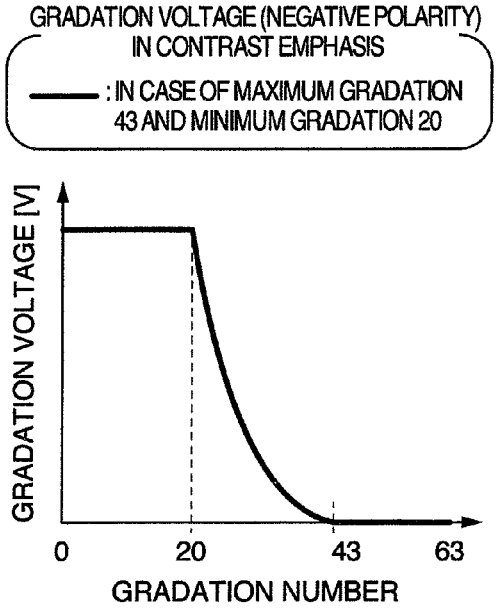

FIGS. 25A to 25D are graphs showing characteristics in the normal display and the contrast emphasis of the positive polarity gradation voltage and the negative polarity gradation voltage. FIGS. 25A and 25C are graphs showing characteristics of the positive polarity gradation voltage and the negative polarity gradation voltage in the normal display, respectively, and FIGS. 25B and 25D are graphs showing characteristics of the positive polarity gradation voltage and the negative polarity gradation voltage in the contrast emphasis of the embodiment. FIGS. 25B and 25D show the characteristics in case where the maximum gradation in the display data is smaller than or equal to 43 and the minimum gradation thereof is larger than or equal to 20.

Embodiment 7

Figure 26:
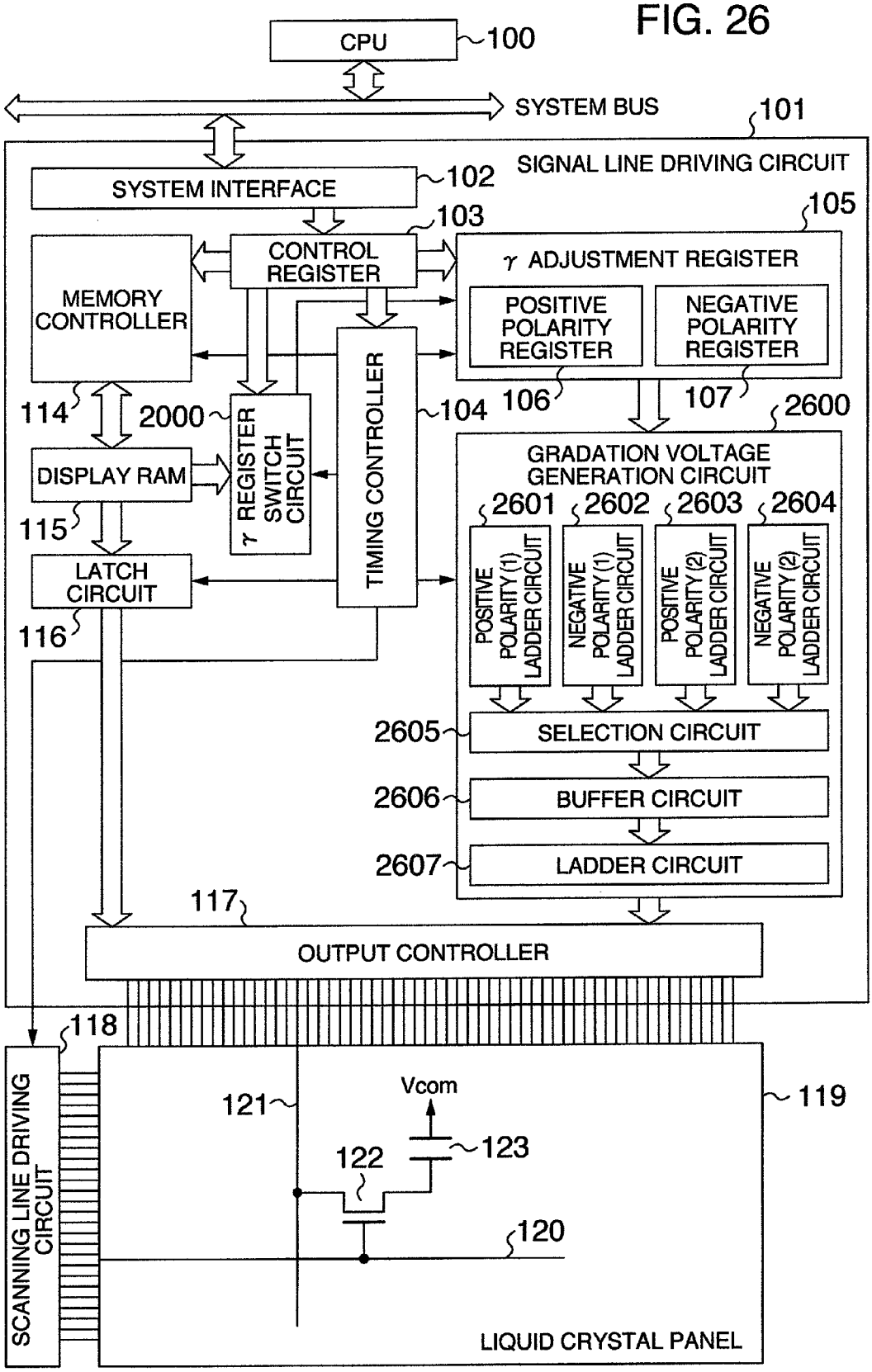
FIG. 26 is a schematic diagram illustrating a liquid crystal display apparatus according to an embodiment 7 of the present invention.

FIG. 26 is a schematic diagram illustrating a liquid crystal display apparatus of the embodiment including a gradation voltage generation circuit 2600 different from the gradation voltage generation circuit 108 shown in FIG. 20. Other configuration is the same as that of FIG. 20.

In the gradation voltage generation circuit 2600 shown in FIG. 26, numeral 2601 denotes a positive polarity (1) ladder circuit, 2602 a negative polarity (1) ladder circuit, 2603 a positive polarity (2) ladder circuit, 2604 a negative polarity (2) ladder circuit, which function as reference ladder circuits 2601 to 2604, 2605 a selection circuit, 2606 a buffer circuit and 2607 a gradation voltage ladder circuit.

In case of the normal display in which the contrast is not emphasized, the γ adjustment register 105 supplies the register value held in the positive polarity register 106 to the positive polarity (1) ladder circuit 2601 and supplies the register value held in the negative polarity register 107 to the negative polarity (1) ladder circuit 2602.

When the contrast is not emphasized, the γ adjustment register 105 supplies the register value held in the positive polarity register 106 to the positive polarity (2) ladder circuit 2603 and supplies the register value held in the negative polarity register 107 to the negative polarity (2) ladder circuit 2604.

These ladder circuits generate the reference voltages in accordance with the inputted register values to be supplied to the selection circuit 2605. The selection circuit 2605 selects one kind of reference voltage from the two kinds of reference voltages inputted from the ladder circuits and supplies it to the buffer circuit 2606. The buffer circuit 2606 buffers the inputted reference voltage by the voltage follower circuit and supplies it to the gradation voltage ladder circuit 2607. The gradation voltage ladder circuit 2607 divides the inputted reference voltage by resistors to generate the gradation voltages of 64 levels and supplies them to the output control circuit 117.

As described above, by providing the dedicated positive polarity (2) ladder circuit 2603 and negative polarity (2) ladder circuit 2604 when the contrast is emphasized, it is not necessary to generate the reference voltage in accordance with the normal display and the contrast emphasis display when the normal display and the contrast emphasis display are often switched. Accordingly, the driving ability of the gradation voltage (reduction in variation time of the gradation voltage) can be improved as compared with the above-mentioned embodiments.

The circuit configuration of the positive polarity (1) ladder circuit 2601, the negative polarity (1) ladder circuit 2602, the positive polarity (2) ladder circuit 2603 and the negative polarity (2) ladder circuit 2604 of the embodiment may adopt the circuit configuration of the positive polarity ladder circuit 109 shown in FIG. 14 and the negative polarity ladder circuit 110 shown in FIG. 15 or the positive polarity ladder circuit 109 shown in FIG. 17 and the negative polarity ladder circuit 110 shown in FIG. 18.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display apparatus comprising:

a display panel including a plurality of pixels; and a driving circuit to drive the display panel;

the driving circuit including a register in which a set value for generating gradation voltages corresponding to display data inputted from an external system is stored, a reference ladder circuit to generate reference voltages in accordance with the set value, a buffer circuit to buffer the reference voltages to be outputted, a gradation voltage ladder circuit to generate gradation voltages on the basis of the reference voltages and an output control circuit to select gradation voltages corresponding to the display data from the gradation voltages to be outputted;

the reference ladder circuit including fixed resistors and variable resistors having resistance values to be controlled by the set value;

the fixed resistors including switches, wherein the reference ladder circuit includes:

a first variable resistor having one end connected to a reference high voltage source, a first fixed resistor connected in series to the first variable resistor and a first switch connected in parallel to the first fixed resistor;

a second variable resistor connected in series to the first fixed resistor, a second fixed resistor connected in series to the second variable resistor and a second switch connected in parallel to the second fixed resistor;

a third variable resistor connected in series to the second fixed resistor, a third fixed resistor connected in series to the third variable resistor and a third switch connected in parallel to the third fixed resistor;

a fourth variable resistor connected in series to the third fixed resistor, a fourth fixed resistor connected in series to the fourth variable resistor and a fourth switch connected in parallel to the fourth fixed resistor;

a fifth variable resistor connected in series to the fourth fixed resistor, a fifth fixed resistor connected in series to the fifth variable resistor and a fifth switch connected in parallel to the fifth fixed resistor;

a sixth variable resistor connected in series to the fifth fixed resistor, a seventh variable resistor connected in series to the sixth variable resistor and a sixth fixed resistor connected in series to the seventh variable resistor;

an eighth variable resistor connected in series to the sixth fixed resistor;

a ninth variable resistor connected in series to the eighth variable resistor, a seventh fixed resistor connected in series to the ninth variable resistor and a sixth switch connected in parallel to the seventh fixed resistor;

a tenth variable resistor connected in series to the seventh fixed resistor, an eighth fixed resistor connected in series to the tenth variable resistor and a seventh switch connected in parallel to the eighth fixed resistor;

an eleventh variable resistor connected in series to the eighth fixed resistor, a ninth fixed resistor connected in series to the eleventh variable resistor and an eighth switch connected in parallel to the ninth fixed resistor;

a twelfth variable resistor connected in series to the ninth fixed resistor, a tenth fixed resistor connected in series to the twelfth variable resistor and a ninth switch connected in parallel to the tenth fixed resistor;

a thirteenth variable resistor connected in series to the tenth fixed resistor, an eleventh fixed resistor connected in series to the thirteenth variable resistor and a tenth switch connected in parallel to the eleventh fixed resistor; and a fourteenth variable resistor connected in series to the eleventh fixed resistor and a twelfth fixed resistor connected in series to the fourteenth variable resistor and having one end connected to a reference low voltage source; and a first reference voltage is generated from a junction between the first variable resistor and the first fixed resistor;

a second reference voltage being generated from a junction between the second variable resistor and the second fixed resistor;

a third reference voltage being generated from a junction between the third variable resistor and the third fixed resistor;

a fourth reference voltage being generated from a junction between the fourth variable resistor and the fourth fixed resistor;

a fifth reference voltage being generated from a junction between the fifth variable resistor and the fifth fixed resistor;

a sixth reference voltage being generated from a junction between the sixth variable resistor and the seventh variable resistor;

a seventh reference voltage being generated from a junction between the eighth variable resistor and the ninth variable resistor;

an eighth reference voltage being generated from a junction between the seventh fixed resistor and the tenth variable resistor;

a ninth reference voltage being generated from a junction between the eighth fixed resistor and the eleventh variable resistor;

a tenth reference voltage being generated from a junction between the ninth fixed resistor and the twelfth variable resistor;

an eleventh reference voltage being generated from a junction between the tenth fixed resistor and the thirteenth variable resistor;

a twelfth reference voltage being generated from a junction between the eleventh fixed resistor and the fourteenth variable resistor.

2. A display apparatus according to claim 1, wherein the driving circuit controls the first to fifth switches to be short-circuited and the second to sixth variable resistors to be zero in dark fields (or light fields) so that the first to fifth reference voltages are made substantially equal and controls the sixth to tenth switches to be short-circuited and the ninth to thirteenth variable resistors to be zero in the light fields (or the dark fields) so that the seventh to twelfth reference voltages are made substantially equal.

3. A display apparatus according to claim 1, wherein the reference ladder circuit includes a positive polarity ladder circuit to generate positive polarity gradation voltages and a negative polarity ladder circuit to generate negative polarity gradation voltages.

4. A display apparatus comprising:

a display panel including a plurality of pixels; and a driving circuit to drive the display panel;

the driving circuit including a register in which a set value for generating gradation voltages corresponding to display data inputted from an external system is stored, a reference ladder circuit to generate reference voltages in accordance with the set value, a buffer circuit to buffer the reference voltages to be outputted, a gradation voltage ladder circuit to generate gradation voltages on the basis of the reference voltages and an output control circuit to select gradation voltages corresponding to the display data from the gradation voltages to be outputted;

the reference ladder circuit including fixed resistors and variable resistors having resistance values to be controlled by the set value;

the fixed resistors including switches, wherein the reference ladder circuit includes:

a first variable resistor having one end connected to a reference high voltage source, a first fixed resistor connected in series to the first variable resistor and a first switch connected in parallel to the first fixed resistor;

a second variable resistor connected in series to the first fixed resistor, a second fixed resistor connected in series to the second variable resistor and a second switch connected in parallel to the second fixed resistor;

a third variable resistor connected in series to the second fixed resistor, a third fixed resistor connected in series to the third variable resistor and a third switch connected in parallel to the third fixed resistor;

a fourth variable resistor connected in series to the third fixed resistor, a fourth fixed resistor connected in series to the fourth variable resistor and a fourth switch connected in parallel to the fourth fixed resistor;

a fifth variable resistor connected in series to the fourth fixed resistor, a fifth fixed resistor connected in series to the fifth variable resistor and a fifth switch connected in parallel to the fifth fixed resistor;

a sixth variable resistor connected in series to the fifth fixed resistor;

a seventh variable resistor connected in series to the sixth variable resistor, a sixth fixed resistor connected in series to the seventh variable resistor and a sixth switch connected in parallel to the sixth fixed resistor;

an eighth variable resistor connected in series to the sixth fixed resistor;

a ninth variable resistor connected in series to the eighth variable resistor, a seventh fixed resistor connected in series to the ninth variable resistor and a seventh switch connected in parallel to the seventh fixed resistor;

a tenth variable resistor connected in series to the seventh fixed resistor, an eighth fixed resistor connected in series to the tenth variable resistor and a eighth switch connected in parallel to the eighth fixed resistor;

an eleventh variable resistor connected in series to the eighth fixed resistor, a ninth fixed resistor connected in series to the eleventh variable resistor and a ninth switch connected in parallel to the ninth fixed resistor;

a twelfth variable resistor connected in series to the ninth fixed resistor, a tenth fixed resistor connected in series to the twelfth variable resistor and a tenth switch connected in parallel to the tenth fixed resistor;

a thirteenth variable resistor connected in series to the tenth fixed resistor, an eleventh fixed resistor connected in series to the thirteenth variable resistor and an eleventh switch connected in parallel to the eleventh fixed resistor; and a fourteenth variable resistor connected in series to the eleventh fixed resistor and a twelfth fixed resistor connected in series to the fourteenth variable resistor and having one end connected to a reference low voltage source; and a first reference voltage is generated from a junction between the first variable resistor and the first fixed resistor;

a second reference voltage being generated from a junction between the second variable resistor and the second fixed resistor;

a third reference voltage being generated from a junction between the third variable resistor and the third fixed resistor;

a fourth reference voltage being generated from a junction between the fourth variable resistor and the fourth fixed resistor;

a fifth reference voltage being generated from a junction between the fifth variable resistor and the fifth fixed resistor;

a sixth reference voltage being generated from a junction between the sixth variable resistor and the seventh variable resistor;

a seventh reference voltage being generated from a junction between the eighth variable resistor and the ninth variable resistor;

an eighth reference voltage being generated from a junction between the seventh fixed resistor and the tenth variable resistor;

a ninth reference voltage being generated from a junction between the eighth fixed resistor and the eleventh variable resistor;

a tenth reference voltage being generated from a junction between the ninth fixed resistor and the twelfth variable resistor;

an eleventh reference voltage being generated from a junction between the tenth fixed resistor and the thirteenth variable resistor;

a twelfth reference voltage being generated from a junction between the eleventh fixed resistor and the fourteenth variable resistor.

5. A display apparatus according to claim 4, wherein the driving circuit controls the first to eleventh switches to be short-circuited so that the first to seventh reference voltages are made substantially equal in the dark fields and controls resistance values of the tenth to thirteenth variable resistors on the basis of a set value from a third register so that the eighth to twelfth reference voltages are made different.

6. A display apparatus comprising:

a display panel including a plurality of pixels; and a driving circuit to drive the display panel;

the driving circuit including a register in which a set value for generating gradation voltages corresponding to display data inputted from an external system is stored, a reference ladder circuit to generate reference voltages in accordance with the set value, a buffer circuit to buffer the reference voltages to be outputted, a gradation voltage ladder circuit to generate gradation voltages on the basis of the reference voltages and an output control circuit to select gradation voltages corresponding to the display data from the gradation voltages to be outputted;

the reference ladder circuit including fixed resistors and variable resistors having resistance values to be controlled by the set value;

the fixed resistors including switches, wherein the driving circuit switches between a first case where brightness corresponding to the display data is displayed during one frame period and a second case where one frame period is divided into fields so that one or more fields of the divided fields are defined as dark fields where low a brightness display is made and the other fields are defined as light fields where a high brightness display is made and brightness corresponding to the display data is displayed by average brightness of the dark and light fields in response to a control signal inputted from the external system; and the register includes a first register in which the set value for generating the gradation voltages corresponding to the first case is stored, a second register in which the set value for generating the gradation voltages corresponding to the light fields is stored and a third register in which the set value for generating the gradation voltages corresponding to the dark fields is stored;

in the first case, the reference ladder circuit being controlled by the first register;

in the second case, the reference ladder circuit being controlled by the second register in the light fields and controlled by the third register in the dark fields.

7. A display apparatus according to claim 6, wherein the reference ladder circuit includes a positive polarity ladder circuit to generate positive polarity gradation voltages and a negative polarity ladder circuit to generate negative polarity gradation voltages.

8. A display apparatus comprising:

a display panel including a plurality of pixels; and a driving circuit to drive the display panel;

the driving circuit including a register in which a set value for generating gradation voltages corresponding to display data inputted from an external system is stored, a reference ladder circuit to generate reference voltages in accordance with the set value, a buffer circuit to buffer the reference voltages to be outputted, a gradation voltage ladder circuit to generate gradation voltages on the basis of the reference voltages and an output control circuit to select gradation voltages corresponding to the display data from the gradation voltages to be outputted;

the reference ladder circuit including fixed resistors and variable resistors having resistance values to be controlled by the set value;

the fixed resistors including switches, wherein the reference ladder circuit includes:

a positive polarity ladder circuit to generate positive polarity gradation voltages for light fields;

a negative polarity ladder circuit to generate negative polarity gradation voltages for light fields;

a positive polarity ladder circuit to generate positive polarity gradation voltages for dark fields; and a negative polarity ladder circuit to generate negative polarity gradation voltages for dark fields; and in a first case, the positive polarity ladder circuit and the negative polarity ladder circuit for the light fields (or the dark fields) are used to generate the reference voltages;

in a second case, the positive polarity (or negative polarity) ladder circuit being used in accordance with the positive polarity (or negative polarity) in the light fields (or dark fields) to generate the reference voltages.

9. A display apparatus comprising:

a display panel including a plurality of pixels; and a driving circuit to drive the display panel;

the driving circuit including a register in which a set value for generating gradation voltages corresponding to input display data is stored, a reference ladder circuit to generate reference gradation voltages in accordance with the set value, a buffer circuit to buffer the reference gradation voltages to be outputted, a gradation voltage ladder circuit to generate gradation voltages on the basis of the reference gradation voltages and an output control circuit to select gradation voltages corresponding to the input display data from the gradation voltages to be outputted;

the reference ladder circuit including variable resistors, fixed resistors connected in series to the variable resistors and switches connected in parallel to the fixed resistors, the variable resistors and the switches being controlled on the basis of the set value to control contrast characteristics, wherein the reference ladder circuit includes:

a first variable resistor having one end connected to a reference high voltage source, a first fixed resistor connected in series to the first variable resistor and a first switch connected in parallel to the first fixed resistor;

a second variable resistor connected in series to the first fixed resistor, a second fixed resistor connected in series to the second variable resistor and a second switch connected in parallel to the second fixed resistor;

a third variable resistor connected in series to the second fixed resistor, a third fixed resistor connected in series to the third variable resistor and a third switch connected in parallel to the third fixed resistor;

a fourth variable resistor connected in series to the third fixed resistor, a fourth fixed resistor connected in series to the fourth variable resistor and a fourth switch connected in parallel to the fourth fixed resistor;

a fifth variable resistor connected in series to the fourth fixed resistor, a fifth fixed resistor connected in series to the fifth variable resistor and a fifth switch connected in parallel to the fifth fixed resistor;

a sixth variable resistor connected in series to the fifth fixed resistor, a seventh variable resistor connected in series to the sixth variable resistor and a sixth fixed resistor connected in series to the seventh variable resistor;

an eighth variable resistor connected in series to the sixth fixed resistor;

a ninth variable resistor connected in series to the eighth variable resistor, a seventh fixed resistor connected in series to the ninth variable resistor and a sixth switch connected in parallel to the seventh fixed resistor;

a tenth variable resistor connected in series to the seventh fixed resistor, an eighth fixed resistor connected in series to the tenth variable resistor and a seventh switch connected in parallel to the eighth fixed resistor;

an eleventh variable resistor connected in series to the eighth fixed resistor, a ninth fixed resistor connected in series to the eleventh variable resistor and an eighth switch connected in parallel to the ninth fixed resistor;

a twelfth variable resistor connected in series to the ninth fixed resistor, a tenth fixed resistor connected in series to the twelfth variable resistor and a ninth switch connected in parallel to the tenth fixed resistor;

a thirteenth variable resistor connected in series to the tenth fixed resistor, an eleventh fixed resistor connected in series to the thirteenth variable resistor and a tenth switch connected in parallel to the eleventh fixed resistor; and a fourteenth variable resistor connected in series to the eleventh fixed resistor and a twelfth fixed resistor connected in series to the fourteenth variable resistor and having one end connected to a reference low voltage source; and a first reference voltage is generated from a junction between the first variable resistor and the first fixed resistor;

a second reference voltage being generated from a junction between the second variable resistor and the second fixed resistor;

a third reference voltage being generated from a junction between the third variable resistor and the third fixed resistor;

a fourth reference voltage being generated from a junction between the fourth variable resistor and the fourth fixed resistor;

a fifth reference voltage being generated from a junction between the fifth variable resistor and the fifth fixed resistor;

a sixth reference voltage being generated from a junction between the sixth variable resistor and the seventh variable resistor;

a seventh reference voltage being generated from a junction between the eighth variable resistor and the ninth variable resistor;

an eighth reference voltage being generated from a junction between the seventh fixed resistor and the tenth variable resistor;

a ninth reference voltage being generated from a junction between the eighth fixed resistor and the eleventh variable resistor;

a tenth reference voltage being generated from a junction between the ninth fixed resistor and the twelfth variable resistor;

an eleventh reference voltage being generated from a junction between the tenth fixed resistor and the thirteenth variable resistor;

a twelfth reference voltage being generated from a junction between the eleventh fixed resistor and the fourteenth variable resistor.

10. A display apparatus according to claim 9, wherein the first to fifth switches are short-circuited to make the first to sixth variable resistors zero, so that the first to sixth reference voltages are made equal and the sixth to tenth switches are short-circuited to make the ninth to fourteenth variable resistors zero, so that the seventh to twelfth reference voltages are made equal.

11. A display apparatus according to claim 9, wherein the reference ladder circuit includes a positive polarity ladder circuit to generate positive polarity gradation voltages and a negative polarity ladder circuit to generate negative polarity gradation voltages.

12. A display apparatus according to claim 9, wherein the variable resistors of the reference ladder circuit are controlled in accordance with maximum and minimum gradations in the input display data.

13. A display apparatus according to claim 9, wherein the reference ladder circuit includes positive and negative polarity ladder circuits for normal display and positive and negative polarity ladder circuits for contrast emphasis.

14. A display apparatus comprising:

a display panel including a plurality of pixels; and a driving circuit to drive the display panel;

the driving circuit including a register in which a set value for generating gradation voltages corresponding to input display data is stored, a reference ladder circuit to generate reference gradation voltages in accordance with the set value, a buffer circuit to buffer the reference gradation voltages to be outputted, a gradation voltage ladder circuit to generate gradation voltages on the basis of the reference gradation voltages and an output control circuit to select gradation voltages corresponding to the input display data from the gradation voltages to be outputted;

the reference ladder circuit including variable resistors, fixed resistors connected in series to the variable resistors and switches connected in parallel to the fixed resistors, the variable resistors and the switches being controlled on the basis of the set value to control contrast characteristics, wherein the reference ladder circuit includes:

a first variable resistor having one end connected to a reference high voltage source, a first fixed resistor connected in series to the first variable resistor and a first switch connected in parallel to the first fixed resistor;

a second variable resistor connected in series to the first fixed resistor, a second fixed resistor connected in series to the second variable resistor and a second switch connected in parallel to the second fixed resistor;

a third variable resistor connected in series to the second fixed resistor, a third fixed resistor connected in series to the third variable resistor and a third switch connected in parallel to the third fixed resistor;

a fourth variable resistor connected in series to the third fixed resistor, a fourth fixed resistor connected in series to the fourth variable resistor and a fourth switch connected in parallel to the fourth fixed resistor;

a fifth variable resistor connected in series to the fourth fixed resistor, a fifth fixed resistor connected in series to the fifth variable resistor and a fifth switch connected in parallel to the fifth fixed resistor;

a sixth variable resistor connected in series to the fifth fixed resistor;

a seventh variable resistor connected in series to the sixth variable resistor, a sixth fixed resistor connected in series to the seventh variable resistor and a sixth switch connected in parallel to the sixth fixed resistor;

an eighth variable resistor connected in series to the sixth fixed resistor;

a ninth variable resistor connected in series to the eighth variable resistor, a seventh fixed resistor connected in series to the ninth variable resistor and a seventh switch connected in parallel to the seventh fixed resistor;

a tenth variable resistor connected in series to the seventh fixed resistor, an eighth fixed resistor connected in series to the tenth variable resistor and an eighth switch connected in parallel to the eighth fixed resistor;

an eleventh variable resistor connected in series to the eighth fixed resistor, a ninth fixed resistor connected in series to the eleventh variable resistor and a ninth switch connected in parallel to the ninth fixed resistor;

a twelfth variable resistor connected in series to the ninth fixed resistor, a tenth fixed resistor connected in series to the twelfth variable resistor and a tenth switch connected in parallel to the tenth fixed resistor;

a thirteenth variable resistor connected in series to the tenth fixed resistor, an eleventh fixed resistor connected in series to the thirteenth variable resistor and an eleventh switch connected in parallel to the eleventh fixed resistor; and a fourteenth variable resistor connected in series to the eleventh fixed resistor and a twelfth fixed resistor connected in series to the fourteenth variable resistor and having one end connected to a reference low voltage source; and a first reference voltage is generated from a junction between the first variable resistor and the first fixed resistor;

a second reference voltage being generated from a junction between the second variable resistor and the second fixed resistor;

a third reference voltage being generated from a junction between the third variable resistor and the third fixed resistor;

a fourth reference voltage being generated from a junction between the fourth variable resistor and the fourth fixed resistor;

a fifth reference voltage being generated from a junction between the fifth variable resistor and the fifth fixed resistor;

a sixth reference voltage being generated from a junction between the sixth variable resistor and the seventh variable resistor;

a seventh reference voltage being generated from a junction between the eighth variable resistor and the ninth variable resistor;

an eighth reference voltage being generated from a junction between the seventh fixed resistor and the tenth variable resistor;

a ninth reference voltage being generated from a junction between the eighth fixed resistor and the eleventh variable resistor;

a tenth reference voltage being generated from a junction between the ninth fixed resistor and the twelfth variable resistor;

an eleventh reference voltage being generated from a junction between the tenth fixed resistor and the thirteenth variable resistor;

a twelfth reference voltage being generated from a junction between the eleventh fixed resistor and the fourteenth variable resistor.

15. A display apparatus according to claim 14, wherein the first to eleventh switches are short-circuited to make the first to seventh reference voltages equal and resistance values of the tenth to fourteenth resistors are controlled on the basis of the set value to make the eighth to twelfth reference voltages different.

16. A display apparatus according to claim 14, wherein the reference ladder circuit includes a positive polarity ladder circuit to generate positive polarity gradation voltages and a negative polarity ladder circuit to generate negative polarity gradation voltages.

17. A display apparatus according to claim 14, wherein the variable resistors of the reference ladder circuit are controlled in accordance with maximum and minimum gradations in the input display data.

18. A display apparatus according to claim 14, wherein the reference ladder circuit includes positive and negative polarity ladder circuits for normal display and positive and negative polarity ladder circuits for contrast emphasis.

* * * * *